US007678333B2

(12) United States Patent
Reynolds et al.

(10) Patent No.: US 7,678,333 B2
(45) Date of Patent: Mar. 16, 2010

(54) FLUID TRANSFER ASSEMBLY FOR PHARMACEUTICAL DELIVERY SYSTEM AND METHOD FOR USING SAME

(75) Inventors: David L. Reynolds, Bromont (CA); Daniel MacDonald, Bromont (CA); Julie Trépanier, Rock Forest (CA)

(73) Assignee: Duoject Medical Systems Inc., Bromont, Quebec (CA)

( * ) Notice: Subject to any disclaimer, the term of this patent is extended or adjusted under 35 U.S.C. 154(b) by 1145 days.

(21) Appl. No.: 11/197,439

(22) Filed: Aug. 5, 2005

(65) Prior Publication Data

US 2007/0078428 A1 Apr. 5, 2007

Related U.S. Application Data

(63) Continuation-in-part of application No. 10/540,230, filed as application No. PCT/CA2004/000064 on Jan. 22, 2004.

(60) Provisional application No. 60/441,352, filed on Jan. 22, 2003, provisional application No. 60/518,345, filed on Nov. 10, 2003.

(51) Int. Cl.
*B01L 3/02* (2006.01)
*B01L 99/00* (2006.01)

(52) U.S. Cl. ..... 422/100; 422/99; 422/103; 73/864.82

(58) Field of Classification Search ..... 422/100, 422/102–104, 63, 99; 73/864.82
See application file for complete search history.

(56) References Cited

U.S. PATENT DOCUMENTS 3,490,437 A 1/1970 Bakondy et al.

(Continued)

FOREIGN PATENT DOCUMENTS

CH 676548 2/1991

GB 1372549 10/1974

(Continued)

OTHER PUBLICATIONS

Kimble Kontes: "Micro-Vial KG-33 Borosilicate Glass, Screw Thread, Graduated, with Solid Top Closure and PTFE-Faced 14-B White Rubber Liner". Accessed on the Internet on Jul. 20, 2005.

(Continued)

*Primary Examiner*—Brian R Gordon
(74) *Attorney, Agent, or Firm*—Eric Fincham

(57) ABSTRACT

The present invention provides a transfer assembly for transferring a fluid between a vessel and a vial and a method for using same. The vial may be a maximum recovery vial. The vessel has a body with an open end and a slidable piston positioned within the body through the open end. The maximum recovery vial has an inner chamber with an open end and a closed end and a penetrable seal covering the open end of the inner chamber. The transfer assembly includes a housing having first and second open ends and a bore extending between the first and second open ends. The housing is connectable to the piston. The transfer assembly also includes a conduit having first and second ends and first and second apertures adjacent to the first and second ends, respectively. The conduit is longitudinally slidable within the bore between a retracted position in which the first aperture is positioned within at least one of the housing and the piston when the housing is connected to the piston, and an activated position in which the first aperture protrudes through the piston into the body of the vessel when the housing is connected to the piston. The transfer assembly also includes a vial socket assembly having a vial socket and a hollow piercing member. The vial socket is sized and shaped for receiving and engaging at least a portion of the maximum recovery vial including the penetrable seal. The hollow piercing member has a first open end in fluid communication with the conduit and a second open end for piercing the penetrable seal of the maximum recovery vial. The hollow piercing member is sized to extend substantially the full length of the inner chamber of the maximum recovery vial when the maximum recovery vial is fully engaged in the vial socket. The vial socket assembly is moveable longitudinally relative to the housing in concert with the conduit.

27 Claims, 35 Drawing Sheets

U.S. PATENT DOCUMENTS

| | | | | | |
|---|---|---|---|---|---|
| 3,563,373 | A | | 2/1971 | Paulson | |
| 3,977,555 | A | * | 8/1976 | Larson | 215/247 |
| 4,180,070 | A | | 12/1979 | Genese | |
| 4,191,225 | A | | 3/1980 | Ogle | |
| 4,259,956 | A | | 4/1981 | Ogle | |
| 4,861,335 | A | | 8/1989 | Reynolds | |
| 4,976,925 | A | * | 12/1990 | Porcher et al. | 422/100 |
| 5,069,670 | A | | 12/1991 | Vetter et al. | |
| 5,080,649 | A | | 1/1992 | Vetter | |
| 5,360,012 | A | * | 11/1994 | Ebara et al. | 600/577 |
| 5,393,497 | A | * | 2/1995 | Haber et al. | 422/103 |
| 5,514,339 | A | * | 5/1996 | Leopardi et al. | 422/99 |
| 5,536,476 | A | * | 7/1996 | Baxter | 422/102 |
| 5,569,191 | A | | 10/1996 | Meyer | |
| 5,603,695 | A | | 2/1997 | Erickson | |
| 5,607,399 | A | | 3/1997 | Grimard et al. | |
| 5,667,495 | A | | 9/1997 | Bitdinger et al. | |
| 5,700,247 | A | | 12/1997 | Grimard et al. | |
| 5,709,666 | A | | 1/1998 | Reynolds | |
| 5,750,075 | A | * | 5/1998 | Spike | 422/102 |
| 5,791,466 | A | | 8/1998 | Tsals | |
| 5,795,337 | A | | 8/1998 | Grimard | |
| 5,803,918 | A | | 9/1998 | Vetter et al. | |
| 5,833,659 | A | | 11/1998 | Vetter et al. | |
| 6,149,623 | A | | 11/2000 | Reynolds | |
| 6,746,438 | B1 | | 6/2004 | Arnisolle | |
| 6,752,030 | B2 | * | 6/2004 | Egas et al. | 73/864.74 |
| 2003/0180193 | A1 | * | 9/2003 | Ruther et al. | 422/103 |

FOREIGN PATENT DOCUMENTS

| | | |
|---|---|---|
| WO | WO 93/09825 | 5/1993 |
| WO | WO 95/32015 | 11/1995 |
| WO | WO 00/13723 | 3/2000 |
| WO | WO 00/54723 | 9/2000 |
| WO | WO 2004/064706 | 8/2004 |

OTHER PUBLICATIONS

Kimble Kontes: "Micro-Vial, KG-33 Borosilicate Glass, Aluminum Seal, Graduated, Without Closure". Accessed on the Internet on Jul. 20, 2005.

Sigma-Alorich: "Combi-Vial". Accessed on the Internet on Jul. 19, 2005.

Waters Corporation: "Water Vials Product Brochure". Accessed on the Internet on Jul. 19, 2005.

* cited by examiner

FLUID TRANSFER ASSEMBLY FOR PHARMACEUTICAL DELIVERY SYSTEM AND METHOD FOR USING SAME

CROSS REFERENCE TO RELATED APPLICATIONS

This application is a continuation-in-part of co-pending U.S. patent application Ser. No. 10/540,230, entitled "Pharmaceutical delivery systems and methods for using same", which is the National Stage of International Application No. PCT/CA2004/000064, filed Jan. 22, 2004, which claims the benefit of U.S. Provisional Application No. 60/441,352 filed on Jan. 22, 2003 and U.S. Provisional Application No. 60/518,345 filed on Nov. 10, 2003.

FIELD OF THE INVENTION

The present invention generally relates to fluid transfer assemblies for pharmaceutical delivery systems, and to methods for using same. More specifically, it relates to an assembly for transferring one or more components of a pharmaceutical composition from a pharmaceutical vial to a syringe or vice versa.

BACKGROUND OF THE INVENTION

Traditionally, a syringe is filled manually by aspirating a liquid pharmaceutical component from a pharmaceutical vial having a neck with a penetrable closure into the syringe through a needle that penetrates the penetrable closure. The method of manually filling the syringe typically includes the following steps: (a) drawing air into the body of the syringe by pulling the syringe's plunger away from the needle end of the syringe until the volume of air in the body approximately equals the volume of pharmaceutical component to be loaded into the syringe; (b) carefully aligning the needle with the vial's penetrable closure and inserting the needle through the penetrable closure into the vial; (c) inverting the vial and forcing the air from the body of the syringe into the vial by advancing the syringe's plunger; (d) withdrawing the plunger to draw out the desired volume of the pharmaceutical component into the syringe; and (e) removing the needle from the vial.

This method suffers from various disadvantages. Firstly, the user is exposed to the unprotected needle tip, which can result in accidental stabbings or prickings to the user. Secondly, if the user wishes to draw a large volume of the pharmaceutical component into the syringe (e.g., 10 cc) an equivalent volume of air must be forced into the vial. This can increase the pressure in the pharmaceutical vial to the point where the pharmaceutical component may spray through the puncture point made by the needle in the penetrable seal and onto the user. These accidents are particularly dangerous if the pharmaceutical component is unsafe to the user, for example where it includes toxic oncology pharmaceuticals. Thirdly, the sterility of the needle may be compromised during the process of transferring the pharmaceutical component from the vial to the syringe.

Additionally, many pharmaceutical preparations must be distributed and stored as two or more separate components, for example such as a solid lyophilized component and a liquid component. The two components are mixed just prior to administration. In the case of a solid and liquid component, the pharmaceutical preparation may be reconstituted by: (a) providing a first solid component packaged in a pharmaceutical vial having a neck closed by a penetrable closure; (b) providing a second liquid component in a syringe; (c) injecting the second liquid component into the vial through the penetrable closure; (d) swirling the vial impaled on the syringe to dissolve, dilute or suspend the first solid component in the second component; and (e) aspirating the combined components back into the syringe. Alternatively, the two or more components may be liquid and require mixing just prior to administration. The mixing may be accomplished in an analogous manner. These methods suffer from many of the disadvantages described above.

Some medical treatments require the administration of a relatively small dosage of a pharmaceutical composition. Examples of such medical treatments include, but are not limited to, ocular treatments, ovulation induction treatments, tuberculin tests, and diabetes treatment. In some cases, the composition can be relatively viscous, which may tend to cause some of the composition to remain or be "held up" in the vial. These types of pharmaceutical compositions tend to be very expensive both to manufacture and administer. For these reasons, it is desirable to minimize the volume of pharmaceutical composition that is "held up" or left behind in the dispensing container.

For vials containing a pharmaceutical component in lyophilized form, there can be a tendency of the pharmaceutical component to cake onto the inner walls of the vial during lyophilization. Such caking of the lyophilized pharmaceutical component on the vial walls can make mixing of the component with a diluent more difficult.

SUMMARY OF THE INVENTION

Embodiments of the invention aim to address or ameliorate one or more of the above-described problems or shortcomings, or to at least provide a useful alternative to existing methods, systems or devices.

In one aspect of the invention, a transfer assembly is provided for transferring a fluid between a vessel and a vial. The vessel has a body with an open end and a slidable piston positioned within the body through the open end. The vial has an inner chamber with an open end and a closed end and a penetrable seal covering the open end of the inner chamber. The closed end tapers toward an apex. The transfer assembly comprises:

a housing having first and second open ends and a bore extending between the first and second open ends, the housing being connectable to the piston;

a conduit having first and second ends and first and second apertures adjacent to the first and second ends, respectively, the conduit being longitudinally slidable within the bore between a retracted position in which the first aperture is positioned within at least one of the housing and the piston when the housing is connected to the piston, and an activated position in which the first end protrudes through the piston so that the first aperture is in fluid communication with a chamber of the vessel when the housing is connected to the piston;

a vial socket assembly having a vial socket and a hollow piercing member, the vial socket being sized and shaped for receiving and engaging at least a portion of the vial including the penetrable seal, the hollow piercing member having a first open end in fluid communication with the conduit and a second open end for piercing the penetrable seal, the hollow piercing member being sized to extend substantially the full length of the inner chamber of the vial so that the second open end of the hollow piercing member is positioned adjacent the apex of the closed end of the inner chamber when the vial is fully engaged in the vial socket, the vial socket assembly being moveable longitudinally relative to the housing in concert with the conduit so that moving the vial socket assembly longitudinally toward the housing advances the conduit from the retracted position to the activated position to fluidly connect the chamber of the vessel and the inner chamber of the vial.

In one embodiment, the vial socket has an outer wall of sufficient length to substantially overlie an outer wall of the vial. Preferably, the vial socket includes a radially extending flange on its outer wall to assist manual insertion of the vial into the vial socket. Preferably, the vial socket includes retention means for retaining the vial in the vial socket when the vial is fully engaged within the vial socket.

In one embodiment, the inner chamber of the maximum recovery vial is sized to contain a volume of fluid of about 0.5 mL. In other embodiments, the volume may be between about 50 μL to 10 mL.

In another aspect of the invention, a system is provided for transferring a fluid between a vessel and a vial. The system comprises:

a) a vessel having a body with an open end and a slidable piston positioned within the body through the open end;

b) a vial having an inner chamber with an open end and a closed end and a penetrable seal covering the open end of the inner chamber, the closed end tapering inwardly toward an apex;

c) a transfer assembly including:

i) a housing having first and second open ends and a bore extending between the first and second open ends, the housing being connectable to the piston;

ii) a conduit having first and second ends and first and second apertures adjacent to the first and second ends, respectively, the conduit being longitudinally slidable within the bore between a retracted position in which the first aperture is positioned within at least one of the housing and the piston when the housing is connected to the piston, and an activated position in which the first end protrudes through the piston into the body of the vessel when the housing is connected to the piston;

iii) a vial socket assembly having a vial socket and a hollow piercing member, the vial socket being sized and shaped for receiving and engaging at least a portion of the vial including the penetrable seal, the hollow piercing member having a first open end in fluid communication with the conduit and a second open end for piercing the penetrable seal, the hollow piercing member being sized to extend substantially the full length of the inner chamber so that the second open end of the hollow piercing member is positioned adjacent the apex of the closed end of the inner chamber when the vial is fully engaged in the vial socket, the vial socket assembly being moveable longitudinally relative to the housing in concert with the conduit so that moving the vial socket assembly longitudinally toward the housing advances the conduit from the retracted position to the activated position to fluidly connect the vessel and the vial.

In another aspect of the invention, a method is provided for transferring a fluid between a vessel and a vial. The method comprises the steps of:

a) providing a vessel having a body with an open end and a slidable piston positioned within the body through the open end;

b) providing a vial having an inner chamber with an open end and a closed end and a penetrable seal covering the open end of the inner chamber, the closed end tapering inwardly toward an apex;

c) providing a transfer assembly including:

i) a housing having first and second open ends and a bore extending between the first and second open ends;

ii) a conduit having first and second ends and first and second apertures adjacent to the first and second ends, respectively, the conduit longitudinally slidable within the bore between a retracted position in which the first aperture is positioned within at least one of the housing and the piston and an activated position in which the first end protrudes through the piston into the body of the vessel; and iii) a vial socket assembly having a vial socket and a hollow piercing member, the vial socket being sized and shaped for receiving and engaging at least a portion of the vial including the penetrable seal, the hollow piercing member having a first open end in fluid communication with the conduit and a second open end for piercing the penetrable seal, the vial socket assembly being moveable longitudinally relative to the housing in concert with the conduit;

d) in any order, connecting the first open end of the housing to the piston and fully inserting the vial into the vial socket so that the hollow piercing member pierces the penetrable seal and the second open end of the hollow piercing member extends substantially the full length of the inner chamber and is positioned adjacent the apex of the closed end of the inner chamber;

e) advancing the vial socket assembly relative to the housing, causing the conduit to advance from the retracted position to the activated position to fluidly connect the chamber of the vessel and the inner chamber of the vial; and f) transferring a fluid between the vessel and the vial through the conduit.

Preferably, the transferring is performed by advancing the piston and housing within the vessel.

In one embodiment of the invention, the method further comprises, prior to step (b), the step of selecting a vial having an inner chamber that is sized to contain a volume of fluid up to about 500 μL. The volume of transferred fluid is, in one particular embodiment, about 100 μL.

In one embodiment of the invention, the vessel is pre-filled with the fluid, the vial contains a pharmaceutical component, and step (f) is performed by injecting the fluid from the vessel into the vial and aspirating the contents of the vial into the vessel. In an alternative embodiment, the vial is pre-filled with the fluid and step (f) is performed by aspirating the fluid from the vial into the vessel.

The method may further comprise the step of mixing the contents of the vial after the step of injecting and before the step of aspirating. Alternatively, the method may further comprise the step of mixing the contents of the vessel after the step of aspirating.

In another embodiment, the vessel contains a pharmaceutical component, the vial is pre-filled with the fluid, and step (f) is performed by aspirating the at least one fluid from the vial into the vessel.

In a further embodiment, the method further comprises the step of mixing the contents of the vessel after the step of aspirating. The method may further comprise, subsequent to step (f), the steps of detaching the vial socket assembly from the housing and using the housing as a plunger rod to dispense the contents of the vessel through a dispensing end opposite the open end.

A vial socket assembly for use in a transfer assembly, the transfer assembly being adapted to transfer a fluid between a conduit and a vial, the vial having an inner chamber with an open end and a closed end and a penetrable seal covering the open end of the inner chamber, the closed end tapering inwardly toward an apex, the vial socket assembly comprising:

a vial socket for receiving and engaging at least a portion of the vial including the penetrable seal; and a hollow piercing member having a first open end for fluid communication with the conduit and a second open end for piercing the penetrable seal of the vial when the vial is received in the vial socket, the hollow piercing member being sized to extend substantially the full length of the inner chamber of the vial so that the second open end is positioned adjacent the apex of the closed end of the inner chamber when the vial is fully engaged within the vial socket.

Another aspect of the invention relates to a vial having an inner wall defining an inner chamber for containing a small volume of fluid. The inner chamber has an open end and an opposite closed end. A penetrable seal is receivable in the open end of the inner chamber. The inner wall graduates inwardly toward the closed end and tapers inwardly toward a point at the closed end. The vial is constructed to receive a hollow needle or other piercing conduit so that it extends the length of the inner chamber and a tip of the needle abuts or rests adjacent an apex of the closed end.

The vial also comprises an outer wall connected to, and preferably integrally formed with, the inner wall. The vial is preferably formed of glass, such as borosilicate glass. The outer wall defines an outer chamber having a closed end and open end oppositely disposed relative to the open end and closed end of the inner chamber, respectively. The outer wall is formed as a protective apron or shroud around at least the part of the inner wall defining the closed end of the inner chamber. The outer wall is preferably connected to the inner wall toward the open end of the inner chamber and extends in the direction of the closed end of the inner chamber so that the outer wall extends longitudinally beyond the apex.

In one embodiment, the inner chamber has three parts: a first part of largest diameter adjacent the open end; a second part of reduced diameter intermediate the first part and the closed end; and a third part of inwardly tapering diameter adjacent the closed end. The first part defines a first compartment and the second and third parts together define a second compartment. The inner wall may also define a transitional portion intermediate the first and second parts that tapers inwardly from the largest diameter to the reduced diameter.

The inner chamber is preferably sized so that the first and second compartments together contain between about 0.5 mL and 1.0 mL of fluid and the second compartment contains between about 0.1 mL and 0.2 mL of fluid.

The vial may also comprise a cap over the penetrable seal to hold the seal in the open end of the inner chamber. The vial may further comprise a plug received in the open end of the outer chamber or a cap covering the open end of the outer chamber.

Advantageously, embodiments of the invention employing a vial with an inner wall tapering toward a point or apex, such as vials of a class called maximum recovery vials, allow for a small amount of fluid to be stored in, or mixed within, the vial and to be withdrawn so as to leave behind only a small fraction of the fluid volume. Particularly advantageously, providing the small diameter second compartment below the larger first compartment allows a drug-containing fluid of about 0.5 mL to be contained within the inner chamber and then lyophilized to form a powder. The powder collects in the second compartment and is mixed with a viscous diluent of about 0.1 mL injected from the vessel. The viscosity of the diluent may be between about 1 and 100 cP, but is preferably between about 60 and 80 cP.

The relative viscosity and small diameter of the second compartment (for example in the order of about 3 mL) serve to induce a sufficient surface tension of the fluid mixture within the second compartment so that the fluid mixture does not leave the second compartment, even if the vial is inverted. This advantageously avoids the possibly of the fluid mixture coating the walls of the first compartment or penetrable seal, which would reduce the recovery rate of the fluid mixture and lead to wastage of the drug.

For one application of the invention, the transfer assembly may be used for delivering a small amount, in the order of 0.1 mL, of fluid mixture to an eye, for example to administer drug treatments for macular degeneration, diabetic macular edema and retinal vein occlusion. One suitable viscous diluent for this purpose is a carboxy-menthyl-cellulose (CMC) solution.

Further, a pharmaceutical transfer assembly employing the modified vial socket assembly advantageously provides a piercing conduit, such as a hollow needle, longer than that conventionally used to pierce the top seal of a vial. This long needle has a length dimension sized to extend the length of the inner chamber of the vial, so that the tip of the needle (and the aperture in the tip) is positioned closely adjacent the apex of the inner chamber. This narrowing of the inner chamber to an apex and placement of the needle aperture adjacent thereto assists to ensure that as much of the fluid as possible can be withdrawn from the vial. This is because the tapering of the inner chamber towards a downward apex causes the fluid in the inner chamber to tend to collect at the apex.

Further advantageously, the vial socket assembly may have a cylindrical wall for receiving a substantial part of the vial within the cylindrical wall. The cylindrical wall of the vial socket assembly preferably extends longitudinally beyond the tip of the hollow needle. Thus, the cylindrical wall serves to reduce the possibility of accidental pricking or other damaging contact with the needle when the vial is not received in the vial socket assembly. Further, the cylindrical wall has sufficient length to substantially overlie most, if not all, of the outer wall of the vial, when the vial is received in the vial socket assembly. The vial socket assembly may also have a flange extending outward from the cylindrical wall near its open end, in order to assist with manual insertion of the vial into the vial socket assembly.

BRIEF DESCRIPTION OF THE DRAWINGS

For a better understanding of the present invention and to show more clearly how it may be carried into effect, embodiments of the invention are described in further detail below, by way of example only, with reference to the accompanying drawings which illustrate various embodiments of the invention and in which.

DETAILED DESCRIPTION OF THE INVENTION

The pharmaceutical transfer assemblies described herein may be used with a standard pharmaceutical vial and a standard syringe or slightly modified versions thereof. However, some other embodiments of the transfer assembles may use a special form of vial, which falls within a class of vials called maximum recovery vials. Such other embodiments are shown and described in relation to FIGS. 54 to 58.

Figure 1:
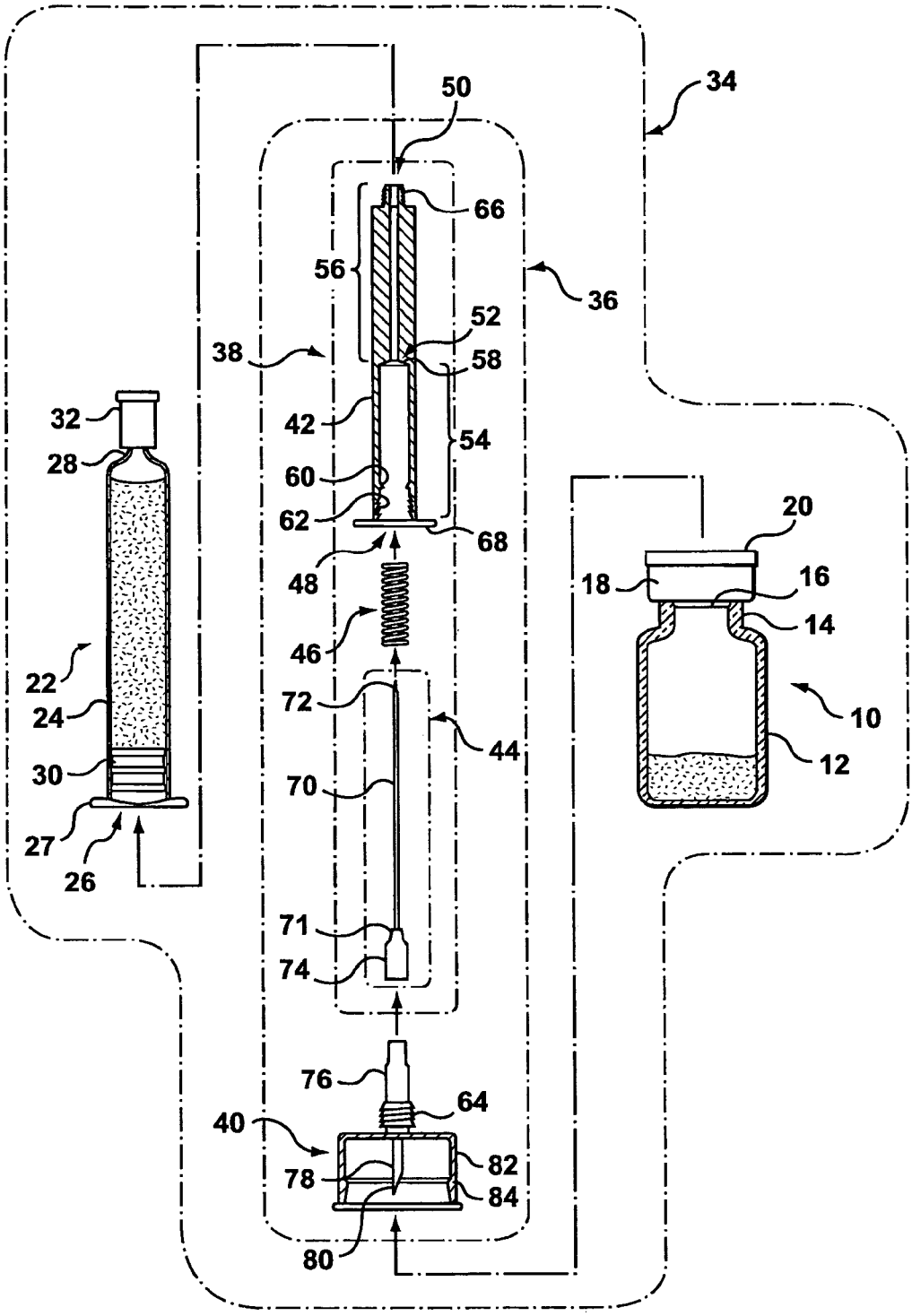
FIG. 1 is an exploded side elevational view of a pharmaceutical delivery system including a pharmaceutical transfer assembly according to one embodiment of the invention.
Figure 2:
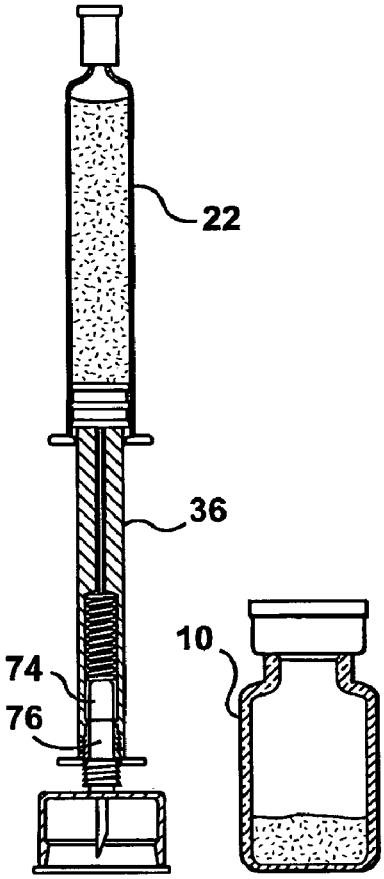
FIGS. 2-7 illustrate successive stages in the deployment of the pharmaceutical transfer assembly shown in FIG. 1 to reconstitute a multi-component pharmaceutical according to a further embodiment of the invention.
Figure 3:
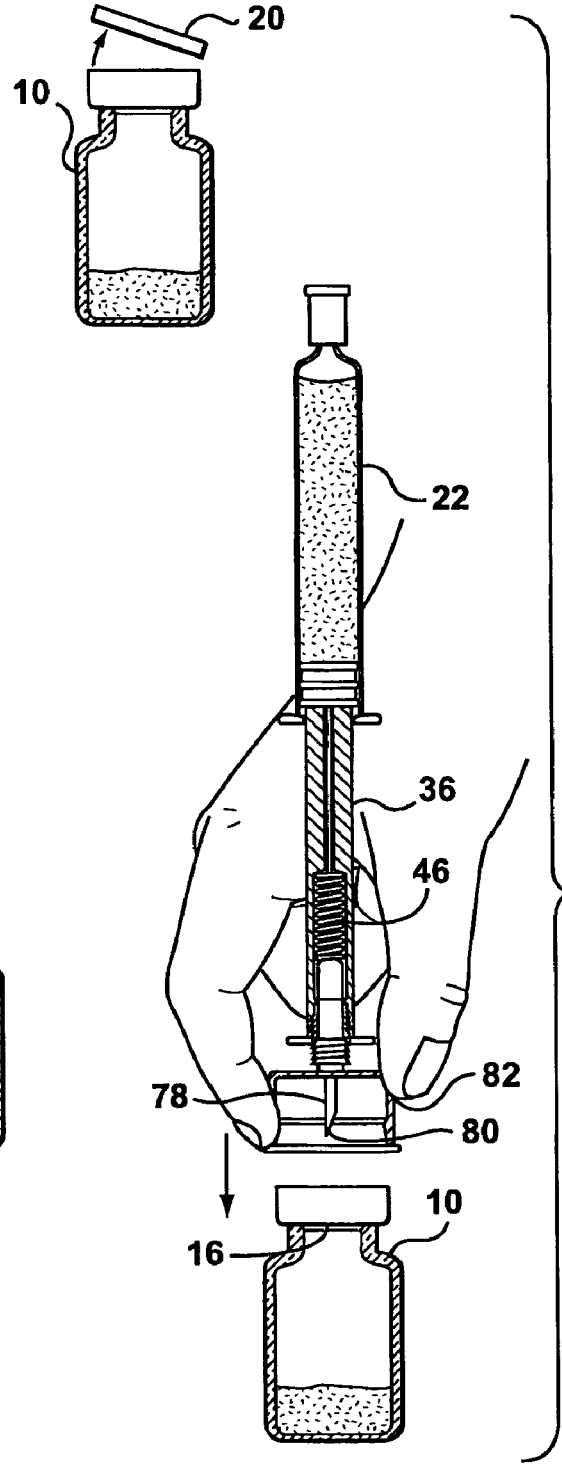
Figure 4:
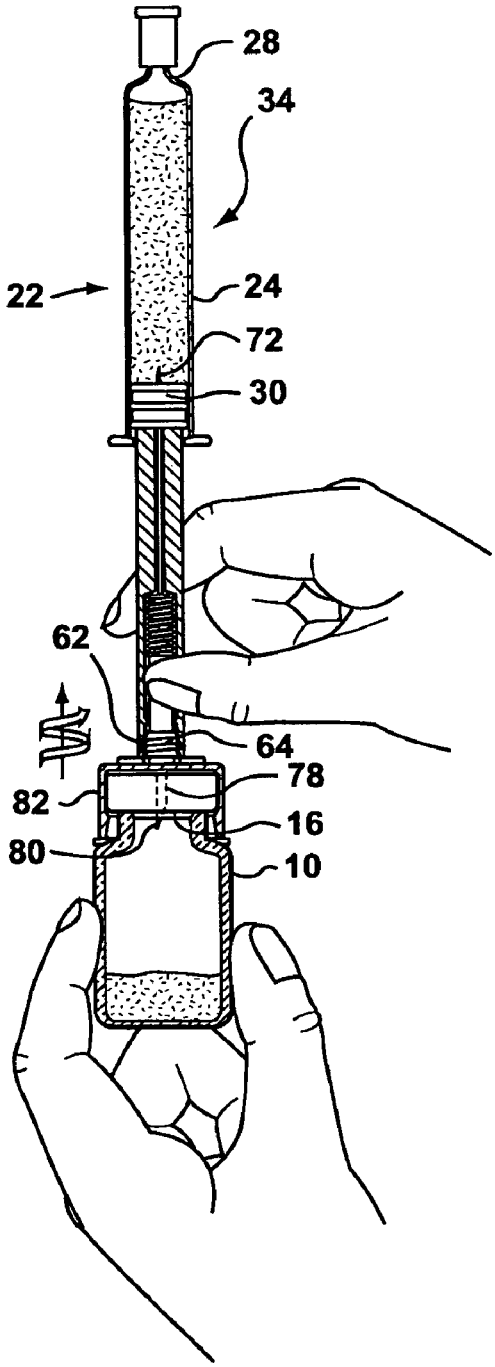
Figure 5:
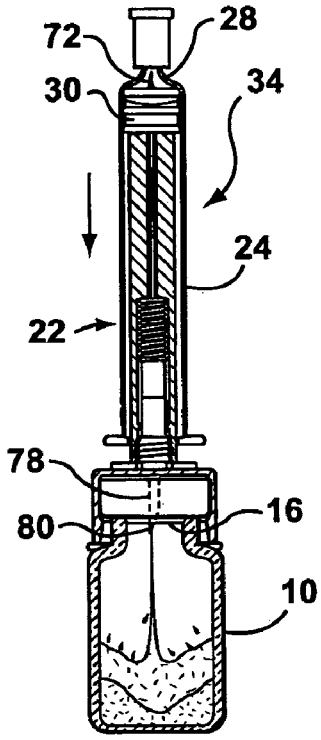

As best seen in FIG. 1, a standard pharmaceutical vial 10 generally has a vial body 12, a neck 14 of a reduced diameter compared with the body 12, a penetrable closure 16 made of an elastomeric material (e.g. rubber), a cap 18 to hold the penetrable closure 16 onto the pharmaceutical vial 10, and a cover 20 to protect the integrity of the penetrable closure 16 before use.

Still referring to FIG. 1, a standard syringe 22 may be a glass syringe having a syringe body 24 being open at one end 26 and having a neck 28 at the opposite end. A piston 30 is lodged in the syringe body 24 from the open end 26, the piston 30 being provided with means (not shown) by which a standard detachable plunger rod (not shown) may be secured to the piston 30. The open end 26 of the syringe body 24 is provided with a flange 27. The neck 28 of the syringe body 24 has a needle mount (which in the illustrated embodiment is a standard needle coupling or "luer lock" comprising a conical spigot (not shown) with a central passage communicating with the syringe body 24 surrounded by a cylindrical sleeve (not shown) having an internal thread (not shown)). The neck 28 of the syringe body 24 is sealed with a tip cap 32 made of an elastomeric material (e.g. rubber).

Still referring to FIG. 1, a pharmaceutical delivery system according to one embodiment of the invention is shown generally at 34. The pharmaceutical delivery system 34 generally comprises the syringe 22 pre-filled with a first fluid pharmaceutical component, a pharmaceutical transfer assembly shown generally at 36, and the pharmaceutical vial 10 containing a second pharmaceutical component. The second pharmaceutical component may be either a fluid or a solid (e.g. lyophilized powder). The pharmaceutical transfer assembly 36 generally comprises a detachable needle transfer plunger rod shown generally at 38, and a vial socket assembly shown generally at 40.

The detachable needle transfer plunger rod 38 may be of any suitable size and shape. In one embodiment, the detachable needle transfer plunger rod 38 has the same dimensions as a standard detachable plunger rod as is known in the syringe art. The detachable needle transfer plunger rod 38 generally comprises a housing 42, a needle hub assembly 44, and a resilient biasing member 46.

The housing 42 has a first open end 48, a second open end 50 opposite open end 48, and a bore 52 disposed between the first and second open ends 48, 50. The bore 52 is appropriately sized and shaped to receive the needle hub assembly 44 and the resilient biasing member 46, which is described in more detail below. The bore 52 generally has a first portion 54 and an adjacent second portion 56. The first portion 54 has a larger diameter than the second portion 56, and an inner annular shoulder 58 is formed at the juncture between the first and second portions 54, 56.

There is an annular detent 60 in the first portion 54 to provide a snap fit connection to secure the needle hub assembly 44 in a retracted or "inactivated" position while not in use, as will be subsequently described. There is an internal thread 62 in the first portion 54 of the bore 52 that cooperates with an external thread 64 on the vial socket assembly 40 to securely lock the vial socket assembly 40 onto the needle transfer plunger rod 38 thereby advancing the needle hub assembly 44 into an advanced or "activated" position, as will be subsequently described.

There is an external thread 66 on the second open end 50 of the housing 42 that cooperates with an internal thread (not shown) contained within the piston 30 to permit the needle transfer plunger rod 38 to be connected to the syringe 22. The first open end 48 of the housing 42 preferably has a finger flange 68 (through which central bore 52 passes) to aid in gripping the housing 42 during operation.

The needle hub assembly 44 generally comprises a conduit (which in the illustrated embodiment is a first hollow piercing member 70 having a tip 72) connected to a needle hub 74. The first hollow piercing member 70 may be any suitable hollow piercing device, and in one embodiment is a hollow needle such as a standard cannula. The needle hub assembly 44 is adapted for longitudinal movement within the bore 52 between a retracted or "unactivated" position (as seen in FIGS. 2-3, 7, 8-9, 13-15, 19) and an advanced or "activated" position (as seen in FIGS. 4-6, 10-12, 16-18). As will be described more particularly below, in the retracted position, the tip 72 of the first hollow piercing member 70 is fully contained within the second portion 56 of the bore 52 of the housing 42. In the advanced position, the tip 72 of the first hollow piercing member 70 protrudes past the second portion 56 of the bore 52 of the housing 42 and penetrates the piston 30 so that an aperture (not shown) adjacent or at tip 72 allows fluid communication between the internal volume of the syringe 22 and an internal passage of the first hollow piercing member 70.

The needle hub 74 has a female luer slip fitting to permit receipt of a post 76 of the vial socket assembly 40. The needle hub 74 and the post 76 act to hold the vial socket assembly 40 to the needle transfer plunger rod 38 initially when the needle hub assembly 44 is in the retracted or "inactivated" position.

The resilient biasing member 46 may be any suitable biasing device, and in one embodiment is a compressible spring. The resilient biasing member 46 is adapted to fit within the first portion 54 of the bore 52 between a surface 71 of the needle hub 74 and the annular shoulder 58. While the needle hub assembly 44 is in the retracted or "unactivated" position, the resilient biasing member 46 is at rest (e.g. no force is being applied to or by the resilient biasing member 46 or the needle hub 74). While the needle hub assembly 44 is in the advanced or "activated" position, the resilient biasing member 46 is compressed against the annular shoulder 58 by the needle hub 74 (e.g., a force is being applied to the resilient biasing member 46).

One purpose of the resilient biasing member 46 is to retract the needle hub assembly 44 back to the original retracted or "unactivated" position after the fluid transfer has been completed and the vial socket assembly 40 has been removed from the needle transfer plunger rod 38, as will subsequently be described.

The vial socket assembly 40 generally comprises the post 76, a second hollow piercing member 78 having a tip 80, and a vial socket 82. The post 76 has a male luer slip fitting that permits coupling between the post 76 and the needle hub 74 and permits fluid transfer between second hollow piercing member 78 and the first hollow piercing member 70. The second hollow piercing member 78 may be any suitable hollow piercing device, and in one embodiment is a hollow spike.

The second hollow piercing member has an aperture (not shown) at or adjacent tip 80 for establishing fluid communication between the internal volume of the vial 10 and an internal passage of vial socket assembly 40. The vial socket 82 is appropriately sized and shaped to receive a standard pharmaceutical vial 10 having the penetrable closure 16 and the cap 18, described above. Preferably, the vial socket 82 has a retaining member (which in the illustrated embodiment is an inner annular ridge 84 of smaller diameter than the rest of the inner wall of vial socket 82 for positively engaging and retaining the cap 18 of the vial 10 once it is fully inserted into the vial socket 82 (as shown in FIGS. 4-6 and 10-12).

Referring now to FIGS. 2-7, the successive stages in the deployment of the pharmaceutical transfer assembly 36 shown in FIG. 1 to reconstitute a first fluid pharmaceutical component from a pre-filled syringe 22 with a second pharmaceutical component from a pharmaceutical vial 10 are shown. The second pharmaceutical component contained within the pharmaceutical vial 10 may be either a fluid or a solid (e.g. lyophilized powder).

Still referring to FIGS. 2-7, the method for deploying the pharmaceutical transfer assembly 36 is described in detail below. Step (a) involves screwing external thread 66 into the internal thread (not shown) within piston 30 and inserting the post 76 of the vial socket assembly 40 into the needle hub 74 to create the assembly shown in FIG. 2. Step (b) involves removing the cover 20 of the pharmaceutical vial 10 (see FIG. 3). Step (c) involves inserting and snap fitting the pharmaceutical vial 10 into the vial socket 82 of the vial socket assembly 40 such that the tip 80 of the second hollow piercing member 78 penetrates the penetrable closure 16 on the pharmaceutical vial 10 (see FIG. 3). Step (a) can be performed first followed by steps (b) and (c) in that order, or steps (b) and (c) can be performed first in that order followed by step (a).

After completing steps (a), (b), and (c), step (d) involves advancing both the pharmaceutical vial 10 and the vial socket assembly 40 forward towards the syringe 22 and locking the vial socket assembly 40 into place by screwing the external thread 64 into the internal thread 62 of the plunger rod housing 42. This, in turn, advances the tip 72 of the first hollow piercing member longitudinally within the bore 52 of the housing 42 from the retracted position to the advanced position wherein the tip 72 of the first hollow piercing member 70 penetrates completely through the piston 30. With both tip 72 and tip 80 having pierced their respective items, this creates fluid communication between the pharmaceutical vial 10 and the syringe 22 (see FIG. 4) via connecting longitudinal passages in the first and second hollow piercing members 70 and 78.

Step (e) involves advancing the syringe body 24 longitudinally towards the pharmaceutical vial 10. This moves piston 30 relative to neck 28 to force the fluid within the syringe body 24 into and through the needle assembly 44 and through the vial socket assembly 40 to inject the first fluid pharmaceutical component into the pharmaceutical vial 10 (see FIG. 5). Step (f) involves swirling the pharmaceutical delivery system 34 to dissolve, dilute or suspend the second pharmaceutical component into the first pharmaceutical component.

Figure 6:
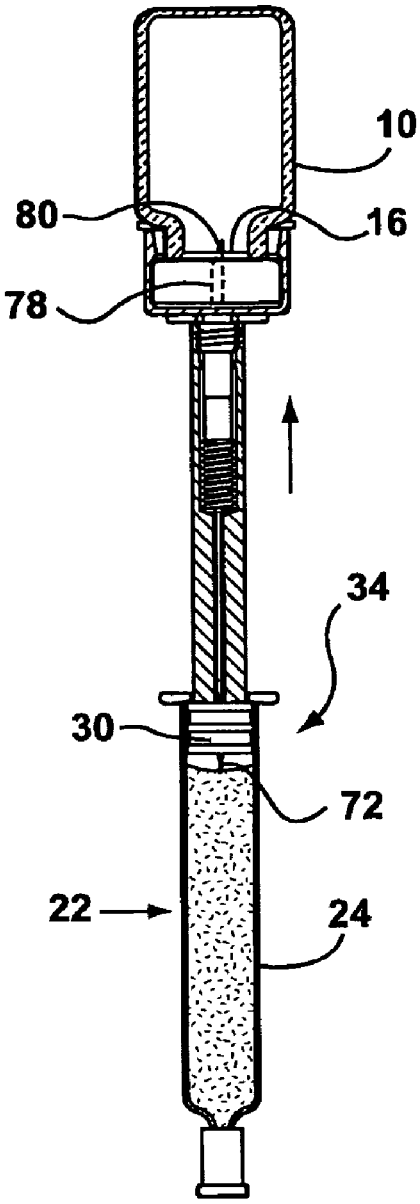

Step (g) involves inverting the pharmaceutical delivery system 34 and withdrawing the syringe body 24 longitudinally away from the pharmaceutical vial 10 to aspirate the now mixed contents of the pharmaceutical vial 10 back into the syringe 22 (see FIG. 6).

Figure 7:
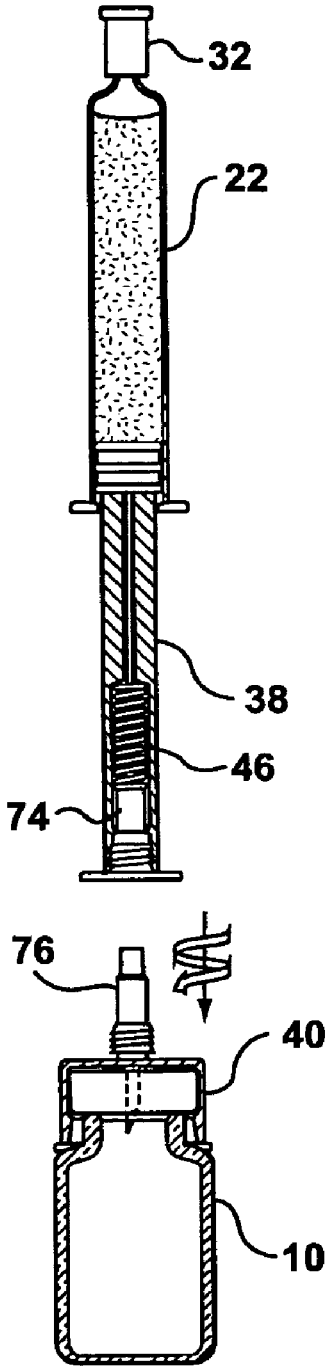
Figure 8:
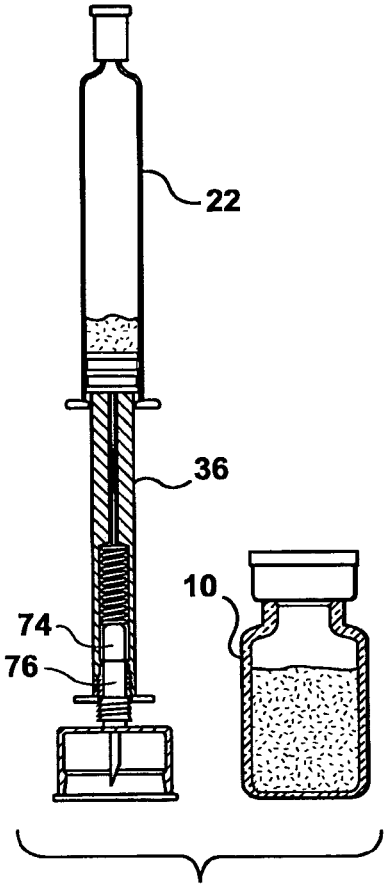
FIGS. 8-13 illustrate successive stages in the deployment of the pharmaceutical transfer assembly shown in FIG. 1 to reconstitute a multi-component pharmaceutical according to a further embodiment of the invention.

Step (h) involves detaching the vial socket assembly 40 from the needle transfer plunger rod 38 (by unthreading the two and pulling the post 76 of the vial socket assembly 40 out of the needle hub 74) to provide a filled syringe 22 ready for use (see FIG. 7). To use the filled syringe the tip cap 32 is removed and a needle (not shown) attached. The needle transfer plunger rod 38 forms the plunger to discharge the mixed pharmaceutical from the syringe 22.

Once the vial socket assembly 40 is detached from the needle transfer plunger rod (by unthreading the two), the resilient biasing member 46 biases the first hollow piercing member 70 back to the retracted or "inactivated" position. With the piercing members 70 withdrawn, the piston 30 reseals to prevent fluid communication between the syringe 22 and the needle transfer plunger rod 38. Accordingly, when the syringe 22 is used to deliver the reconstituted multi-component pharmaceutical to a patient or intravenous feed line, the needle transfer plunger rod 38 is depressed.

Referring now to FIGS. 8-13, the successive stages in the deployment of the pharmaceutical transfer assembly 36 shown in FIG. 1 to reconstitute a first pharmaceutical component from a prepackaged syringe 22 with a second fluid pharmaceutical component from a prepackaged pharmaceutical vial 10 are shown. The first pharmaceutical component contained within the syringe 22 may be either a fluid or a solid (e.g., lyophilized powder).

Figure 9:
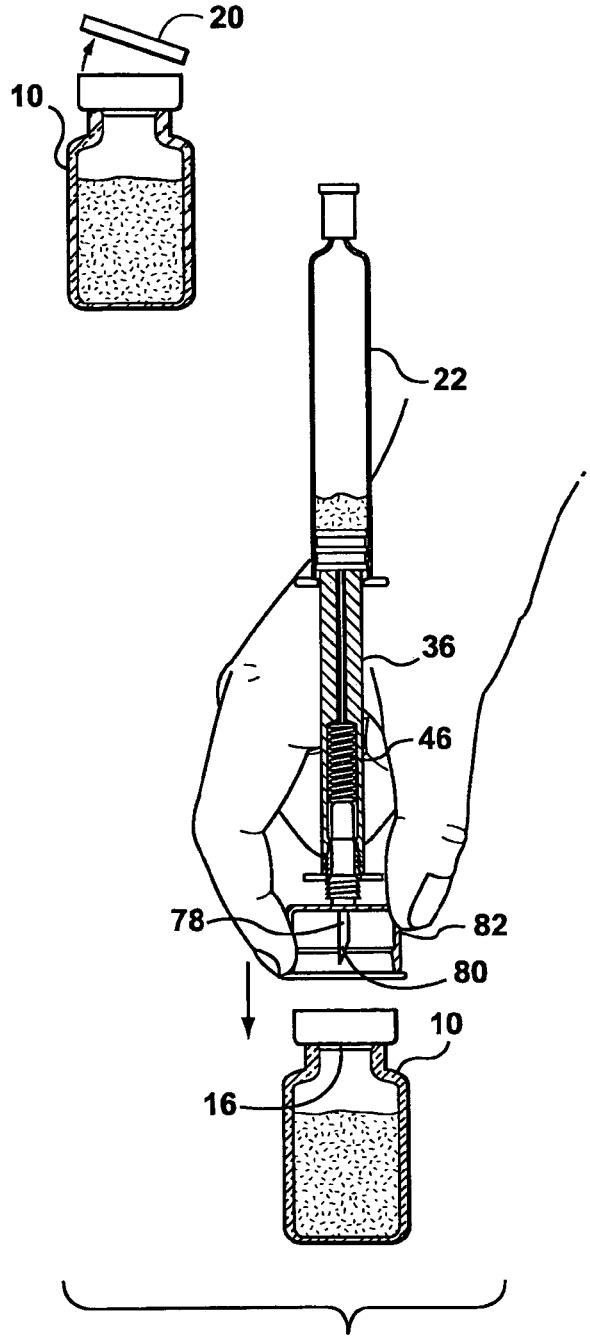
Figure 10:
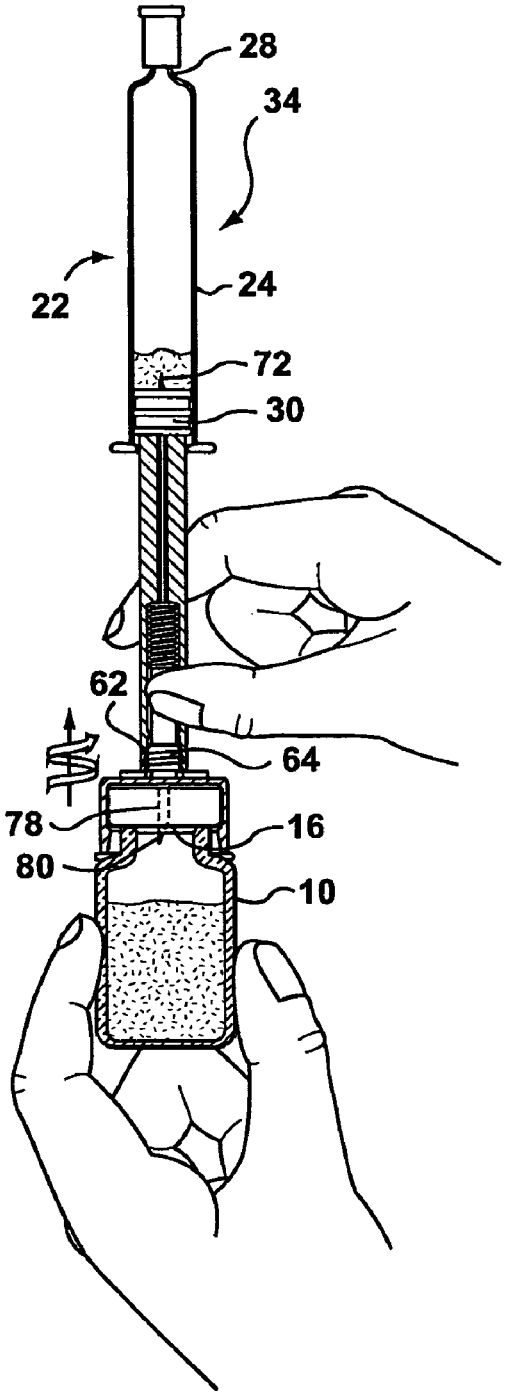
Figure 11:
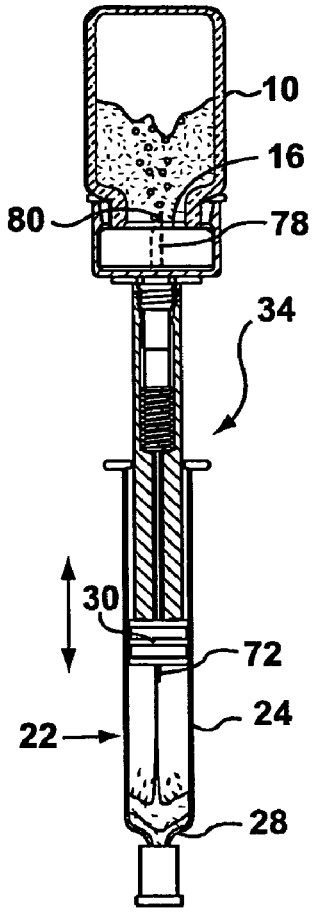
Figure 12:
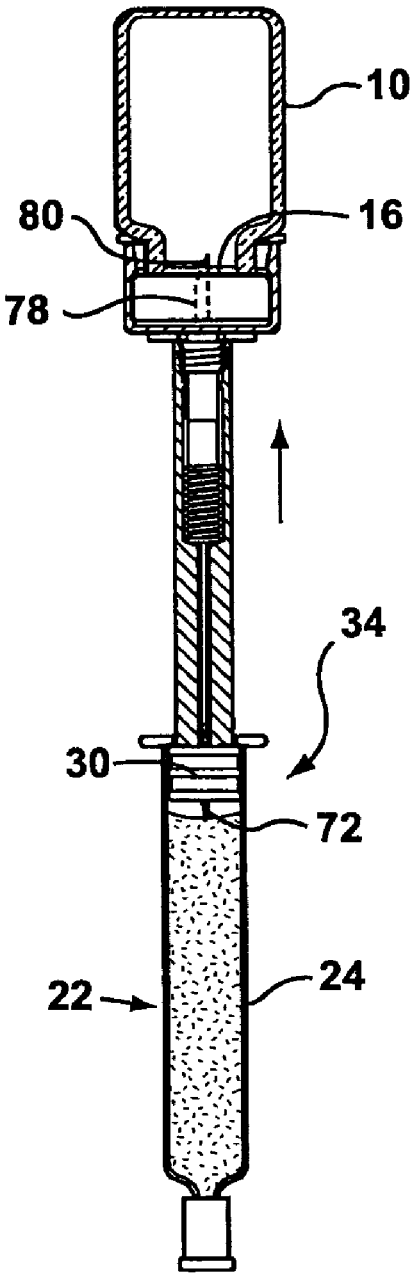

Still referring to FIGS. 8-13, the method for deploying the pharmaceutical transfer assembly 36 is described in detail below. Step (a) involves screwing external thread 66 into the internal thread (not shown) within piston 30 and inserting post 76 of the vial socket assembly 40 into the needle hub 74 to create the assembly shown in FIG. 8. Step (b) involves removing the cover 20 of the pharmaceutical vial 10 (FIG. 9). Step (c) involves inserting and snap fitting the pharmaceutical vial 10 into the vial socket 82 of the vial socket assembly 40 such that the tip 80 of the second hollow piercing member 78 penetrates the penetrable closure 16 on the pharmaceutical vial 10 (see FIG. 9). Step (a) can be performed first followed by steps (b) and (c) in that order, or steps (b) and (c) can be performed first in that order followed by step (a).

After completing steps (a), (b), and (c), step (d) involves advancing both the pharmaceutical vial 10 and the vial socket assembly 40 forward towards the syringe 22 and locking the vial socket assembly 40 into place by screwing the external thread 64 into the internal thread 62 of the plunger rod housing 42. This, in turn, advances the tip 72 of the first hollow piercing member 70 longitudinally within the bore 52 of the housing 42 from the retracted position to the advanced position wherein the tip 72 of the first hollow piercing member 70 penetrates completely through the piston 30. With both tip 72 and tip 80 having pierced their respective items, this creates fluid communication between the pharmaceutical vial 10 and the syringe 22 (see FIG. 10) via longitudinal passages in the first and second hollow piercing embers 70, 78.

Step (e) involves inverting the pharmaceutical delivery system 34 and advancing the syringe body 22 longitudinally towards the pharmaceutical vial 10. This moves piston 30 relative to neck 28 to force the air within the syringe body 24 into and through the needle assembly 44 and through the vial socket assembly 40 to aspirate the air into the pharmaceutical vial 10. Step (f) involves withdrawing the syringe body 24 away from the pharmaceutical vial to aspirate the second, fluid pharmaceutical from the pharmaceutical vial 10 into the syringe 22 (see FIG. 11). Step (g) involves swirling the pharmaceutical delivery system 34 to dissolve, dilute or suspend the first pharmaceutical component into the second pharmaceutical component.

Figure 13:
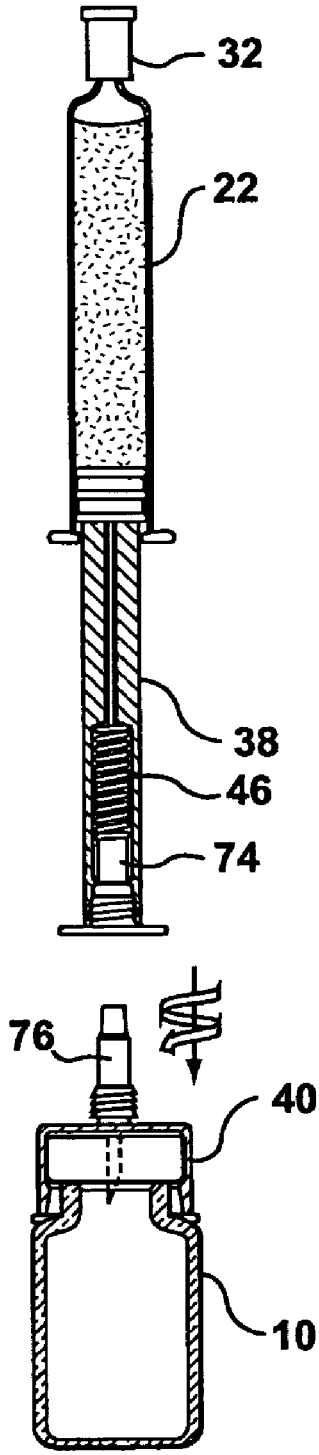
Figure 14:
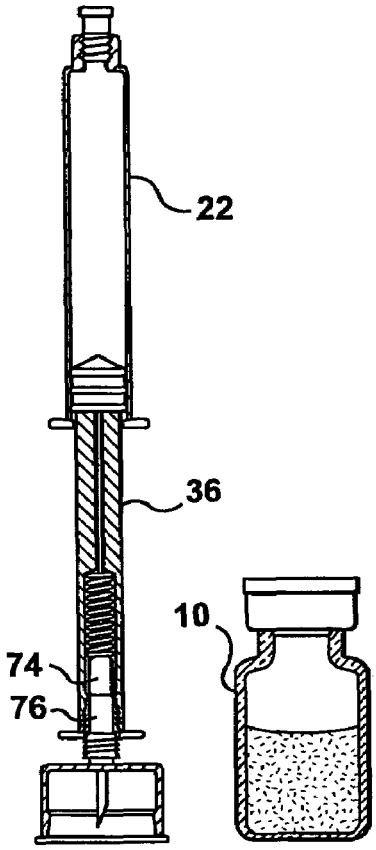
FIGS. 14-19 illustrate successive stages in the deployment of the pharmaceutical transfer assembly shown in FIG. 1 to transfer a fluid pharmaceutical component from a prepackaged pharmaceutical vial to a syringe according to a further embodiment of the invention.

Step (h) involves detaching the vial socket assembly 40 from the needle transfer plunger rod 38 (by unthreading the two and pulling the post 76 of the vial socket assembly 40 out of the needle hub 74) to provide a filled syringe 22 ready for use (see FIG. 13). To use the filled syringe the tip cap 32 is removed and a needle (not shown) attached. The needle transfer plunger rod 38 forms the plunger to discharge the mixed pharmaceutical from the syringe 22.

Referring now to FIGS. 14-19, the successive stages in deployment of the pharmaceutical transfer assembly 36 shown in FIG. 1 to transfer a fluid pharmaceutical component from a prepackaged pharmaceutical vial 10 to an empty syringe 22 are shown.

Figure 15:
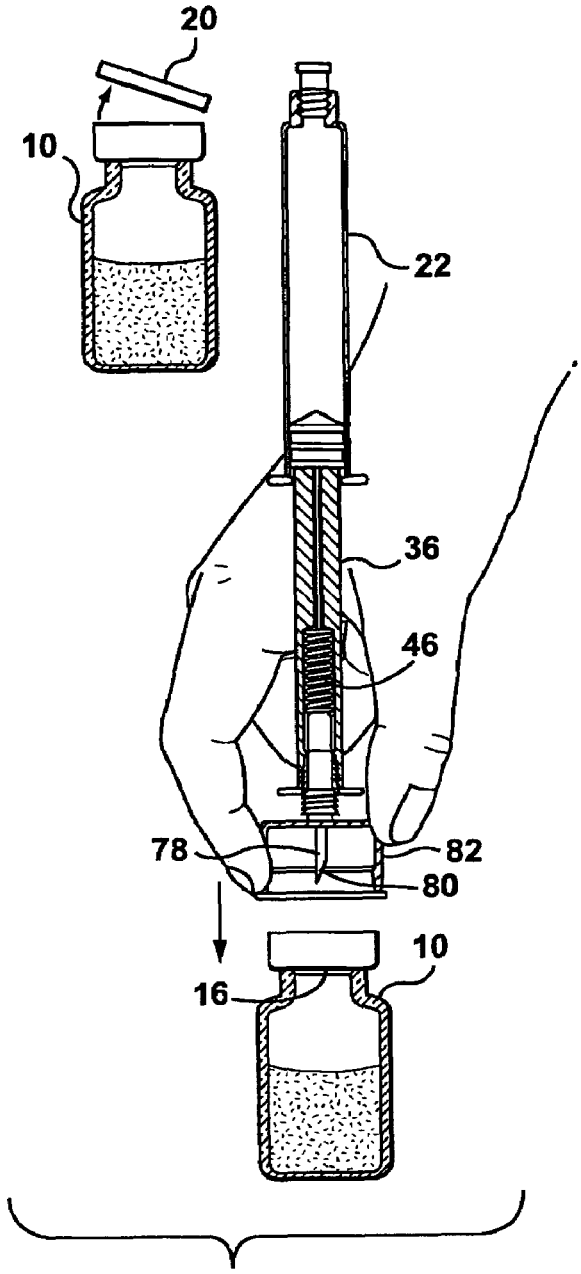
Figure 16:
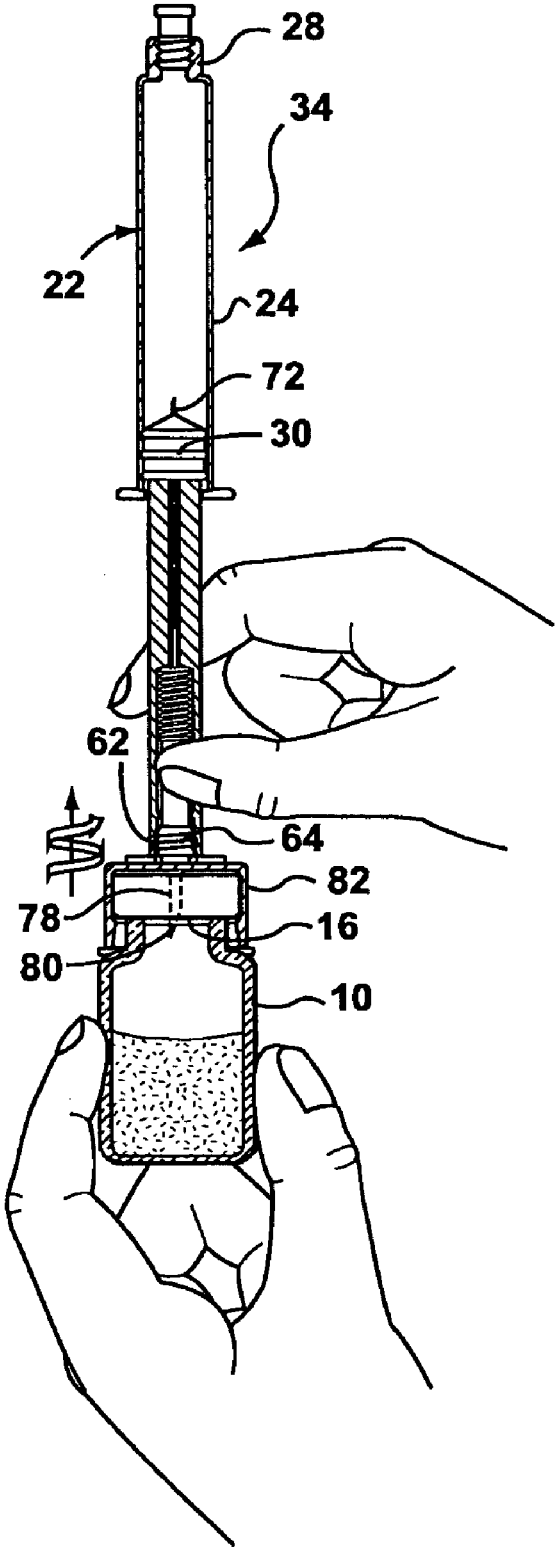

Still referring to FIGS. 14-19, the method for deploying the pharmaceutical transfer assembly 36 is described in detail below. Step (a) involves screwing external thread 66 into the internal thread (not shown) within piston 30 and inserting post 76 of the vial socket assembly 40 into the needle hub 74 to create the assembly shown in FIG. 14. Step (b) involves removing the cover 20 of the pharmaceutical vial 10 (FIG. 15). Step (c) involves inserting and snap fitting the pharmaceutical vial 10 into the vial socket 82 of the vial socket assembly 40 such that the tip 80 of the second hollow piercing member 78 penetrates the penetrable closure 16 on the pharmaceutical vial 10 (see FIG. 15). Step (a) can be performed first followed by steps (b) and (c) in that order, or steps (b) and (c) can be performed first in that order followed by step (a).

After completing steps (a), (b), and (c), step (d) involves advancing both the pharmaceutical vial 10 and the vial socket assembly 40 forward towards the syringe 22 and locking the vial socket assembly 40 into place by screwing the external thread 64 into the internal thread 62 of the plunger rod housing 42. This, in turn, advances the tip 72 of the first hollow piercing member 70 longitudinally within the bore 52 of the housing 42 from the retracted position to the advanced position wherein the tip 72 of the first hollow piercing member 70 penetrates the piston 30. With both tip 72 and tip 80 having pierced their respective items, this creates fluid communication between the pharmaceutical vial 10 and the syringe 22 (see FIG. 16).

Figure 17:
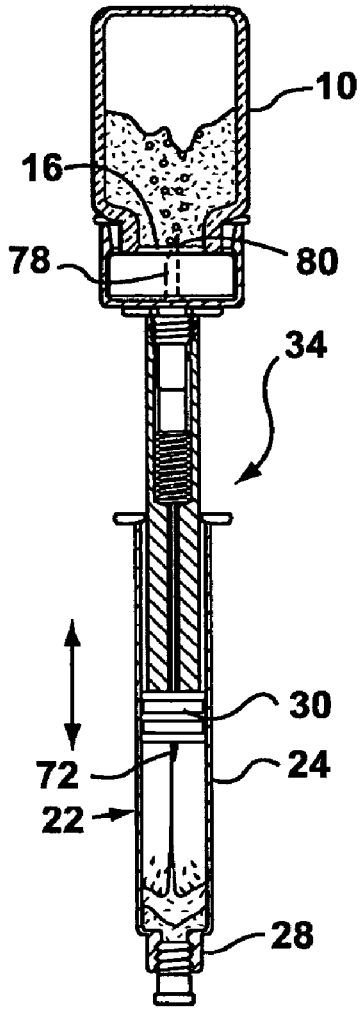
Figure 18:
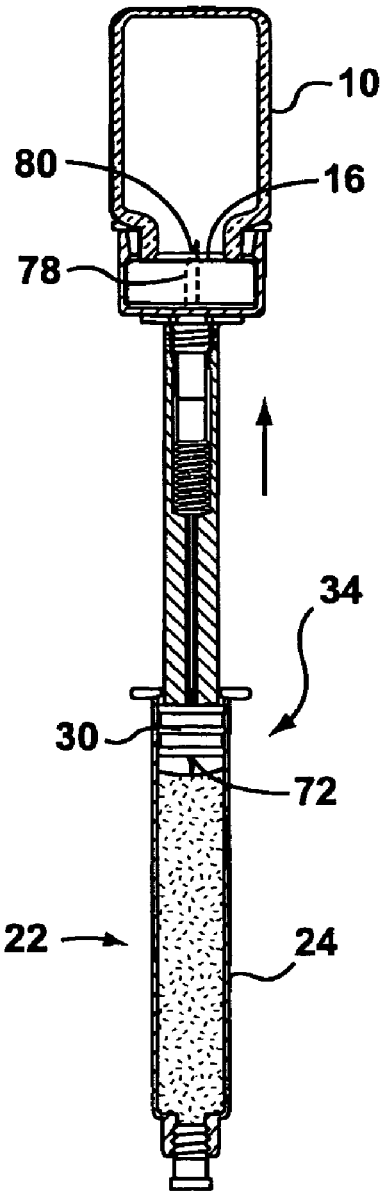
Figure 19:
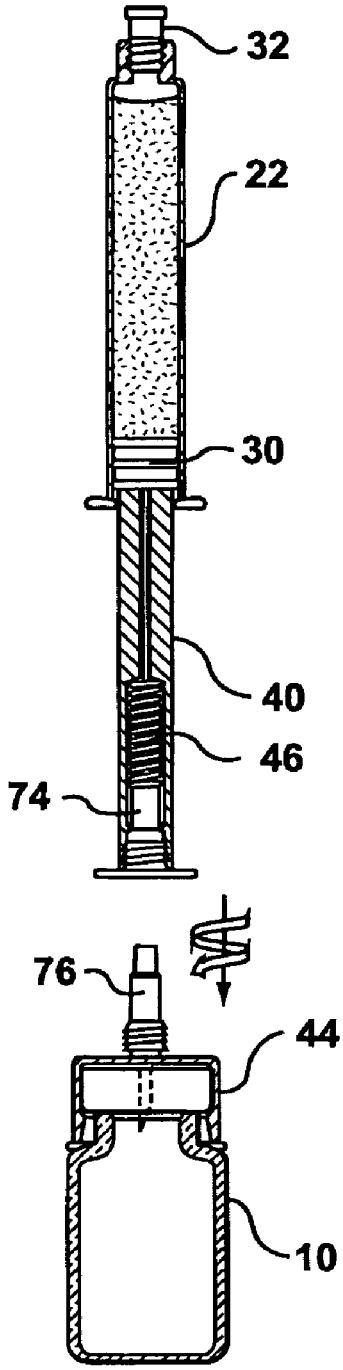

Step (e) involves advancing the syringe body 24 longitudinally towards the pharmaceutical vial 10 to aspirate air into the pharmaceutical vial 10 (see FIG. 17). Step (f) involves inverting the pharmaceutical delivery system 34 to aspirate the fluid pharmaceutical component from the prepackaged pharmaceutical vial 10 into the syringe 22 (see FIGS. 17, 18). Step (g) involves detaching the vial socket assembly 40 from the needle transfer plunger rod 38 (by unthreading the two and pulling the post 76 of the vial socket assembly 40 out of the needle hub 74) to provide a syringe 22 ready for use (see FIG. 19). To use the filled syringe the tip cap 32 is removed and a needle (not shown) attached. The needle transfer plunger rod 38 forms the plunger to discharge the transferred fluid from the syringe 22.

Figure 20:
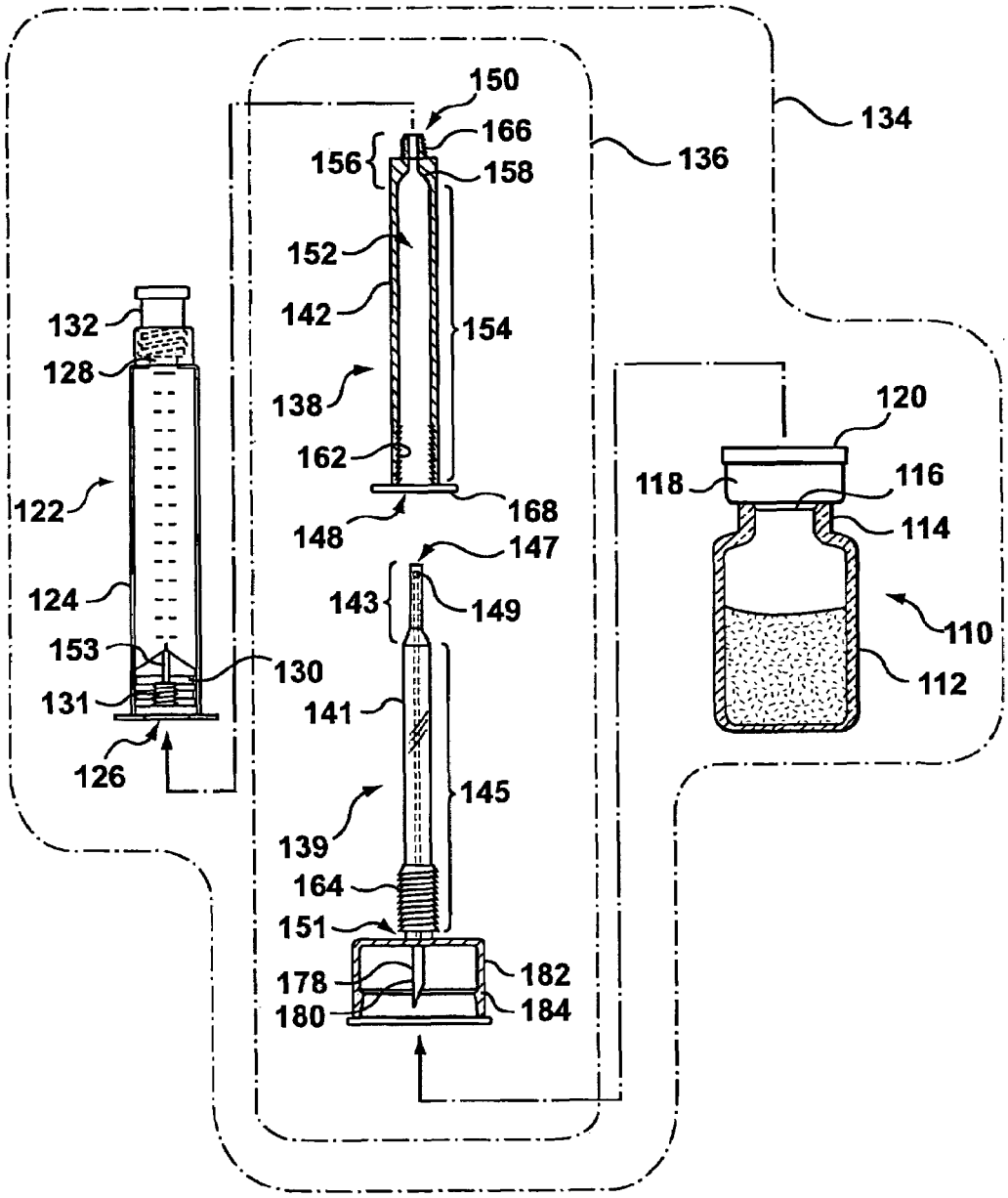
FIG. 20 is an exploded side elevational view of a pharmaceutical delivery system including a pharmaceutical transfer assembly according to a further embodiment of the invention.
Figure 21:
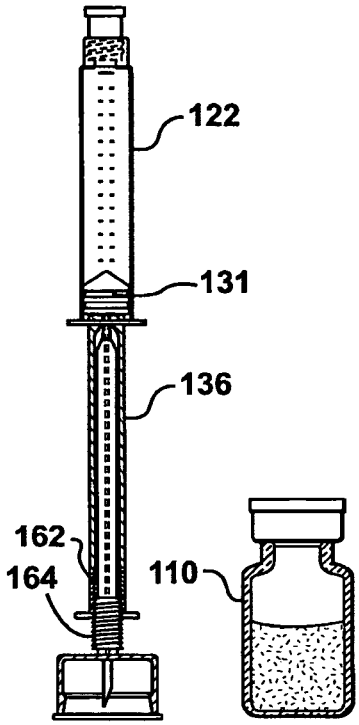
FIGS. 21-26 illustrate successive stages in the deployment of the pharmaceutical transfer assembly of FIG. 20 to transfer a fluid pharmaceutical component from a prepackaged pharmaceutical vial to a syringe according to a further embodiment of the invention.

Referring now to FIG. 20, a pharmaceutical delivery system according to another embodiment of the invention is shown generally at 134. The pharmaceutical delivery system 134 generally comprises an empty syringe 122, a pharmaceutical transfer assembly shown generally at 136, and a pharmaceutical vial 110 containing a fluid pharmaceutical component. The pharmaceutical transfer assembly 136 generally comprises a detachable plunger rod shown generally at 138, and a transfer tube/vial socket assembly shown generally at 139.

The detachable plunger rod 138 may be of any suitable size and shape. In particular, the detachable plunger rod 138 may have the same dimensions as a standard detachable plunger rod known in the syringe art.

The detachable plunger rod generally comprises a housing 142. The housing 142 has a first open end 148, a second open end 150 opposite the first open end 148, and a bore 152 disposed between the first and second open ends 148, 150. The bore 152 is appropriately sized and shaped to receive the transfer tube/vial socket assembly 139, which will be described in more detail below. The bore 152 generally has a first portion 154, and an adjacent second portion 156. The first portion 154 has a larger diameter than the second portion 156. There is an internal thread 162 in the first portion 154 of the bore 152 that cooperates with an external thread 164 on the transfer tube/vial socket assembly 139 to connect the plunger rod 138 to the transfer tube/vial socket assembly 139. These cooperating threads 162, 164 permit axial movement of the transfer tube/vial socket assembly 139 relative to the plunger rod 138. There is an external thread 166 on the second open end 150 of the housing 142 that cooperates with an internal thread 131 contained within the piston 130 to permit the plunger rod 138 to be connected to the syringe 122. The first open end 148 of the housing 142 preferably has a finger flange 168 with a central bore (not shown) to aid in gripping the pharmaceutical transfer assembly 136 during operation.

The transfer tube/vial socket assembly 139 generally comprises a conduit (which in the illustrated embodiment is a hollow tube 141) and a vial socket 182. The hollow tube 141 has a first portion 143, and a second portion 145 adjacent the first portion 143. The first portion 143 preferably has a smaller diameter than the second portion 145. The hollow tube 141 has a first end 147, and a second open end 151 opposite the first end 147. The first end 147 preferably has a blunt tip, and an aperture 149 on a sidewall of the hollow tube adjacent the blunt tip that is in fluid communication with the inside of the hollow tube.

Figure 23:
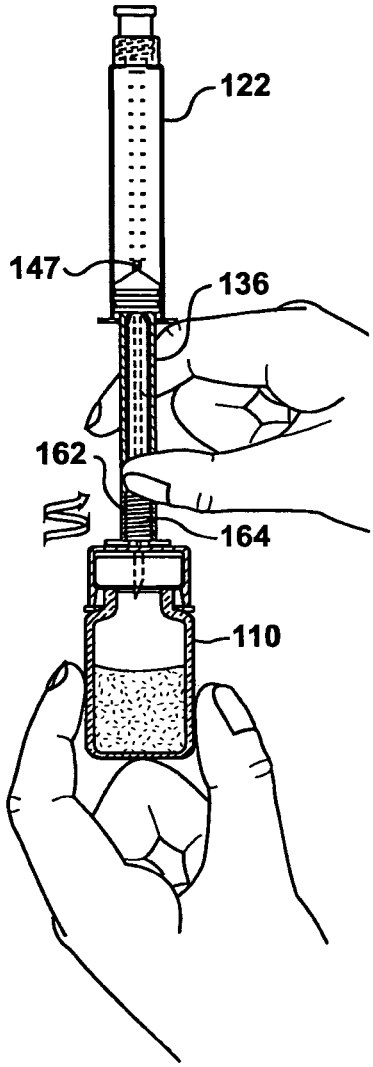
Figure 24:
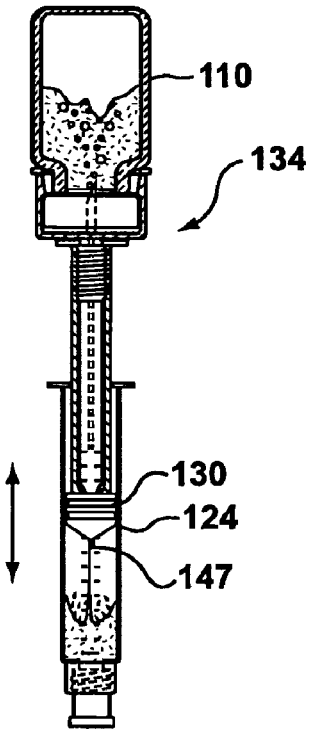
Figure 25:
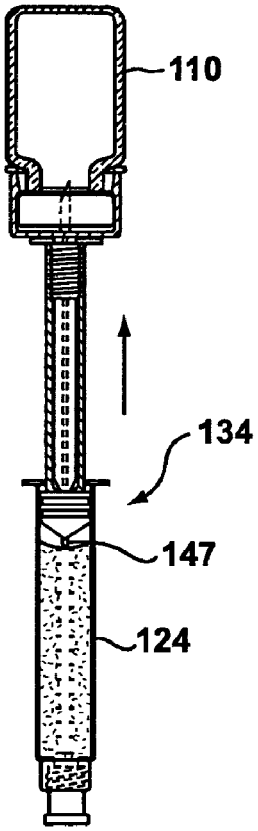

The vial socket 182 includes a hollow piercing member 178 having a tip 180. The hollow piercing member 178 may be any suitable hollow piercing device, and is preferably a hollow needle such as a standard spike. The second open end 151 of the hollow tube 141 is integrally connected to an aperture (not shown) in the tip 180 of the vial socket 182, and fluidly connected to the hollow piercing member 178. The vial socket 182 is appropriately sized and shaped to receive a standard pharmaceutical vial 110 having the penetrable closure 116 and the cap 120, described above. Preferably, the vial socket 182 has a retaining member 184 (which in the illustrated embodiment is an inner annular ridge of smaller diameter than the remainder of the inner wall of vial socket 182 for positively engaging and retaining the cap 120 of the vial 110 once it is fully inserted into the vial socket (as shown in FIGS. 23-25)).

The syringe 122 is slightly modified in this aspect of the invention. In particular, the piston 130 has an aperture 153 with a diameter that is slightly smaller than the diameter of the first portion 143 of the hollow tube 141 to allow snug passage of the hollow tube 141 through the piston 130, as will be subsequently described.

Referring now to FIGS. 21-26, the successive stages in deployment of the pharmaceutical transfer assembly shown in FIG. 20 to transfer a fluid pharmaceutical component from a prepackaged pharmaceutical vial 110 to a syringe 122 are shown.

Still referring to FIGS. 21-26, the method for deploying the pharmaceutical transfer assembly 136 is described in detail below. Step (a) involves screwing external thread 166 into the internal thread 131 within piston 130 and screwing external thread 164 part way into the internal thread 162 within the second portion 154 of the housing 142 to create the assembly shown in FIG. 21. In this position, the aperture 149 is wholly contained within the aperture 153 in the piston 131 to create a fluid seal.

Figure 22:
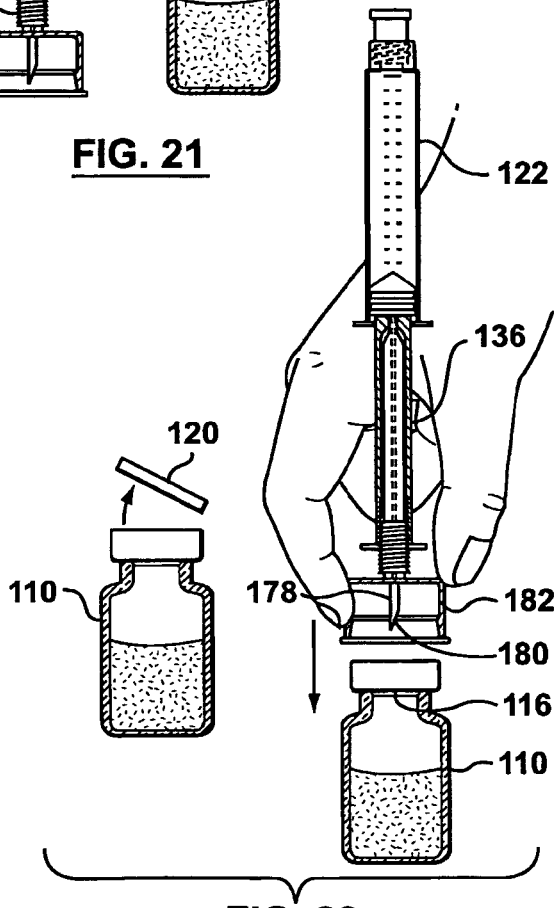

Step (b) involves removing the cover 120 of the pharmaceutical vial 110 (FIG. 22). Step (c) involves inserting and snap fitting the pharmaceutical vial 110 into the vial socket 182 of the transfer tube/vial socket assembly 139 such that the tip 180 of the hollow piercing member 178 penetrates the penetrable closure 116 on the pharmaceutical vial 110 (see FIG. 22).

Step (d) involves screwing the external thread 164 into the internal thread 162 within the first, portion 154 of the housing 142 to advance the blunt tip of the hollow tube 141 longitudinally within the bore 152 of the housing 142 from the retracted position to the advanced position wherein aperture 149 in the blunt tip of the hollow tube 141 protrudes through the piston 130 to create fluid communication between the pharmaceutical vial 110 and the syringe 122 (see FIG. 23).

Step (e) involves advancing the syringe body 124 longitudinally towards the pharmaceutical vial 110 to aspirate air into the pharmaceutical vial 110. Step (f) involves inverting the pharmaceutical delivery system 134 to aspirate the fluid pharmaceutical component from the prepackaged pharmaceutical vial 110 into the syringe 122 (see FIG. 24 and FIG. 25).

Figure 26:
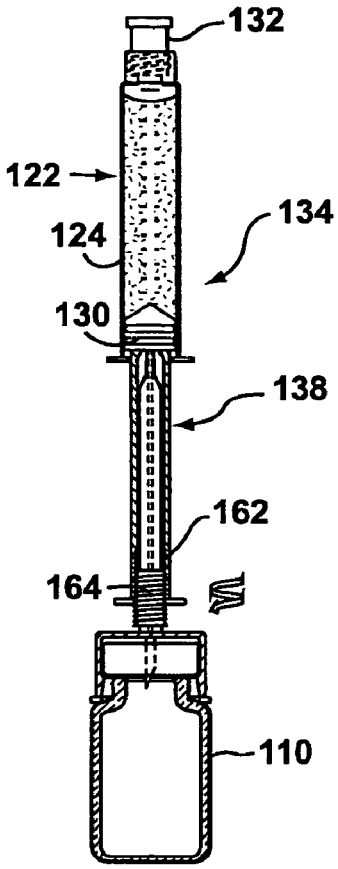

Step (g) involves unscrewing the external thread 164 from the internal thread within the first portion 154 of the housing 142 to retract the blunt tip of the hollow tube 141 longitudinally within the bore 152 of the housing 142 from the advanced position to the retracted position wherein the aperture 149 in the blunt tip of the hollow tube is wholly contained within the piston 130 to create a seal (see FIG. 26). Once the hollow tube has been retracted, the syringe 122 is ready for use. To use the filled syringe 122 the tip cap 132 is removed and a needle (not shown) attached. The plunger rod 138 can be used to discharge the transferred fluid from the syringe 122.

Although embodiments have been described in terms of transferring a single dose from the vial 110 to the syringe 122, the apparatus and methods described herein can also be used to transfer a plurality of doses from the vial 110 to the syringe 122 while keeping the pharmaceutical delivery system 134 intact and thereby maintaining sterility. After the first dose has been administered, the needle (not shown) is removed from the syringe 122, the tip cap 132 is replaced, and the procedure may be repeated for a second or subsequent dose. The amount drawn in for each repeated dose can be controlled by the degree of movement of the piston 130 within the syringe 122.

Referring now to FIGS. 27-37, a pharmaceutical delivery system according to another embodiment of the invention is shown generally at 234. The pharmaceutical delivery system 234 has a syringe 222, a pharmaceutical transfer assembly shown generally at 236, and a pharmaceutical vial 210.

The pharmaceutical transfer assembly 236 has a piston backstop 201, a detachable needle transfer plunger rod shown generally at 238, and a vial socket assembly shown generally at 240.

Optionally, a sheath assembly 203 can be secured over the neck end 228 of the syringe 222 for reasons that will be subsequently described. The sheath assembly 203 has a plastic tip cap 205, and a hard body sheath 207.

Figure 27:
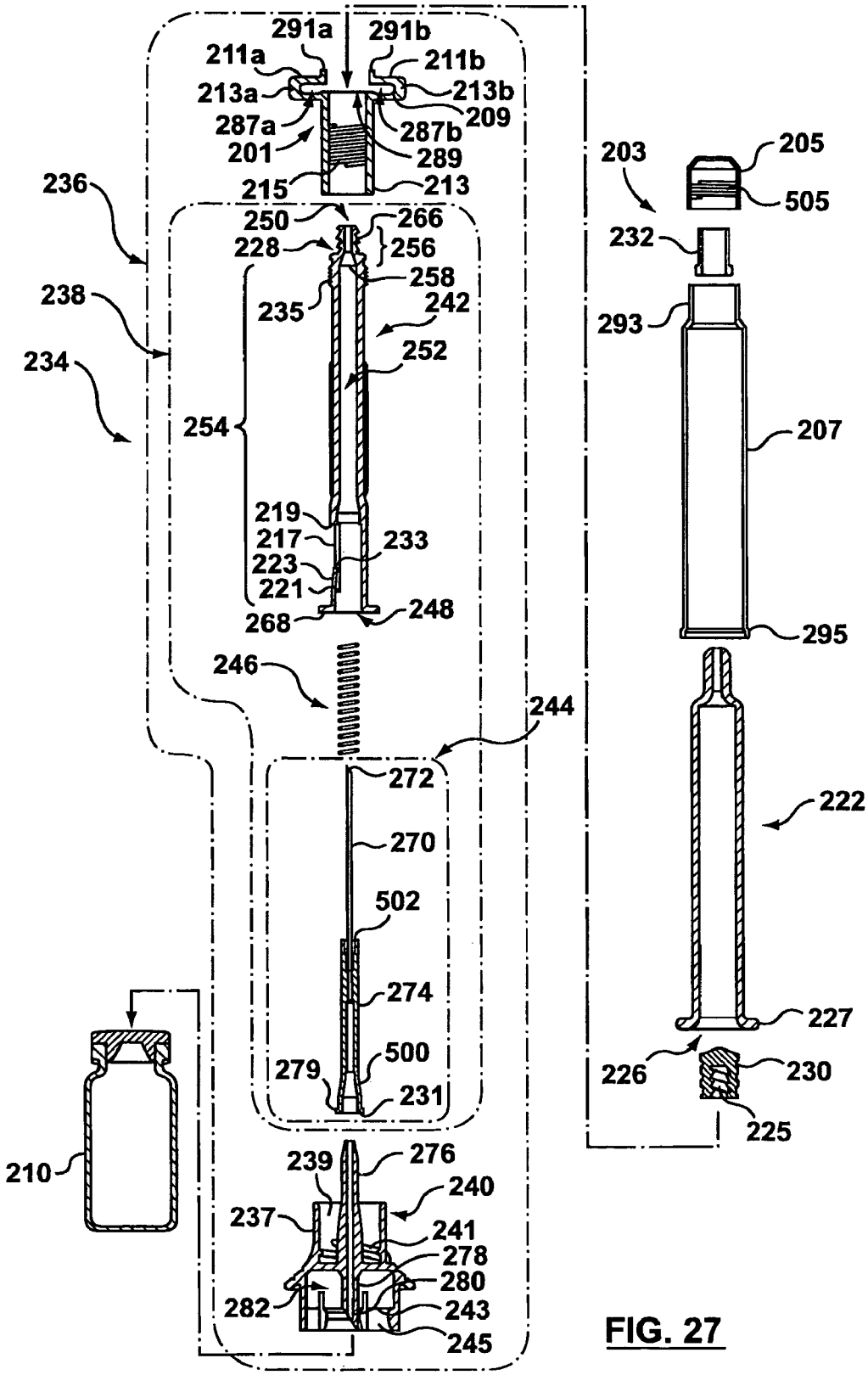
FIG. 27 is an exploded cross-sectional view of a pharmaceutical delivery system including a pharmaceutical transfer assembly according to a further embodiment of the invention.
Figure 41:
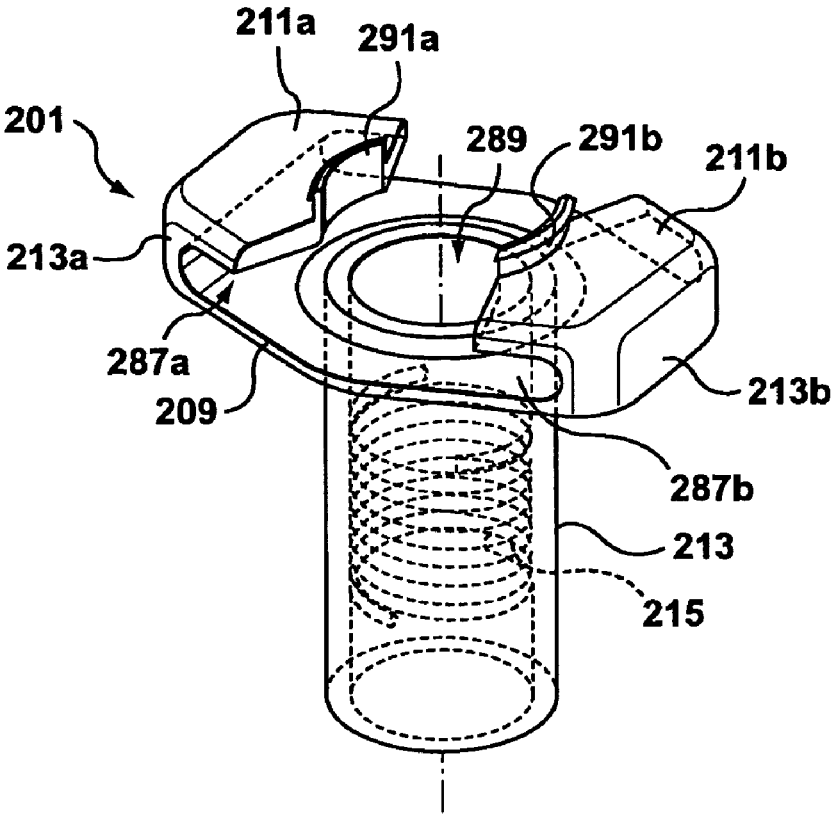
FIG. 41 is a perspective view of a backstop according to one embodiment of the invention.

Referring now to FIGS. 27 and 41, the piston backstop 201 can be connected to a flange 227 of the syringe 222 to facilitate sterilization of the transfer assembly 236, to prevent accidental activation of the pharmaceutical delivery system 234, and to prevent a piston 230 from being accidentally dislodged from the open end 226 of the syringe 222 as will be described in more detail below. The piston backstop 201 has a bottom plate 209 extending radially from a preferably cylindrical collar 213. The bottom plate 209 has an aperture 289, two top plate extensions 211*a*, 211*b*, and two side walls 213*a*, 213*b* respectively connecting the bottom plate 209 to the two top plate extensions 211*a*, 211*b*. In this arrangement, the bottom plate 209, sidewalls 213*a*, 213*b*, and the top plate extensions 211*a*, 211*b* form a pair of gaps 287*a*, 287*b* that is sized to snugly receive the flange 227 of the syringe 222. Collar 213 has a retaining means 215 (which is preferably an internal thread), and an inner diameter that is slightly larger than the outer diameter of the detachable needle transfer plunger rod 238 to permit the needle transfer plunger rod 238 to move axially within the piston backstop 201. The piston backstop 201 may have a pair of snaps 291*a*, 291*b* positioned on the two top plate extensions 211*a*, 211 *b*, respectively to permit attachment of the sheath 207 as will be subsequently described.

The piston backstop 201 can be formed in a conventional manner such as injection molding, and may be made of appropriate plastics, hard rubber materials, or the like. The piston backstop 201 is preferably made from a slightly flexible material to allow it to flex slightly as it is placed about flange 227. Preferably, the piston backstop 201 and preferably the gap is shaped and sized to fit snugly about the flange 227 to ensure that the system does not disassemble during deployment.

The detachable needle transfer plunger rod 238 may be of any suitable size and shape. In particular, the detachable needle transfer plunger rod 238 may have the same dimensions as a standard detachable plunger rod. The detachable needle transfer plunger rod 238 has a housing 242, a needle hub assembly 244, and a resilient biasing member 246.

The housing 242 has a first open end 248, a second open end 250 opposite open end 248, and a bore 252 disposed between the first and second open ends 248, 250. The bore 252 is appropriately sized and shaped to receive therein the needle hub assembly 244 and the resilient biasing member 246, which will be described in more detail below. The bore 252 generally has a first portion 254 and an adjacent second portion 256. The first portion 254 has a larger diameter than the second portion 256, and an inner annular shoulder 258 is formed at the juncture between the first and second portions 254, 256. There is a slot 217 in the first portion 254 of the bore 252 with a top end 219 and a bottom end 221.

A latch 223 adjacent the bottom end 221 of the slot 217 supports the needle hub assembly 244 in a retracted or "inactivated" position while not in use, as will be subsequently described. An external thread 266 on the second portion 256 of the housing 242 matingly cooperates with an internal thread 225 contained within the piston 230 to permit the needle transfer plunger rod 238 to be threadedly connected to the piston 230. There is an external thread 235 on the first portion 254 of the housing 242 that matingly cooperates with the internal thread 215 in the piston backstop 201 to permit longitudinal movement of the needle transfer plunger rod 238 relative to the piston backstop 201. The first open end 248 of the housing 242 preferably has a finger flange 268 with a central bore to aid in gripping the pharmaceutical transfer assembly 236 during operation.

The needle hub assembly 244 has a conduit 270 (which in the illustrated embodiment is a first hollow piercing member 270 having a tip 272). Tip 272 has an aperture in communication with a hollow passage in conduit 270. The first hollow piercing member is connected to a needle hub 274. The first hollow piercing member 270 may be any suitable hollow piercing device, and is preferably a hollow needle such as a standard cannula.

The needle hub assembly 244 has a size and shape to permit longitudinal movement within the bore 252 between a retracted or "unactivated" position (as seen in FIGS. 29-30, 32-33, and 37) and an advanced or "activated" position (as seen in FIGS. 31, 34-36). In the retracted position, the tip 272 of the first hollow piercing member 270 is fully contained within the second portion 256 of the bore 252 of the housing 242. In the advanced position, the tip 272 of the first hollow piercing member 270 protrudes past the second portion 256 of the bore 252 of the housing 242 and penetrates completely through the piston 230.

The needle hub 274 has a flange 279 having a bottom surface 231 that abuts a top surface 233 of the latch 223 to support the needle hub assembly 244 within the housing 242 while in the retracted or "inactivated" position. The needle hub 274 has a female luer slip 500 fitting to permit receipt of a post 276 of the vial socket assembly 240. The needle hub 274 and the post 276 act to hold the vial socket assembly 240 to the needle transfer plunger rod 238 initially when the needle hub assembly 244 is in the retracted or "inactivated" position.

The resilient biasing member 246 may be any suitable biasing device, and is preferably a compressible spring. The resilient biasing member 246 is sized and shaped to fit within the first portion 254 of the bore 252 between a surface 502 of the needle hub 274 and the shoulder 258. While the needle hub assembly 244 is in the retracted or "unactivated" position, the resilient biasing member 246 is at rest (e.g. no force is being applied to or by the resilient biasing member 246 or the hub 274). While the needle hub assembly 244 is in the advanced or "activated" position, the resilient biasing member 246 is compressed against the annular shoulder 258 by the hub 274 (e.g., a force is being applied to the resilient biasing member 246). A main purpose of the resilient biasing member 246 is to retract the needle hub assembly 244 to the retracted or "unactivated" position after the fluid transfer has been completed and the vial socket assembly 240 has been removed from the needle transfer plunger rod 238, as will subsequently be described.

The vial socket assembly 240 has a post 276, a collar 237 having an internal thread 241, an annular recess 239, a second hollow piercing member 278 having a tip 280, and a vial socket 282. The post 276 has a male luer slip fitting that permits coupling between the post 276 and the female luer slip fitting 500 on the needle hub 274 while the pharmaceutical transfer assembly 236 is in the retracted or "inactivated position". The flange 268 matingly cooperates with the internal thread 241 in the annular recess 239 to securely connect the vial socket assembly 240 to the needle transfer plunger rod 238.

The second hollow piercing member 278 may be any suitable, hollow piercing device, and is preferably is a hollow needle such as a spike. The vial socket 282 is appropriately sized and shaped to receive a standard pharmaceutical vial having the penetrable closure and the cap, described above. Preferably, the vial socket 282 has a retaining means 243 (which in the illustrated embodiment is a plurality of retaining latches 243 in the form of an annular ridge around the inner circumference of the vial socket 240, which is divided by a plurality of longitudinal slots 245) for retaining vial 210 in vial socket 282. The slots 245 permit the vial socket 240 some flexibility to facilitate insertion of the pharmaceutical vial 210. The retaining latches 243 positively engage the cap 220 of the vial 210 once it is fully inserted into the vial socket 240 (as shown in FIGS. 30-31, and 34-36).

The optional sheath assembly 203 generally comprises a plastic cap 205 having an internal thread 505, and a hard body sheath 207 having a corresponding external thread 293 and an annular detent 295. The annular detent 295 snap fits into the snaps 291*a*, 291*b* on the top plate extensions of the piston backstop 201 to positively engage the sheath 207 on the piston backstop 201. The sheath assembly 203 protects the syringe 222 from breakage, and also prevents a rubber tip cap 232 from dislodging from the neck end 228 of the syringe 222 during both transport and deployment of the pharmaceutical transfer system 234.

Figure 28:
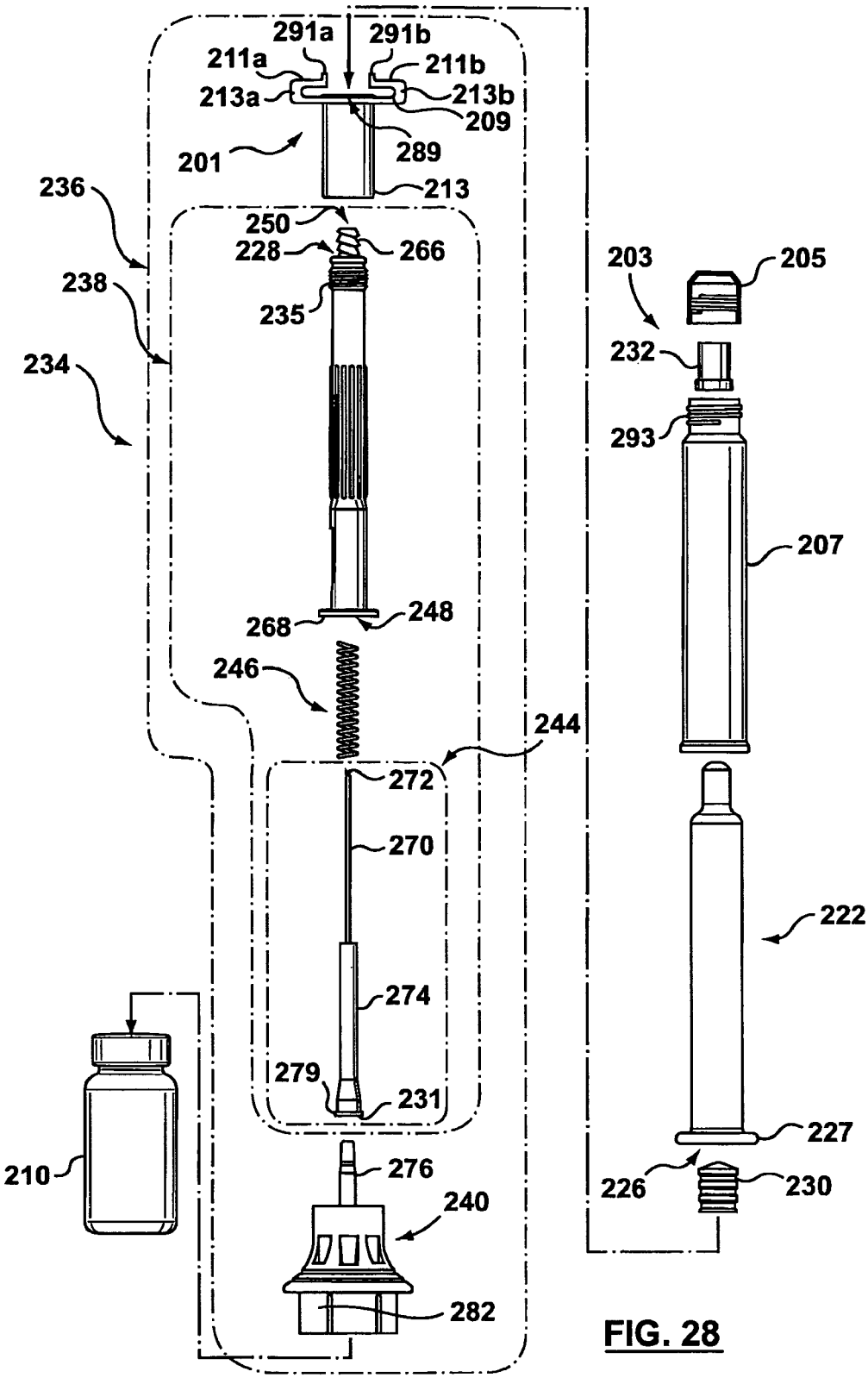
FIG. 28 is an exploded side elevational view of the pharmaceutical delivery system of FIG. 27.
Figure 29:
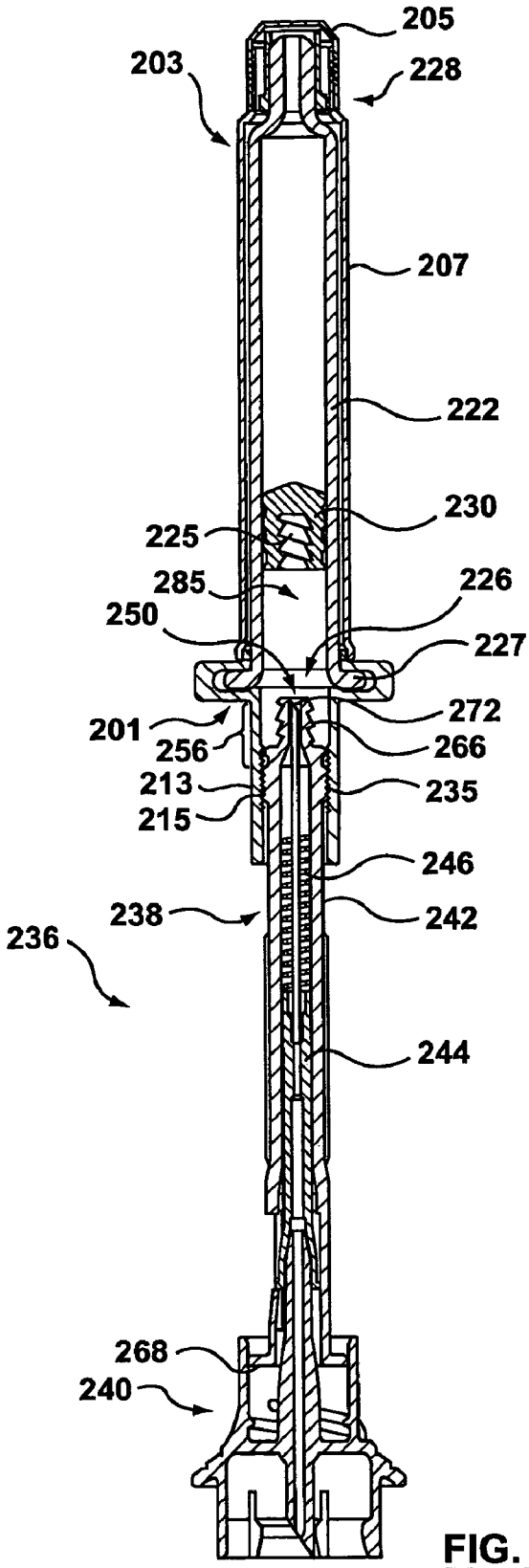
FIG. 29 is a cross-sectional view of the pharmaceutical transfer assembly of FIG. 27 attached to a syringe with a needle hub assembly in a retracted position relative to a housing and a transfer needle plunger rod in a first position relative to a backstop.
Figure 32:
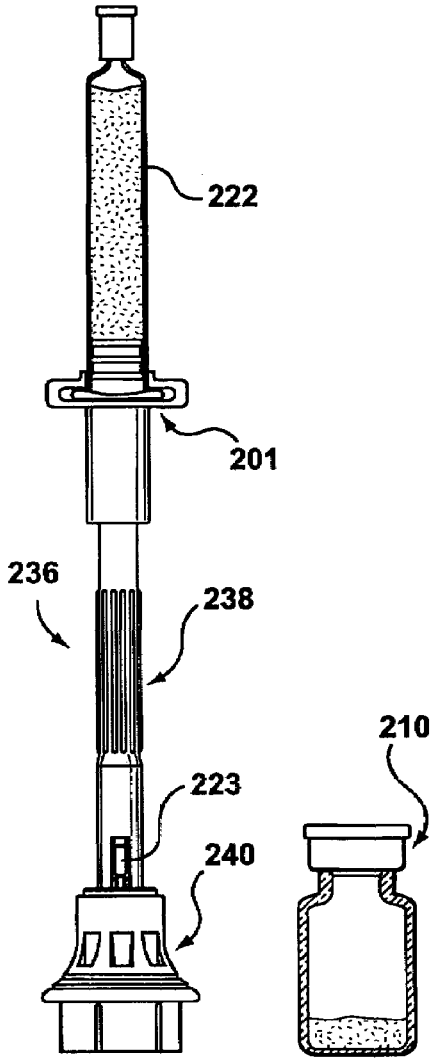
FIGS. 32-37 illustrate successive stages in the deployment of the pharmaceutical transfer assembly of FIG. 27 to reconstitute a multi-component pharmaceutical according to a further embodiment of the invention.
Figure 33:
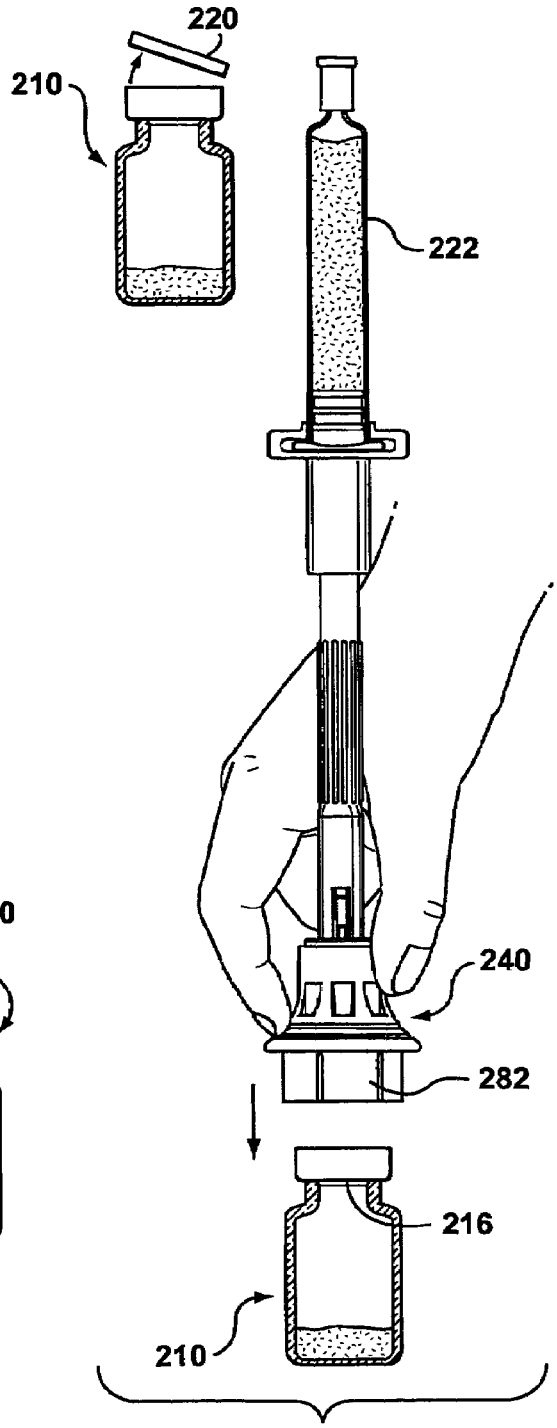

Referring now to FIGS. 29 and 32, the pharmaceutical transfer assembly of FIGS. 27-28 is shown generally at 236 with the needle transfer assembly 244 in a retracted position and the transfer needle plunger rod 238 in a first position. While in this configuration, the external thread 235 of the housing 242 is engaged with the internal thread 215 of the piston backstop 201. Additionally, the second portion 256 of the housing 242 is contained within the collar 213 of the piston backstop 201 and does not extend into the open end 226 of the syringe 222. This configuration has a number of advantages including that it permits sterilizing gas to pass through a gap 285 created between the second portion 256 of the housing 242 and the internal thread 225 of the piston 230, prevents accidental activation of the system since the needle transfer plunger rod 238 must be rotated to fully disengage the external thread 235 from the internal thread 215 of the piston stop 201 before the external thread 266 of needle transfer plunger rod can be threaded into the internal thread 225 of the piston 230, and permits the flange 227 of the syringe 222 to be inserted into the piston backstop 201 with ease since the flange 227 of the syringe 222 can be inserted into the piston backstop 201 without interference from the needle transfer plunger rod 238.

Figure 30:
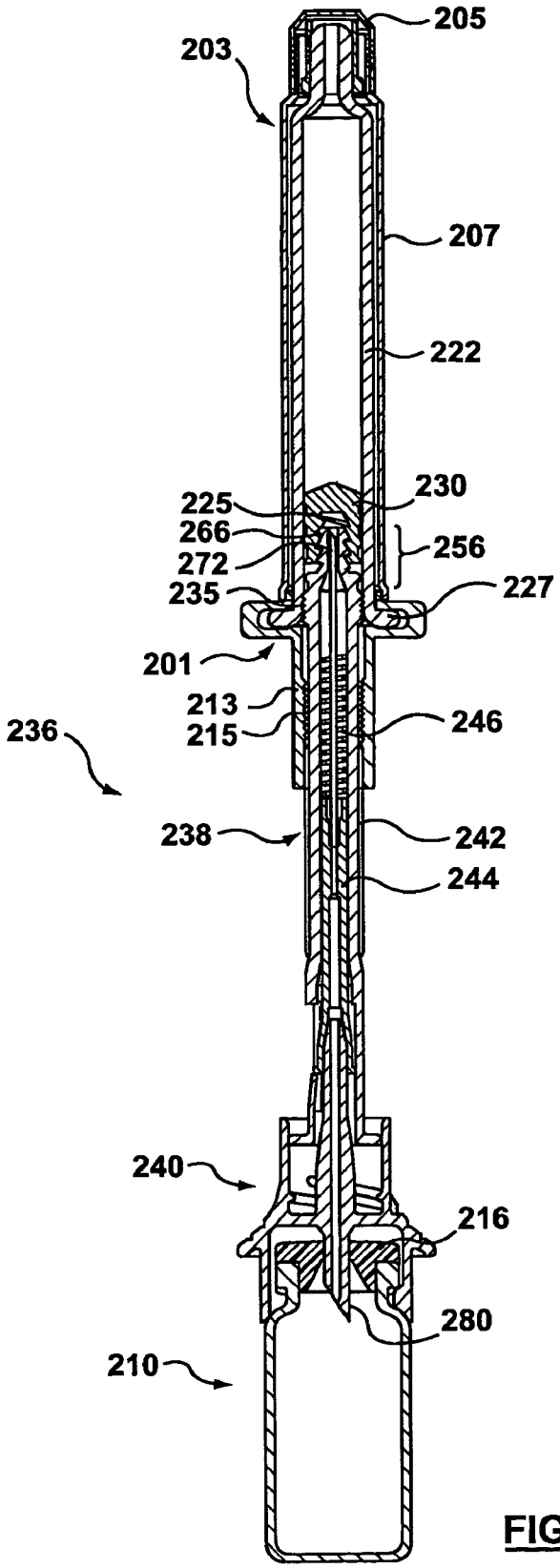
FIG. 30 is a cross-sectional view of the pharmaceutical transfer assembly of FIG. 27 attached to both a syringe and a vial with a needle hub assembly in a retracted position relative to a housing and a transfer needle plunger rod in a second position relative to a backstop.

FIG. 30 is a cross-sectional view of the pharmaceutical transfer assembly 236 with the needle hub assembly 244 in a retracted position and the needle transfer plunger rod 238 in a second position. While in this configuration, the external thread 235 of the housing 242 is fully disengaged from the internal thread 215 of the piston backstop 201. The second portion 256 of the housing 242 extends past the collar 213 of the piston stop 201 into the open end 226 of the syringe 222, and the external thread 266 of the housing 242 is engaged with the internal thread 225 in the piston 230. While in this configuration, the pharmaceutical transfer assembly is ready to be deployed. The piston 230 cannot be accidentally removed from the open end of the 226 of the syringe 222 by accidentally pulling on the vial, because a stop is created when the external thread 235 on the housing 242 abuts the internal thread 215 on the piston backstop 201.

Figure 31:
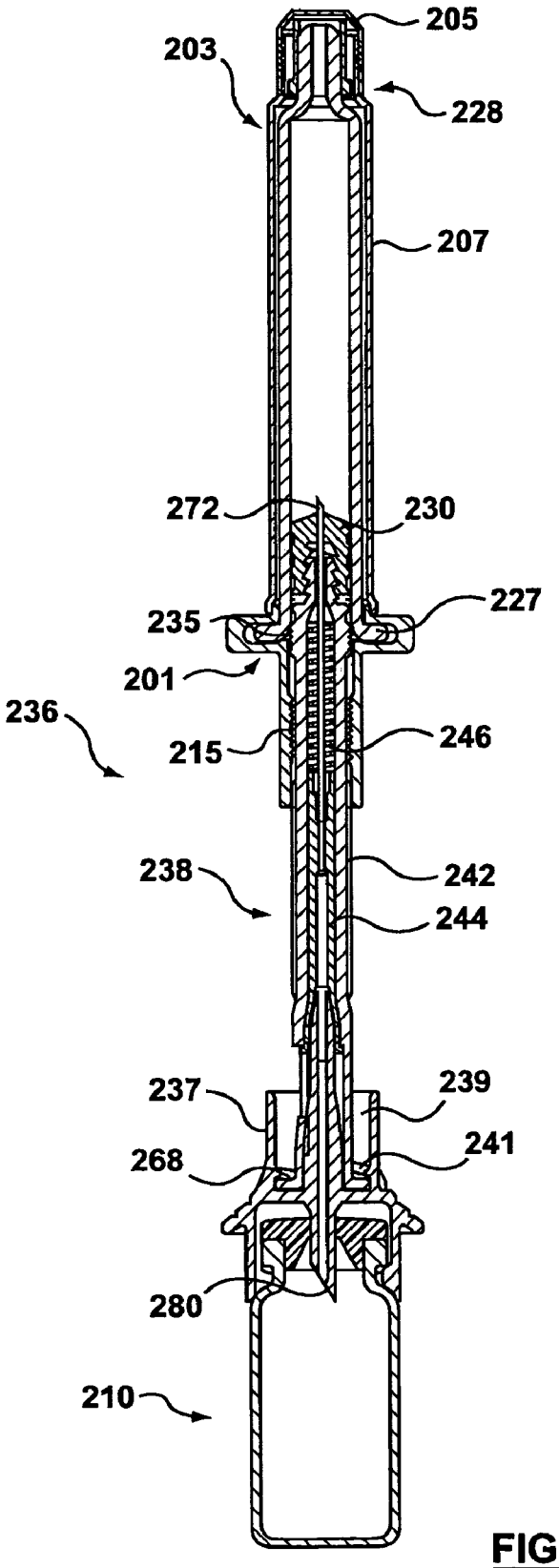
FIG. 31 is a cross-sectional view of the pharmaceutical transfer assembly of FIG. 27 attached to a syringe and a vial with a needle hub assembly in an advanced position relative to a housing and a transfer needle plunger rod in a second position relative to a backstop.
Figure 34:
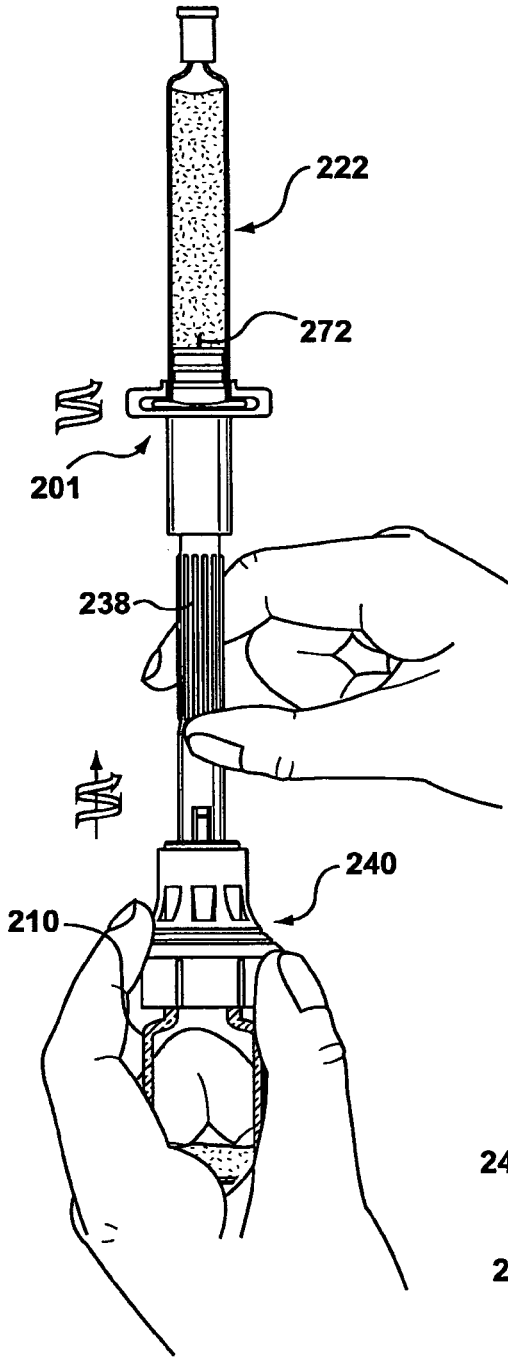
Figure 35:
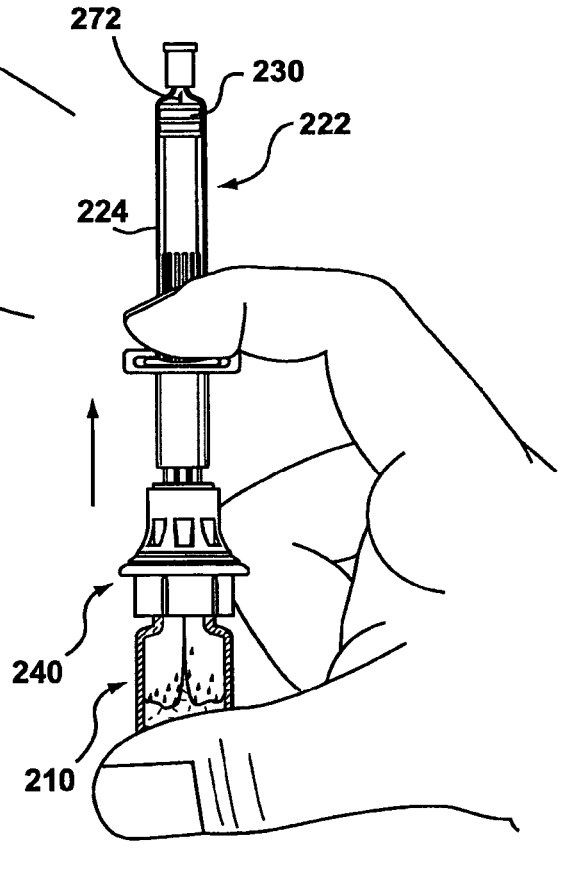

Referring now to FIGS. 31 and 34, the pharmaceutical transfer assembly 236 is shown with the needle hub assembly 244 in an advanced position and the needle transfer plunger rod 238 in a second position. The second portion 256 of the housing 242 extends past the collar 213 of the piston stop 201 into the open end 226 of the syringe 222, and the external thread 266 of the housing 242 is engaged with the internal thread 225 in the piston 230. While in this configuration, the flange 268 of the housing 242 is matingly engaged with the internal thread 241 positioned in the annular recess 239 of the collar 237. This creates fluid communication between the syringe 222 and the vial 210 via internal passages in the needle hub assembly 244 and the vial socket assembly 240 when the vial 210 is inserted into the vial socket 240.

FIGS. 32-37 show the successive stages in the deployment of a pharmaceutical transfer assembly 236 shown in FIG. 27 to reconstitute a first fluid pharmaceutical component from a pre-filled syringe 222 with a second pharmaceutical component from a pharmaceutical vial 210. The second pharmaceutical component contained within the pharmaceutical vial 210 may be either a liquid or a solid (e.g. lyophilized powder).

Still referring to FIGS. 32-37, the method for deploying the pharmaceutical transfer assembly 236 is described in detail below. First, in step (a) the user threads the external thread 235 on the needle transfer plunger rod 238 into the internal thread 215 within the piston backstop 201. Then the user inserts the post 276 of the vial socket assembly 240 into the needle hub 274 to create the assembly shown in FIGS. 29 and 32. Next, in step (b) the user removes the cover 220 of the pharmaceutical vial 210 (see FIG. 33). Then, in step (c) the user inserts and snap fits the pharmaceutical vial 210 into the vial socket 282 of the vial socket assembly 240 such that the tip 280 of the second hollow piercing member 278 penetrates the penetrable closure 216 on the pharmaceutical vial 210 (see FIG. 33). Step (a) can be performed first followed by steps (b) and (c) in that order, or steps (b) and (c) can be performed first in that order followed by step (a).

After completing steps (a), (b), and (c), in step (d) the user threads the needle transfer plunger rod 238 so that the external thread 235 on the housing 242 becomes fully disengaged from the internal thread 215 on the piston backstop 201 and the external thread 266 matingly engages the internal thread 225 on the piston 230 (see FIG. 30). Next, in step (e) the user advances both the pharmaceutical vial 210 and the vial socket assembly 240 forward towards the syringe 222 and locks the vial socket assembly 240 to the housing 242 by threading the flange 268 of the housing 242 into the internal thread 241 formed in the annular recess 239 of the collar 237 of the vial socket 240. This, in turn, advances the tip 272 of the first hollow piercing member longitudinally within the bore 252 of the housing 242 from the retracted position to the advanced position wherein the tip 272 of the first hollow piercing member 270 penetrates completely through the piston 230 into the body of the syringe 222. With both tip 272 and tip 280 having pierced their respective items, this creates fluid communication between the pharmaceutical vial 210 and the syringe 222 (see FIGS. 31 and 34).

Next in step (f) the user advances the vial 210 longitudinally towards the syringe 222. This moves the piston 230 within the syringe 222 forcing the fluid within the syringe body 224 into and through the needle assembly 244 and through the vial socket assembly 240 to inject the first fluid pharmaceutical component into the pharmaceutical vial 210 (see FIG. 35). Then, in step (g) the user swirls the pharmaceutical delivery system 234 to dissolve, dilute or suspend the second pharmaceutical component into the first pharmaceutical component.

Figure 36:
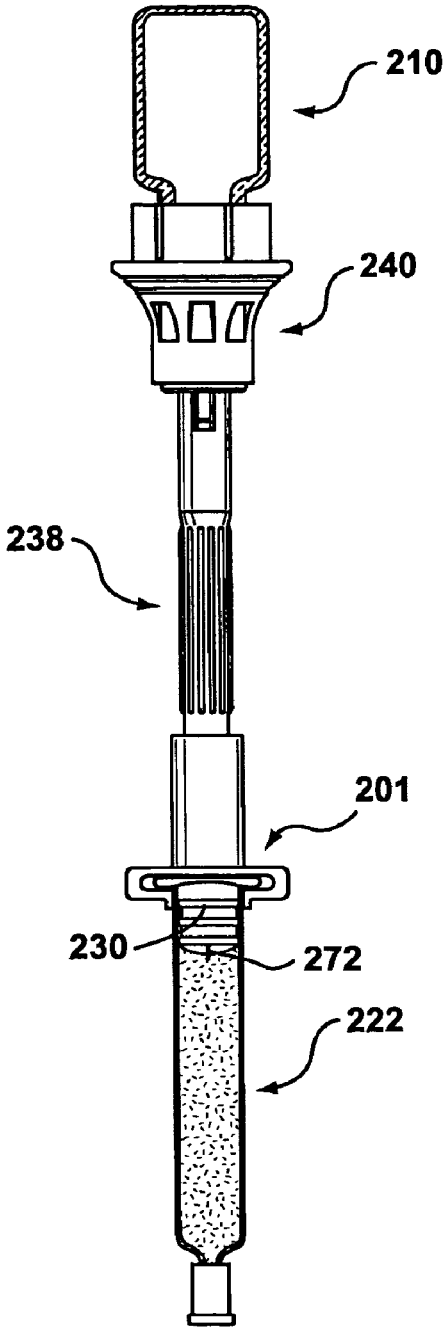

Next in step (h), the user inverts the pharmaceutical delivery system 234 and withdraws the vial 210 longitudinally away from the syringe 222 to aspirate the now mixed contents of the pharmaceutical vial 210 into the syringe 222 (see FIG. 36). The piston 230 cannot be accidentally removed from the open end 226 of the syringe 222 during this step by merely withdrawing the vial away from the syringe, because a stop is created when the external thread 235 on the housing 242 abuts the internal thread 215 on the piston backstop 201.

Figure 37:
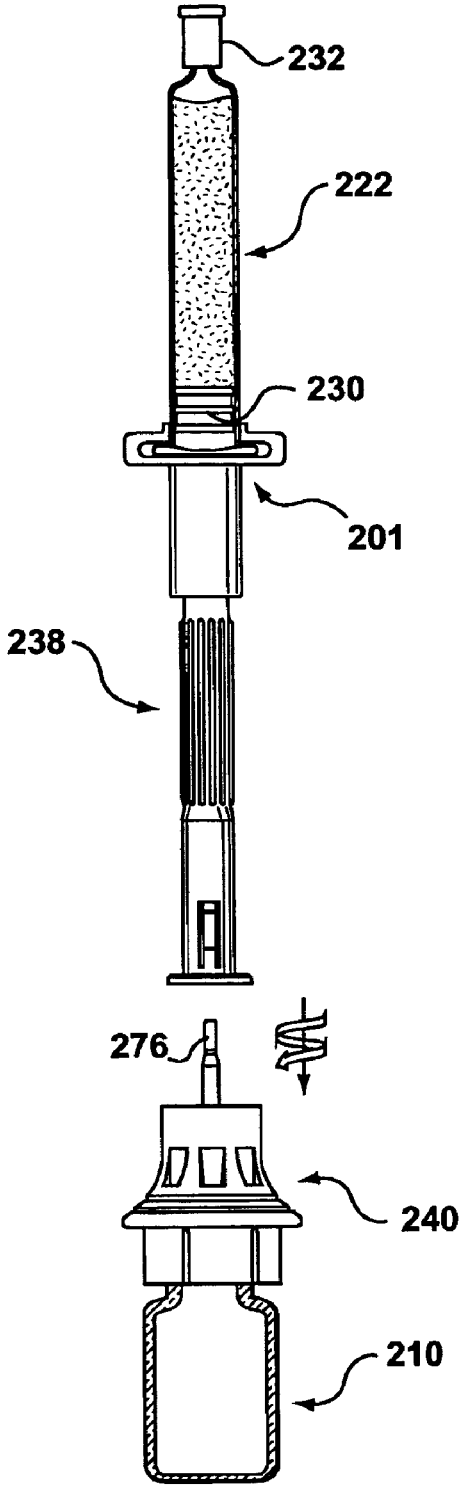

In step (i), the user detaches the vial socket assembly 240 from the needle transfer plunger rod 238 (by unthreading the two and pulling the post 276 of the vial socket assembly 240 out of the needle hub 274) to provide a filled syringe 222 ready for use (see FIG. 37). To use the filled syringe, the user removes the tip cap 232 and attaches a needle (not shown). The needle transfer plunger rod 238 may be used to discharge the mixed pharmaceutical from the syringe 222 through the attached needle.

Once the user detaches the vial socket assembly 240 from the needle transfer plunger rod 238 (by unthreading the two), the resilient biasing member 246 biases the first hollow piercing member back to the retracted or "inactivated" position. As such, the piston 230 reseals to prevent fluid communication between the syringe 222 and the needle transfer plunger rod 238. Accordingly, when the user uses syringe 222 to deliver the reconstituted multi-component pharmaceutical to a patient or intravenous feed line, the user simply depresses the needle transfer plunger rod 238 in a conventional manner.

Figure 42:
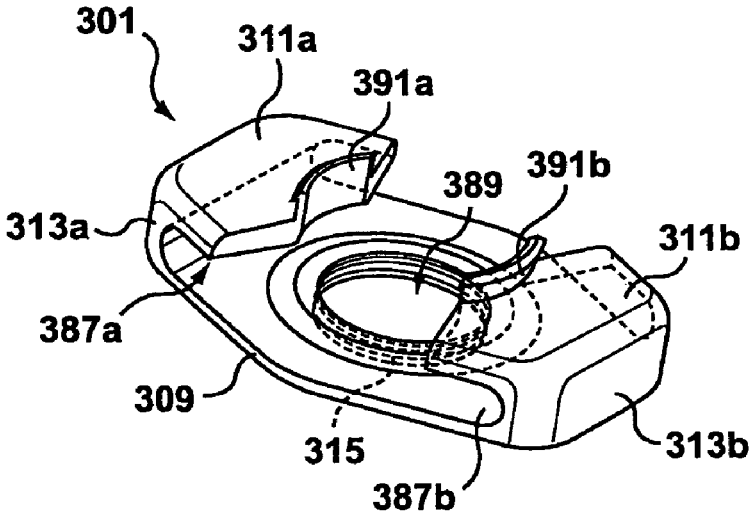
FIG. 42 is a perspective view of a backstop according to a further embodiment of the invention.

FIG. 42 shows another embodiment of a piston backstop 301. The piston backstop 301 has a bottom plate 309 with an aperture 389, two top plate extensions 311*a*, 311*b*, and two side walls 313*a*, 313*b* connecting the bottom plate 309 to the two top plate extensions 311*a*, 311*b*. In this arrangement, the bottom plate 309, sidewalls 313*a*, 313*b*, and the top plate extensions 311*a*, 311*b* form a pair of gaps 387*a*, 387*b* that is sized to snugly receive the flange 227 of the syringe 222. An inner surface defining the aperture 389 has a retaining means 315 (which in the illustrated embodiment is an internal thread), and an inner diameter that is slightly larger than the outer diameter of the detachable needle transfer plunger rod 238 to permit the needle transfer plunger rod to move axially within the piston stop 301. The piston back stop 301 may have a pair of snaps 391*a*, 391*b* positioned on the two top plate extensions 311*a*, 311*b* to permit attachment of the sheath 207. The primary difference between the piston backstop shown in FIG. 42 and the one previously described in relation to FIG. 41 is that there sis no collar and hence the internal thread 315 is located in the inner surface defining the aperture 389, whereas in the previously described embodiment the internal thread 215 is located in the collar 213.

Figure 38:
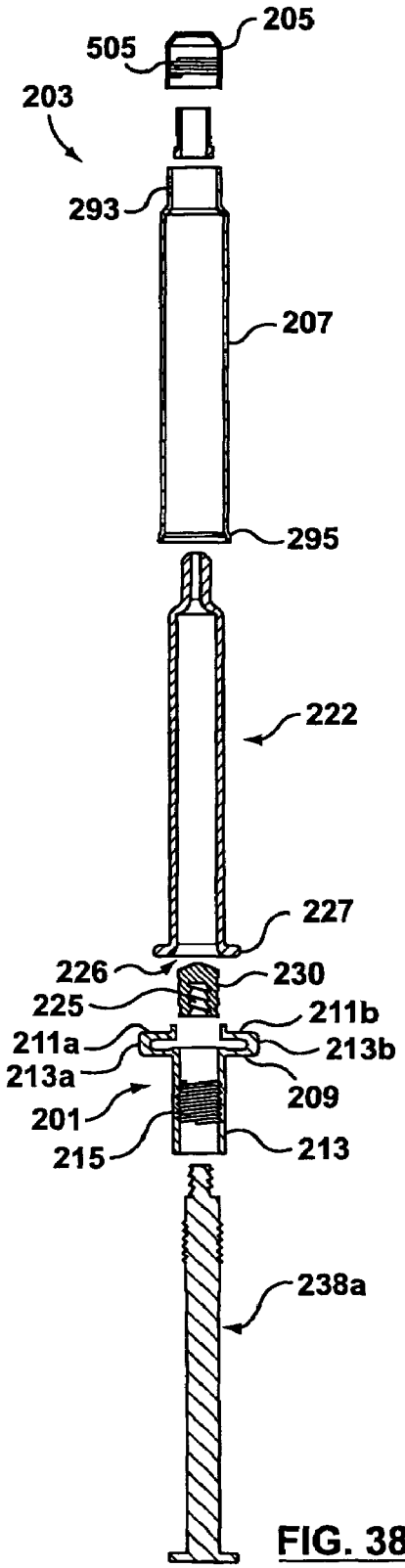
FIG. 38 is an exploded cross-sectional view of a syringe according to a further embodiment of the invention.
Figure 39:
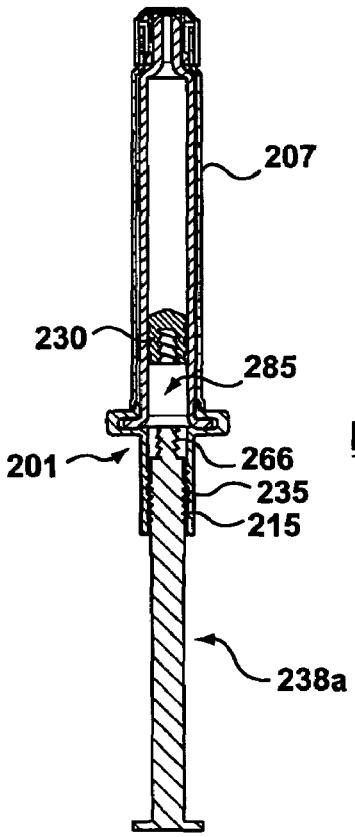
FIG. 39 is a cross-sectional view of the syringe of FIG. 38 in a first position.
Figure 40:
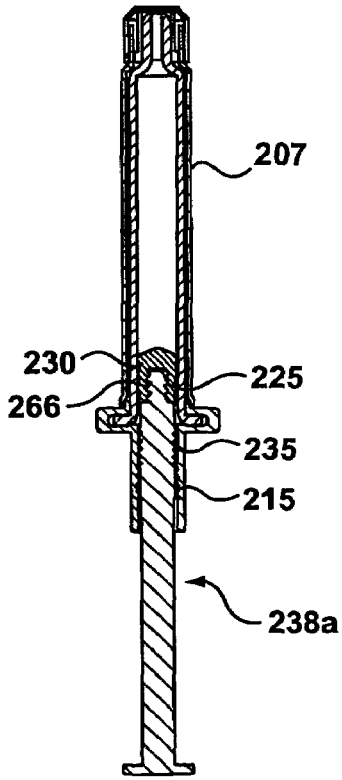
FIG. 40 is a cross-sectional view of the syringe of FIG. 38 in a second position.

FIGS. 38-40 show the piston backstop 201 being used with a pre-filled syringe 222 having a slightly modified plunger rod 238*a*. Plunger rod 238*a* is a conventional plunger rod having an external thread 235 that is shaped and sized to matingly cooperate with the internal thread 215 of the piston backstop 201. In a similar manner, the piston backstop 201 can be connected to a flange 227 of the pre-filled syringe 222 to facilitate sterilization of the pre-filled syringe 222, to prevent accidental activation of the pre-filled syringe 222, and to prevent the piston 230 from being accidentally dislodged from the open end 226 of the syringe 222.

FIG. 39 shows a pre-filled syringe 222 ready to be sterilized. While in this configuration, the external thread 235 of the plunger rod 238*a* is engaged with the internal thread 215 of the piston backstop 201. Additionally, the plunger rod 238*a* is contained within the collar 213 of the piston backstop 201 and does not extend into the open end 226 of the syringe 222. This configuration has a number of advantages including that it permits sterilizing gas to pass through a gap 285 created between the plunger rod 238*a* and the internal thread 235 of the piston 230, prevents accidental activation of the prefilled syringe 222, and permits the flange 227 of the syringe 222 to be inserted into the piston backstop 201 with ease since the flange 227 of the syringe 222 can be inserted into the piston backstop 201 without interference from the plunger rod 238*a*.

FIG. 40 shows a pre-filled syringe ready to be deployed. While in this configuration, the external thread 235 of the plunger rod 238*a* is disengaged from the internal thread 215 of the piston backstop 201. The plunger rod 238*a* extends past the collar 213 of the piston stop 201 into the open end 226 of the syringe 222, and the external thread 266 of the housing 242 is engaged with the internal thread 225 in the piston 230. The piston 230 cannot be accidentally removed from the open end 226 of the syringe 222 by accidentally pulling on the plunger rod 238*a*, because a stop is created when the external thread 235 on the plunger rod 238*a* abuts the internal thread 215 on the piston backstop 201.

Figure 43:
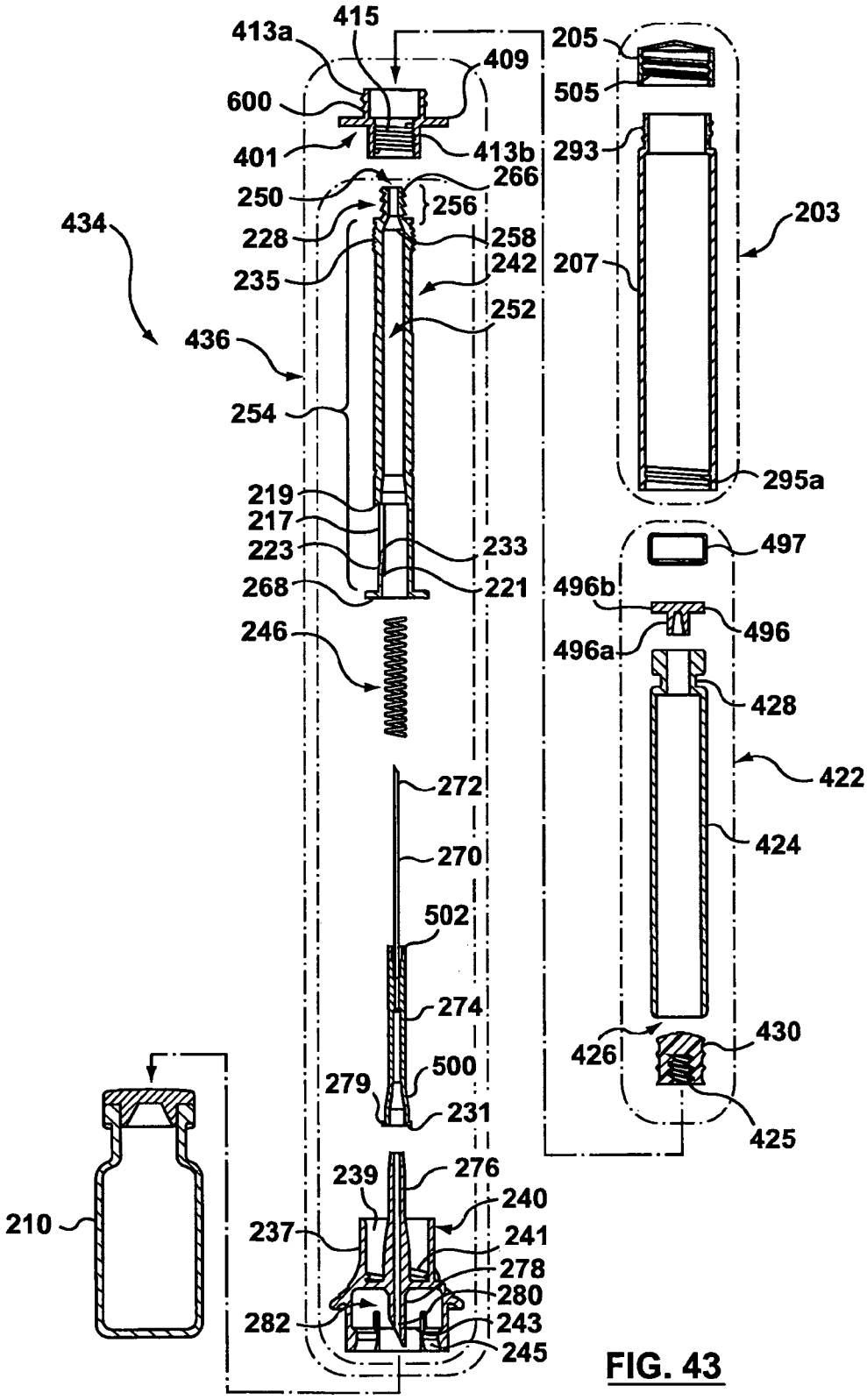
FIG. 43 is an exploded cross-sectional view of a pharmaceutical delivery system including a pharmaceutical transfer assembly.
Figure 44:
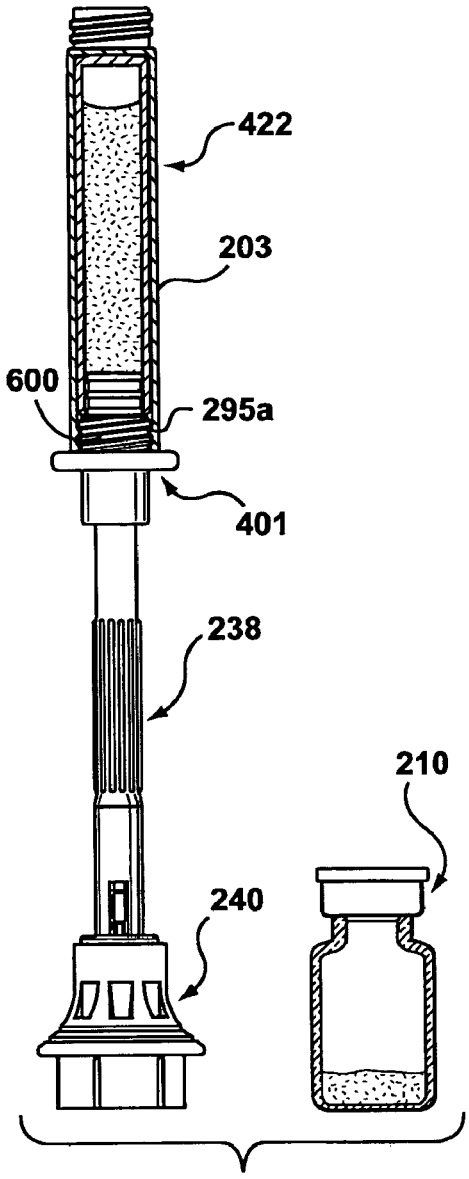
FIGS. 44-51 illustrate successive stages in the deployment of the pharmaceutical transfer assembly of FIG. 43 to reconstitute a multi-component pharmaceutical according to a further embodiment of the invention.
Figure 45:
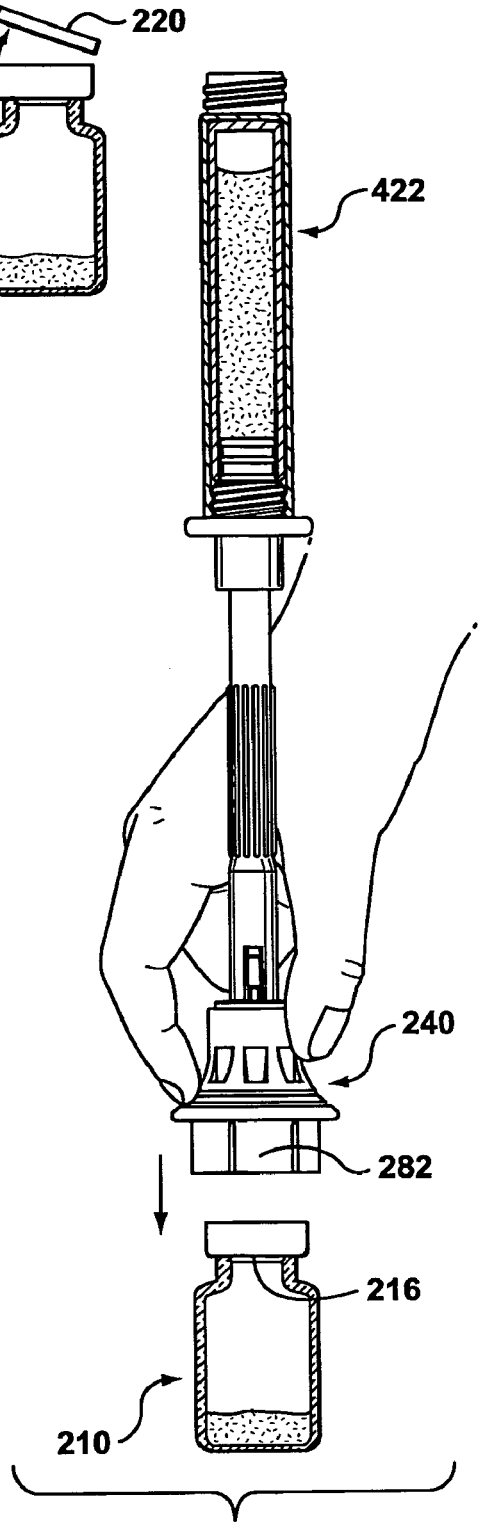
Figure 46:
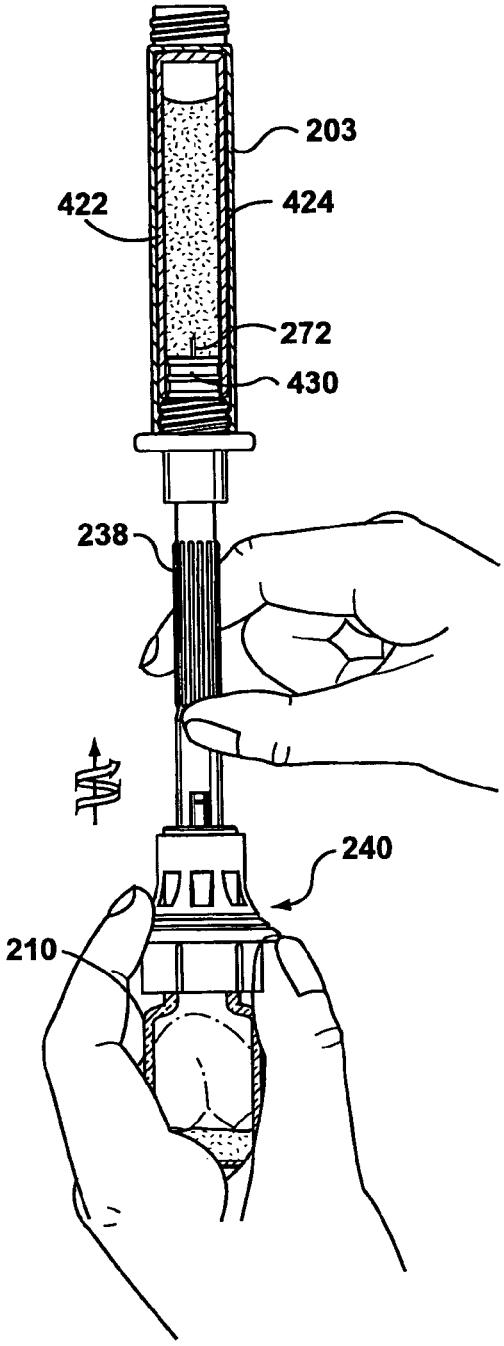
Figure 47:
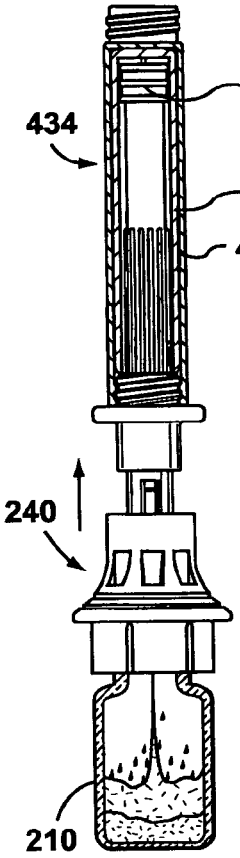

Referring now to FIG. 43, a pharmaceutical delivery system according to another embodiment of the invention is shown generally at 434. The pharmaceutical delivery system 434 shown in FIGS. 43-51 is the same as the pharmaceutical delivery system 234 of FIGS. 27-37, except as described in detail below. In particular, the pharmaceutical delivery system 434 shown in FIG. 43 includes a cartridge 422 (instead of a syringe), a modified sheath assembly 203, and a modified piston backstop 401 that cooperates with the modified sheath assembly 203 to facilitate the deployment of the system 434.

Cartridge 422 has a body 424 being open at one end 426 and having a neck 428 at the opposite end. A piston 430 is lodged in the body 424 proximate the open end 426. The piston 430 has an internal thread 425 that matingly threads with the thread on the detachable needle transfer plunger rod 238. The neck 428 of the cartridge 422 has a reduced diameter compared with the body 424. A penetrable closure 496 has a body 496*a* and a flange 496*b*, and is preferably made of an elastomeric material (e.g. rubber). The body 496*a* is sized to fit snugly within the neck 428. A cap 497 holds the penetrable closure 496 in the neck 428 of the cartridge 422.

The sheath assembly 203 generally has a plastic cap 205 having an internal thread 505, and a hard body sheath 207 having a corresponding external thread 293 and an internal thread 295*a*. The sheath assembly 203 helps protect the cartridge 422 from breakage during both transport and deployment of the pharmaceutical transfer system 434. Additionally, the sheath assembly 203 facilitates the assembly and deployment of the pharmaceutical delivery system 434, as will be subsequently described in more detail below.

The piston backstop 401 may be connected to the sheath assembly 203 to facilitate sterilization of the transfer assembly 436, to prevent accidental activation of the pharmaceutical delivery system 434, and to prevent the piston 430 from being accidentally dislodged from the open end 426 of the cartridge 422. The piston backstop 401 has a preferably cylindrical collar 413 having an upper portion 413*a* and a lower portion 413*b*, and a flange 409 extending radially from the intersection between the upper and lower portions 413*a*, 413*b* of the collar. The collar 413*a*, 413*b* has an internal diameter that is slightly larger than the outer diameter of the detachable needle transfer plunger rod 238 to permit the needle transfer plunger rod 238 to move axially within the piston stop 401. The upper portion of the collar 413*a* has an external thread 600 that matingly cooperates with the internal thread 295*a* of the sheath assembly 203 to permit the two components to be threaded together. The lower portion of the collar 413*b* has an internal thread 415 that matingly cooperates with an external thread 235 of the needle transfer plunger rod 238 to permit the two components to be threaded together.

FIGS. 44-51 show the successive stages in the deployment of the pharmaceutical transfer assembly 436 shown in FIG. 43 to reconstitute a first fluid pharmaceutical component from a pre-filled cartridge 422 with a second pharmaceutical component from a pharmaceutical vial 210. The second pharmaceutical component contained within the pharmaceutical vial 210 may be either a liquid or a solid (e.g. lyophilized powder).

Still referring to FIGS. 44-51, the method for deploying the pharmaceutical transfer assembly 436 is described in detail below. First, in step (a) the user threads the external thread 600 on the piston backstop 401 into the internal thread 295*a* on the sheath assembly 203. Then the user threads external thread 235 on the needle transfer plunger rod 238 into the internal thread 415 within the piston backstop 401. Then the user inserts the post 276 of the vial socket assembly 240 into the needle hub 274 to create the assembly shown in FIG. 44. Next, in step (b) the user removes the cover 220 of the pharmaceutical vial 210 (see FIG. 45). Then, in step (c) the user inserts and snap fits the pharmaceutical vial 210 into the vial socket 282 of the vial socket assembly 240 such that the tip 280 of the second hollow piercing member 278 penetrates the penetrable closure 216 on the pharmaceutical vial 210 (see FIG. 45). Step (a) can be performed first, followed by steps (b) and (c) in that order, or steps (b) and (c) can be performed first, in that order, followed by step (a).

After completing steps (a), (b), and (c), in step (d) the user advances the needle transfer plunger rod 238 by rotation until the external thread 235 on the housing 242 fully disengages from the internal thread 415 on the piston backstop 401 and external thread 266 matingly engages the internal thread 425 on the piston 430. Next, in step (e) the user advances both the pharmaceutical vial 210 and the vial socket assembly 240 forward toward the cartridge 422, and threads the flange 268 of the housing 242 into the internal thread 241 formed in the annular recess 239 of the collar 237 of the vial socket 240 to lock the vial socket assembly 240 onto the housing 242. This, in turn, advances the tip 272 of the first hollow piercing member longitudinally within the bore 252 of the housing 242 from the retracted position to the advanced position wherein the tip 272 of the first hollow piercing member 270 penetrates completely through the piston 430 into the body 424 of the cartridge 422. This creates fluid communication between the pharmaceutical vial 210 and the cartridge 422 (see FIG. 46).

Next in step (f) the user advances the vial 210 longitudinally towards the cartridge 422. This moves the piston 430 within the cartridge 422 forcing the fluid within the cartridge body 424 into and through the needle assembly 244, through the vial socket assembly 240, and into the pharmaceutical vial 210 (see FIG. 47). Then, in step (g) the user swirls the pharmaceutical delivery system 434 to dissolve, dilute or suspend the second pharmaceutical component into the first pharmaceutical component.

Figure 48:
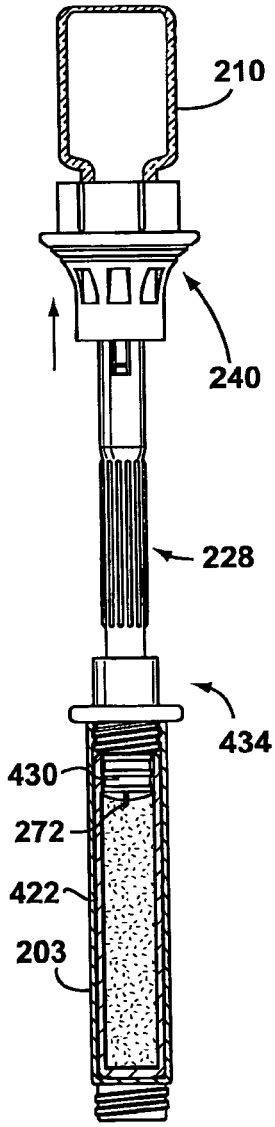

Next in step (h), the user inverts the pharmaceutical delivery system 434 and withdraws the vial 210 longitudinally away from the cartridge 422 to aspirate the now mixed contents of the pharmaceutical vial 210 into the cartridge 422 (see FIG. 48). The piston 430 cannot be accidentally removed from the open end of the 426 of the cartridge 422 during this step by merely withdrawing the vial 210 away from the cartridge 422, because a stop is created when the external thread 235 on the housing 242 abuts the internal thread 415 on the piston backstop 401.

Figure 49:
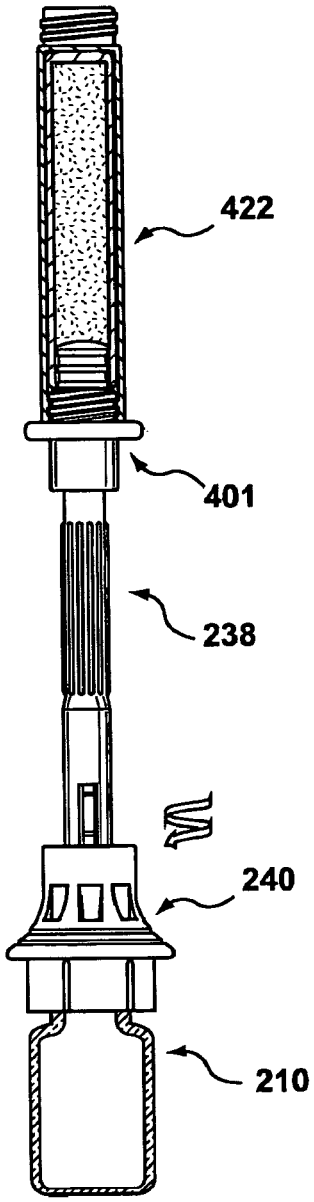
Figure 50:
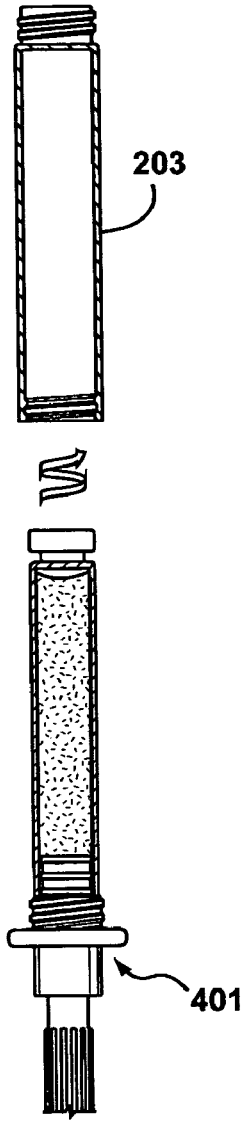
Figure 51:
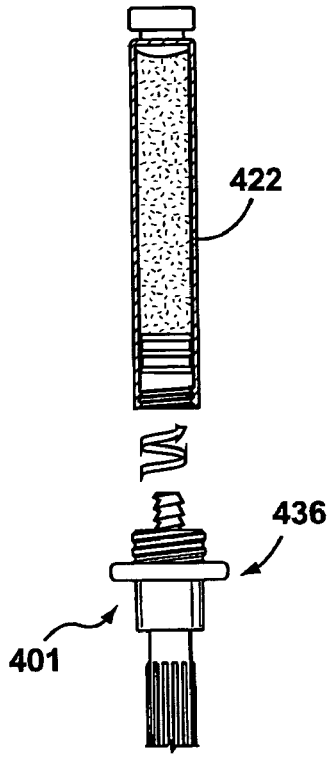

In step (i), the user unlocks the vial socket assembly 240 from the housing 242 by unthreading the two (see FIG. 49). In step (j), the user removes the sheath assembly 203 from the piston backstop 401 by unthreading the two (see FIG. 50). In step (k), the user detaches the cartridge 422 from the transfer assembly 436 by unthreading the two (see FIG. 51). The cartridge 422 containing the reconstituted multi-component pharmaceutical may now be used in any conventional application, such as, for example, a pen injector or an auto injector.

Figure 52:
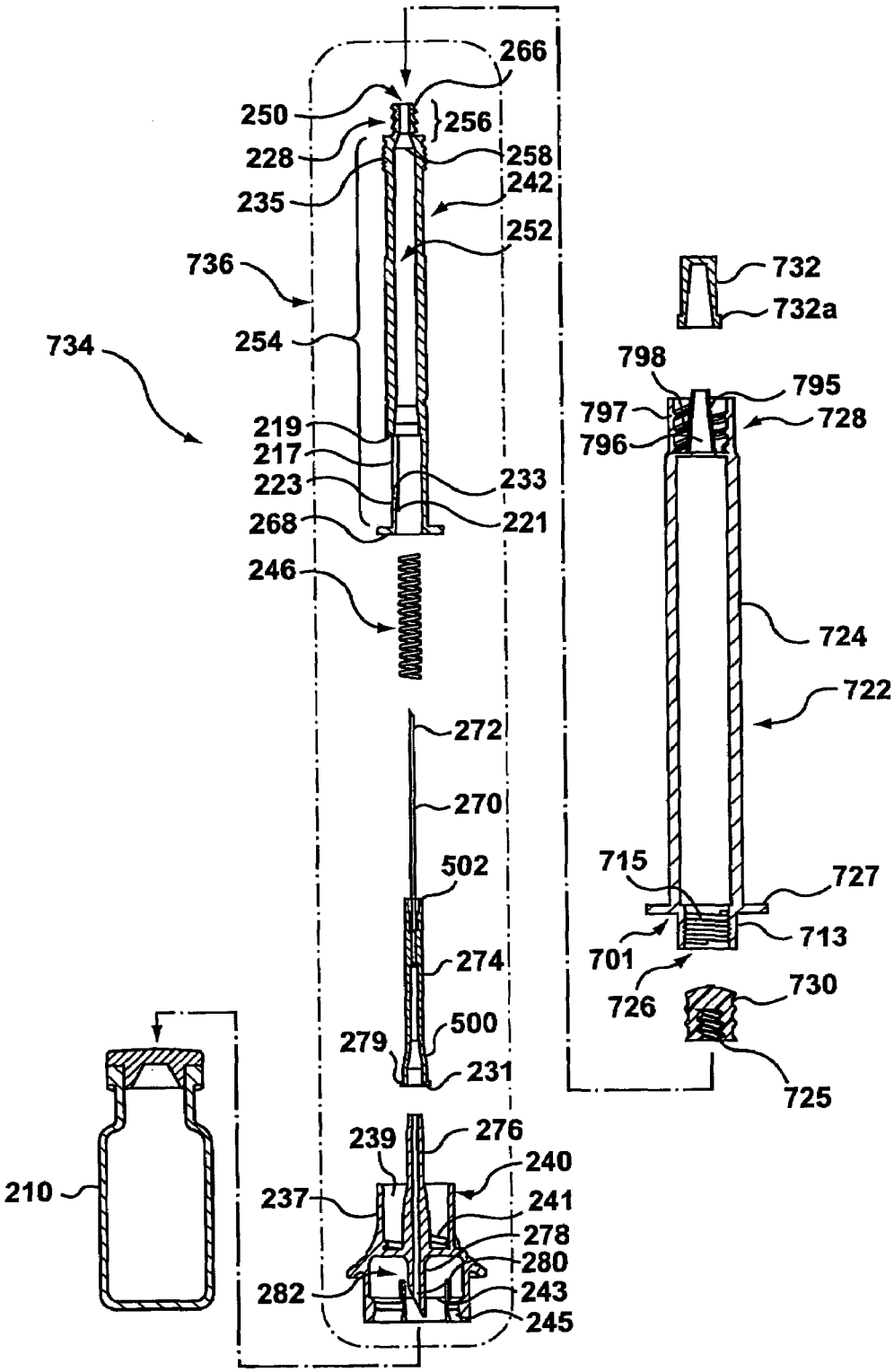
FIG. 52 is an exploded cross-sectional view of a pharmaceutical delivery system including a pharmaceutical transfer assembly according to a further embodiment of the invention.

Referring now to FIG. 52, a pharmaceutical delivery system according to another embodiment of the invention is shown generally at 734. The pharmaceutical delivery system 734 shown in FIG. 52 is the same as the pharmaceutical delivery system 234 of FIGS. 27-37, except as described in detail below. In particular, the pharmaceutical delivery system 734 shown in FIG. 52 includes a modified plastic molded syringe 722 having an integrally molded modified piston backstop 701 proximate an open end 726 of a syringe body 724.

Plastic syringe 722 has a body 724 being open at one end 726 and having a neck 728 at its opposite end. A piston 730 is lodged snugly in the syringe body 724 from the open end 726, the piston 730 being provided with an internal thread 725 that matingly threads with the thread on the detachable needle transfer plunger rod 238 A flange 727 is provided adjacent the open end 726 of the syringe body 724. The neck 728 of the syringe body 724 has a needle mount (which in the illustrated embodiment is a standard needle coupling or "luer lock" comprising a conical spigot 795 with a central passage 796 communicating with the syringe body 724, surrounded by a cylindrical sleeve 797 having an internal thread 798). The neck 728 of the syringe body 724 is sealed with a tip cap 732 having an external flange 732*a*. The syringe 722 has an integrally molded modified piston backstop 701 at the open end 726 of the syringe body 724.

The integrally molded piston backstop 701 can be used to facilitate sterilization of the transfer assembly 736, to prevent accidental activation of the pharmaceutical delivery system 734, and to prevent a piston 730 from being accidentally dislodged from the open end 726 of the syringe 722. The integrally molded piston backstop 701 has a preferably cylindrical collar 713. Collar 713 has an internal thread 715, and an inner diameter that is slightly larger than the outer diameter of the detachable needle transfer plunger rod 238 to permit the needle transfer plunger rod 238 to move axially within the piston stop 701.

The method of deploying the pharmaceutical transfer assembly 734 shown in FIG. 52 is substantially the same as the method of deploying the pharmaceutical transfer assembly 234 shown in FIG. 27.

Figure 53:
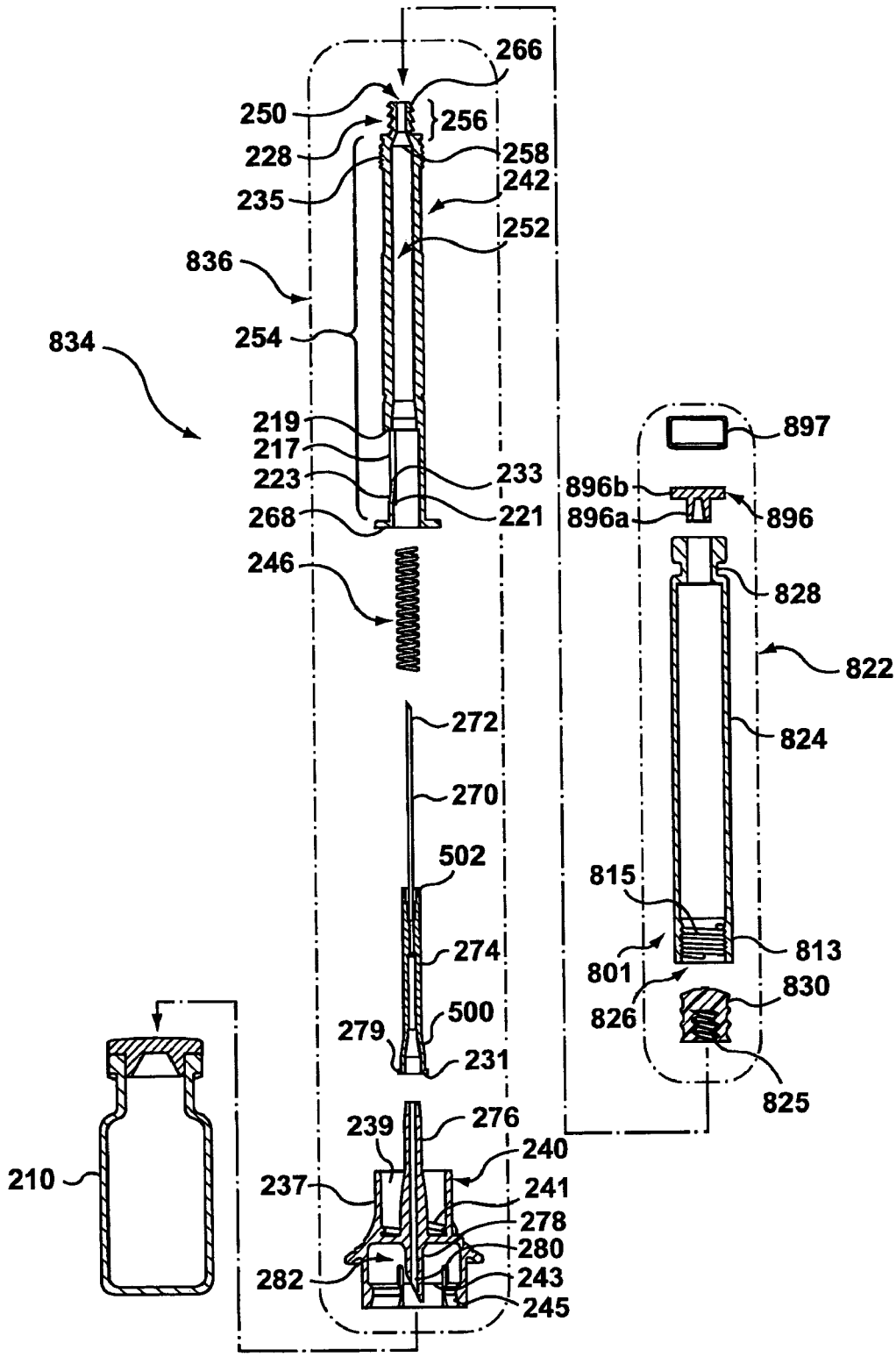
FIG. 53 is an exploded cross-sectional view of a pharmaceutical delivery system including a pharmaceutical assembly according to a further embodiment of the invention.

Referring now to FIG. 53, a pharmaceutical delivery system according to another embodiment of the invention is shown generally at 834. The pharmaceutical delivery system 834 shown in FIG. 53 is the same as the pharmaceutical delivery system 734 of FIG. 52, except as described in detail below. In particular, the pharmaceutical delivery system 834 shown in FIG. 53 includes a modified plastic molded cartridge 822 having an integrally molded modified piston backstop 801 at an open end 826 of a cartridge body 824.

Plastic cartridge 822 has a body 824 being open at one end 826 and having a neck 828 at the opposite end. A piston 830 is lodged in the body 824 proximate the open end 826. The piston 830 has an internal thread 825 that matingly threads with the thread on the detachable needle transfer plunger rod 238. The neck 828 of the cartridge 822 has a reduced diameter compared with the body 824. A penetrable closure 896 has a body 896*a* and a flange 896*b*, and is preferably made of an elastomeric material (e.g. rubber). The body 896*a* is sized to fit snugly within the neck 828. A cap 897 holds the penetrable closure 896 in the neck 828 of the cartridge 822.

The integrally molded piston backstop 801 can be used to facilitate sterilization of the transfer assembly 836, to prevent accidental activation of the pharmaceutical delivery system 834, and to prevent a piston 830 from being accidentally dislodged from the open end 826 of the cartridge 822. The integrally molded piston backstop 801 has a preferably cylindrical collar 813 with an internal thread 815, and an inner diameter that is slightly larger than the outer diameter of the detachable needle transfer plunger rod 238 to permit the needle transfer plunger rod 238 to move axially within the piston stop 801.

The method of deploying the pharmaceutical transfer assembly 836 shown in FIG. 53 is substantially the same as the method of deploying the pharmaceutical transfer assembly 236 shown in FIG. 27.

Figure 54:
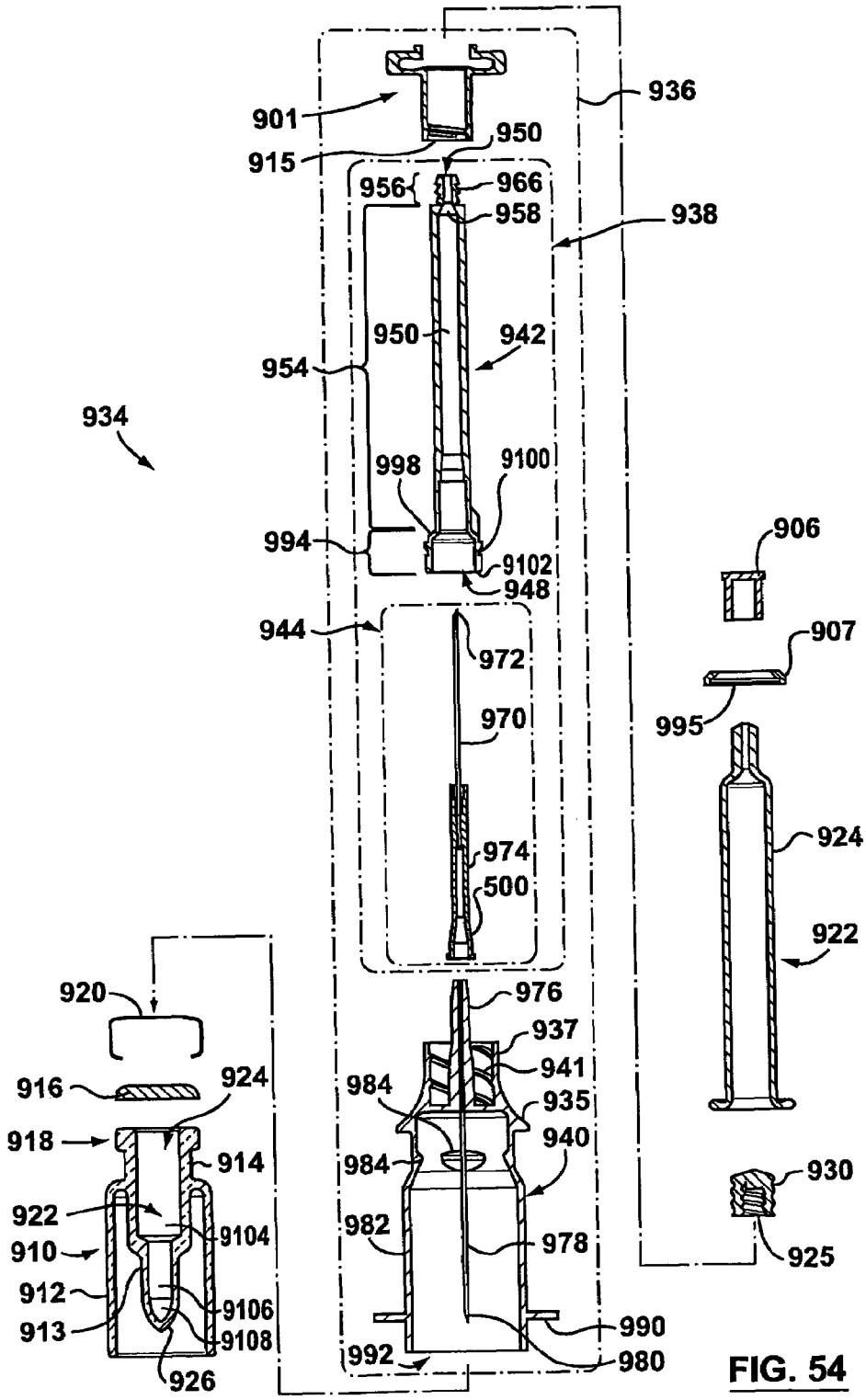
FIG. 54 is an exploded cross-sectional view of a pharmaceutical delivery system including a pharmaceutical transfer assembly according to a further embodiment of the present invention.
Figure 55:
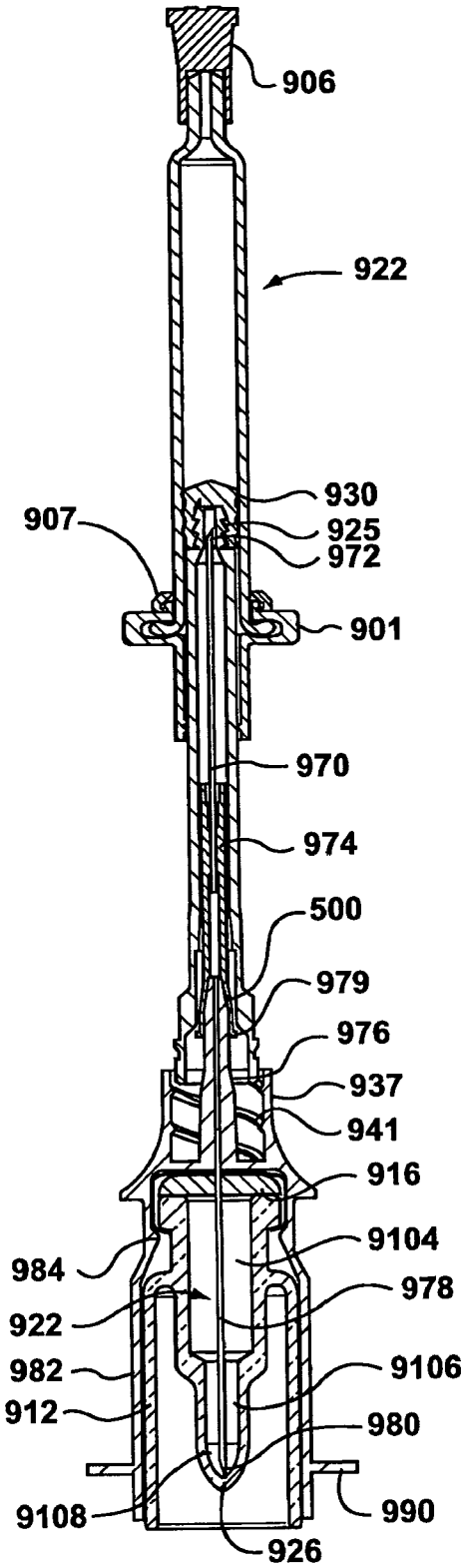
FIG. 55 is a cross-sectional view of the pharmaceutical transfer assembly of FIG. 54 attached to both a syringe and a vial with a needle hub assembly in a retracted position relative to a housing and a transfer needle plunger rod in a second position relative to a backstop.
Figure 56:
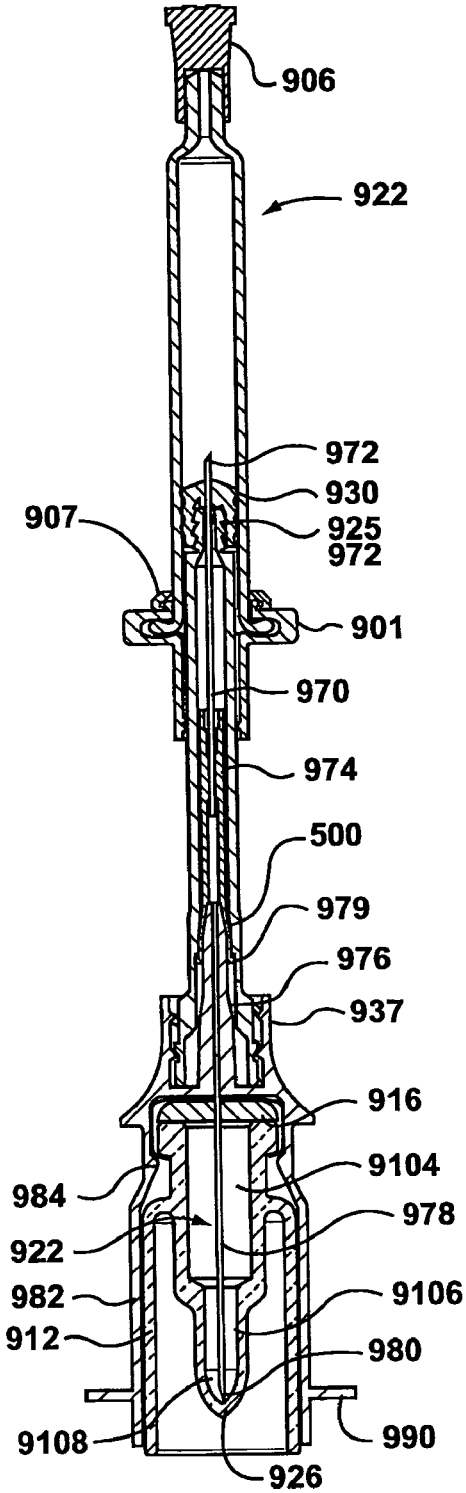
FIG. 56 is a cross-sectional view of the pharmaceutical transfer assembly of FIG. 54 attached to a syringe and a vial with a needle hub assembly in an advanced position relative to a housing and a transfer needle plunger rod in a second position relative to a backstop.

Referring now to FIGS. 54 to 58, a pharmaceutical delivery system according to a further embodiment of the invention is shown generally at 934. The pharmaceutical delivery system 934 shown in FIGS. 54-56 is substantially the same as the pharmaceutical delivery system 234 shown in FIGS. 27-37, except as described below. The primary difference is that the pharmaceutical delivery system 934 is designed to transfer a relatively small and/or precise volume of fluid. To that end, pharmaceutical delivery system 934 includes modified vial 910 (instead of a pharmaceutical vial 210) and portions of a vial socket assembly 940 are modified to accommodate same. Another difference is that the pharmaceutical delivery system 934 includes a pharmaceutical transfer assembly 936 that does not have a resilient biasing member.

Vial 910 is of a kind falling within the class of vials called maximum recovery vials. Maximum recovery vials are so named because they have an internal structure that allows fluid in the vial to pool centrally in a section of the vial having an inwardly tapering wall. This structure is in contrast to the generally flat bottom of standard vials. The inwardly tapering wall of a maximum recovery vial allows for a needle to be inserted towards the apex of the inwardly tapering wall of the vial, where the fluid pools, thereby allowing substantially all of the fluid to be withdrawn from the vial.

The vial 910 may be termed a maximum recovery vial insofar as it has an inwardly tapering wall portion forming a downward apex at which a needle aperture may be located to withdraw fluid from the vial. However, the particular structure of vial 910, as described in further detail below, is specifically designed for transfer of small amounts of fluid, for example in the order of 0.1 mL, when a lyophilized drug is mixed with a diluent and for containing small volumes of fluid to be lyophilized, such as about 0.5 mL, prior to lyophilization. Other forms of maximum recovery vial, such as Micro-Vial KG-33, manufactured by Kimble, may store volumes up to 10 mL. Other maximum recovery vials, such as those made by Waters Corporation, may have a volume of about 1 to 1.5 mL. Still other maximum recovery vials are made by Alltech Associates, Inc.

For expensive low-volume drugs, it is important to minimize the residual volume of fluid remaining in the vial after aspiration of the fluid. Advantageously, use of a maximum recovery vial and vial 910, in particular, assists to minimize the residual fluid volume in the vial and therefore facilitate maximum recovery of the fluid contained therein.

The vial 910 is suitable for containing small amounts of a pharmaceutical fluid or solid (e.g. lyophilized powder). The vial 910 may have outer dimensions that are generally the same as a standard pharmaceutical vial. The vial 910 has an outer cylindrical wall 912, an inner wall 913, a neck 914 of reduced diameter compared with the wall 912, a penetrable closure 916 made of an elastomeric material (e.g., rubber), a cap 920 to hold the penetrable closure 916 within the neck 914 of vial 910, and a cover (not shown) to protect the integrity of the penetrable closure 916 before use. The cap 920 and closure 916 are positioned at a head end 918 of the vial 910. The vial 910 further includes an inner chamber 922 that is designed to hold a relatively small volume of fluid (e.g., between about 50 μL to about 2000 μL, preferably between about 100 μL to about 500 μL).

The inner chamber 922 includes an open end 924 covered by the penetrable seal 916, an upper first part 9104, a lower second part 9106 and a narrowing third part 9108. The first part 9104 is located adjacent to the open end 924. The second part 9106 is intermediate the first part 9104 and the third part 9108. The closed end 926 of the inner chamber 922 is located in the narrowing third part 9108. Preferably, the diameter of the third part 9108 reduces approximately to a point at closed end 926 to collect the fluid residing therein to the smallest point possible, and to increase the surface tension of a fluid residing therein to facilitate aspiration of the fluid out of the inner chamber 922. In the embodiment illustrated, the third part 9108 has an inner surface in a catenoid shape, with the closed end 926 located at the apex of the catenoid. The inner surface of the third part 9108 may have other suitably inwardly tapering shapes including straight or curved surfaces. Such shapes include, in particular, conical and frustoconical shapes.

Outer cylindrical wall 912 is connected to inner wall 913 toward the neck 914 and defines an outer chamber directed oppositely to inner chamber 922. The outer chamber has a closed end and an open end, with the open end being at the bottom of the vial 910 and the closed end being located more toward the top or neck 914 of the vial 910. Outer wall 912 effectively forms a shroud or apron extending around much of the inner wall 913 to protect inner chamber 922. The outer wall 912 preferably connects to inner wall 913 adjacent neck 914 and extends downwardly therefrom longitudinally beyond the closed end 926. Optionally, a cap or plug may be received in the open end of the outer chamber so as to provide a larger bottom surface than is provided by the annular footprint of outer wall 912 and to protect inner wall 913 from potentially damaging contact.

The vial socket assembly 940 generally comprises a post 976, a collar 937, an internal thread 941, a second hollow piercing member 978 having a tip 980, and an aperture (not shown) in the tip 980 and a vial socket 982. The post 976 has a male luer slip fitting that permits coupling between the post 976 and a needle hub 974. The second hollow piercing member 978 may be any suitable device known in the art, and in one embodiment is a hollow needle such as a cannula.

The vial socket 982 is appropriately sized and shaped to receive, through an open end 992, the vial 910 having the penetrable closure 916 and cap 920 described above. Preferably, the vial socket 982 has retaining means 984, which in the illustrated embodiment includes inwardly projecting latching ridges, for fitting into neck 914 and underlying the cap 918 of the maximum recovery vial 910 once it is fully inserted into the vial socket 982 (as shown in FIGS. 55 and 56). The retaining means 984 may comprise any suitable latching and retaining structure, including a flange or latching fingers, that serve to engage and retain the head 918 of vial 910 so as to resist or inhibit removal of the vial 910 from vial socket 982.

In the illustrated embodiment, the second hollow piercing member 978 has a length dimensioned to extend substantially the full length of the inner chamber 922 of the vial 910 when the vial 910 is fully engaged within the vial socket 982 (see FIGS. 54 and 55). In particular, as illustrated, in FIGS. 55 and 56 the aperture of tip 980 of the hollow piercing member 978 is located closely adjacent to the apex of closed end 926 of the tip compartment 9108 of the inner chamber 922. As a result (and because all of the diluent transferred into the second compartment tends to remain in the second compartment due to surface tension), the pharmaceutical delivery system 934 is able to transfer substantially all (for example, in the order of about 98%) of the fluid between the vial 910 and the syringe 922. This minimizes the amount of residual fluid that is "held up" or left behind in the inner chamber 922 of vial 910.

In the illustrated embodiment, the vial socket 982 is of sufficient length to overlie most of the outer wall 912 of vial 910 when the vial 910 is fully engaged within the vial socket 982. After the pharmaceutical delivery system 934 has been used to transfer a fluid between the syringe 922 and the vial 910, the vial socket assembly 940 is detached from the needle transfer plunger rod 938 (by unthreading the two and pulling the post 976 of the vial socket assembly 940 out of the needle hub 974) to provide a filled syringe 922 ready for use. Accordingly, the vial socket assembly 940 and the vial 910 can be discarded as a single unit. This design prevents needle sticks during disposal, since the second hollow piercing member 978 resides safely within the inner chamber 922 of the maximum recovery vial 910. Although not shown in FIGS. 54 to 58, plunger rod 942 preferably has a longitudinal window formed therein adjacent an annular shoulder 998, similar to slot 217, for abutting the bottom end of needle hub 974 and preventing withdrawal of the needle hub assembly 944 from needle transfer plunger rod 938 after activation of transfer device 934.

In the illustrated embodiment, the vial socket 982 includes a radially extending flange 990 to assist insertion of the vial 910 into the vial socket 982 by allowing the user to press the bottom of the vial and the flange toward each other. The radially extending flange 990 is located closer to the open end 992 of the vial socket 982, and further from the post 976 of the vial socket 982. This design permits a user to insert the vial 910 with one hand, pressing the user's fingers against flange 990 and thumb against the bottom of vial 910.

The method of deploying the pharmaceutical transfer assembly 936 shown in FIGS. 54-56 is substantially the same as the method for deploying the pharmaceutical transfer assembly 236 in FIGS. 27-37, except as described below. One difference is that it is not necessary to invert the pharmaceutical transfer assembly 936 when a fluid is being transferred from the vial 910 to the syringe 922. This is due to the fact that the second hollow piercing member 978 is sized to extend substantially the full length of the inner chamber 922 of the vial 910 and to be positioned at closed end 926 to withdraw the fluid from the inner chamber 922 at its apex, where the fluid collects. In this embodiment, the liquid residing in the inner chamber 922 of vial 910 is aspirated into syringe 922 by withdrawing the syringe body 924 longitudinally away from the vial 910 when the transfer assembly 936 is in the activated state.

As best seen in FIG. 54, the detachable needle transfer plunger rod 938 has a housing 942, and a needle hub assembly 944. The housing 942 has a first open end 948, a second open end 950 opposite open end 948, and a bore 952 disposed between the first and second open ends 948, 950. The bore 952 is appropriately sized and shaped to receive therein the needle hub assembly 944. The housing 942 generally has an initial portion 994, an adjacent first portion 954 and an adjacent second portion 956. The initial portion 944 has an annular bottom surface 9102 facing opposite to the first portion 954. The initial portion 994 has a larger outer and bore diameter than the first portion 954, which in turn has a larger outer and bore diameter than the second portion 956. A first annular shoulder 998 is formed at the internal bore juncture between the initial and first portions 994, 954. A second inner annular shoulder 958 is formed at the internal bore juncture between the first and second portions 954, 956.

An external female thread 9100 is formed on an outside surface of a base of needle plunger 938 and is sized to matingly cooperate with an internal thread 941 of the vial socket assembly 940. This permits the needle transfer plunger rod 938 to have different longitudinal positions relative to the vial socket assembly 940 by screwing the transfer plunger rod 938 onto or off of internal thread 941 of the vial socket assembly 940. An external thread 966 on the second open end 950 of the housing 942 matingly cooperates with an internal thread 925 contained within the piston 930 to permit the needle transfer plunger rod 938 to be threadedly connected to the piston 930.

The needle hub assembly 944 has a conduit, which in the illustrated embodiment is a first hollow piercing member 970 in the form of a needle having a tip 972. The first hollow piercing member 970 is connected to a needle hub 974. The first hollow piercing member 970 may be any suitable hollow piercing device known in the art, and in one embodiment is a hollow needle such as a standard cannula. The needle hub assembly 944 has a size and shape to permit longitudinal movement within the bore 952 between a retracted or "unactivated" position (as seen in FIG. 55) and an advanced or "activated" position (as seen in FIG. 56).

In the retracted position, the tip 972 of the first hollow piercing member 970 is fully contained within the first portion 954 of the bore 952 of the housing 942. In the advanced position, the tip 972 of the first hollow piercing member 970 protrudes past the second portion 956 of the bore 952 of the housing 942 and penetrates completely through the piston 930. The needle hub 974 has a female luer slip 500 fitting to permit receipt of the post 976 of the vial socket assembly 940. The needle hub 974 and the post 976 act to hold the vial socket assembly 940 to the needle transfer plunger rod 938, when the needle transfer plunger rod 938 is not threadedly connected to the vial socket assembly 940.

The hub assembly 944 is in the retracted or "unactivated" position when the initial portion 994 is screwed into the internal threads 941 of the vial socket assembly 940 an insufficient amount for the hollow piercing member 970 to penetrate through the piston 930. Additionally, the needle hub assembly 944 may be in the retracted or "unactivated" position, when the initial portion annular bottom surface 9102 is seated on a top surface of the internal threads 941 of the vial socket assembly 940 (see FIG. 55). In this situation, as described above, the needle hub 974 and the post 976 act to hold the vial socket assembly 940 to the needle transfer plunger rod 938.

When the needle hub assembly 944 is in the advanced or "activated" position, the initial portion external threads 9100 of the housing 942 are screwed into the internal threads 941 of the vial socket assembly 940, causing the first hollow piercing member 970 to penetrate completely through the piston 930 (see FIG. 56). Adjusting between the retracted or "unactivated" position and the advanced or "activated" position or between the advanced or "activated" position and the retracted or "unactivated" position is effected by screwing the initial portion external threads 9100 of the housing 942 into or out of the internal threads 941 of the vial socket assembly 940, as desired.

When a relatively viscous diluent, such as a carboxy-methyl-cellulose (CMC) solution of less than about 100 cP is injected into vial 910 from vessel 922, it is forced out of the aperture at needle tip 980 and mixes with the powder resting in the second compartment (consisting of second and third parts 9106, 9108). Because of the relatively high viscosity of CMC and the narrow diameter of the second compartment, a relatively high surface tension is created in the fluid, causing the fluid to tend to remain in the second compartment even if the vial 910 is inverted. This means that the fluid mixture does not coat the walls of the inner chamber 922 outside of the second compartment, thus assisting to minimize the residual fluid volume in the vial 910. Further, the relatively high surface tension of the fluid mixture means that the fluid tends to remain together during aspiration as a continuous fluid volume, with almost no fluid left in the vial 910 at closed end 926 after aspiration.

Depending on the particular pharmaceutical constituents and diluents and their intended purpose, there may be some variation in fluid viscosity and fluid volume. Fluids having a viscosity between that of water and mineral oil may be used, corresponding to viscosities of about 1 to 100 cP. Also, the dimensions of the inner chamber 922 and, in particular, the second compartment thereof, may vary somewhat to suit requirements.

Vial socket assembly 940 differs from the vial socket assemblies of other embodiments in that the outer cylindrical wall of vial socket 982 is substantially longer, so as to overlie the outer wall 912 of vial 910, either completely or substantially. This extended outer cylindrical wall serves to appropriately center the vial 910 within vial socket 940, as well as providing protection against potentially damaging contact that may arise from inadvertent knocking or dropping of transfer device 934. Further, the substantial enclosure of vial 910 by vial socket 982 makes it difficult for vial 910 to be removed from vial socket 940 once it has been fully inserted, thus mitigating against possible reuse of the vial socket 940 or vial 910.

Flange 990 preferably extends all the way around the outer cylindrical wall of vial socket 982, although it may alternatively have only a discrete number of radially projecting wings. Flange 990 is preferably positioned on the outer cylindrical wall of vial socket 982 near its open end, although the precise longitudinal position of flange 990 along the outer wall of vial socket 982 is not important. Additionally, vial socket assembly 940 has an upper flange 935 projecting generally radially outwardly adjacent where a head portion 918 of vial 910 is received within vial socket assembly 940. Flange 935 may also be used for gripping by a person's fingers during insertion of vial 910 into vial socket assembly 940 or during activation or use of transfer assembly 934.

Figure 57:
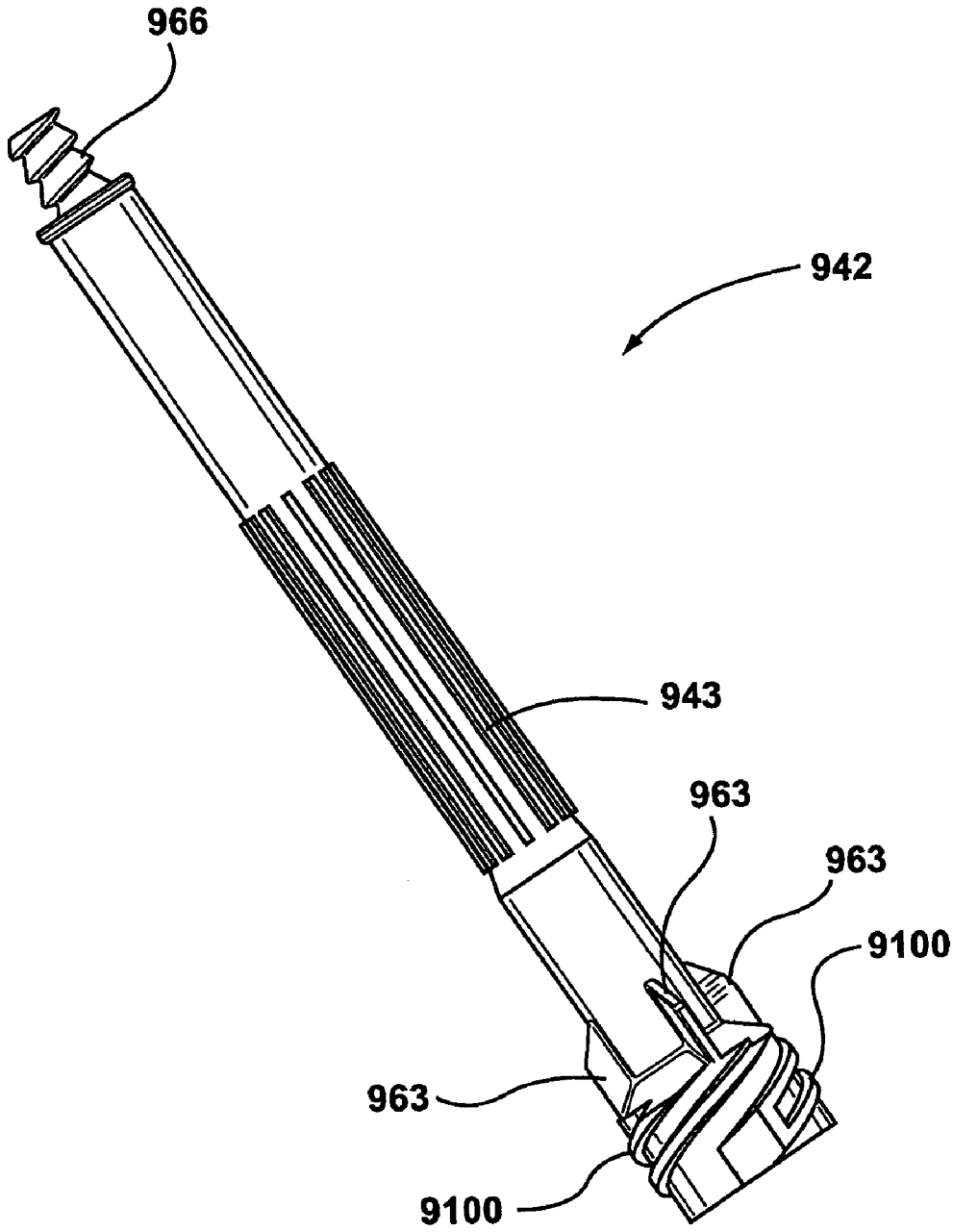
FIG. 57 is a perspective view of a housing, which may also be used as a plunger rod, forming part of the pharmaceutical transfer assembly shown in FIG. 54.

Referring in particular to FIG. 57, the housing 942 is shown in perspective view. Housing 942 has a plurality of longitudinally extending ribs 943 located centrally along a central (generally cylindrical) portion of housing 942. Longitudinal ribs 943 advantageously assist in allowing a person to grip housing 942 during use of transfer assembly 934 while exerting a twisting action on housing 942 during activation or after activation. Housing 942 also has a plurality of buttresses 963 on the outer wall of housing 942 adjacent initial portion 994 and first portion 954 so as to structurally rigidify and reinforce housing 942 against lateral displacement relative to vial socket 940 in the activated position. As is visible in FIG. 58, buttresses 963 extend radially outwardly from housing 942 and contact the inside of collar 937 if housing 942 is laterally displaced, thus mitigating against relative movement of housing 942 in a direction other than axial or longitudinal relative to vial socket assembly 940.

Figure 58:
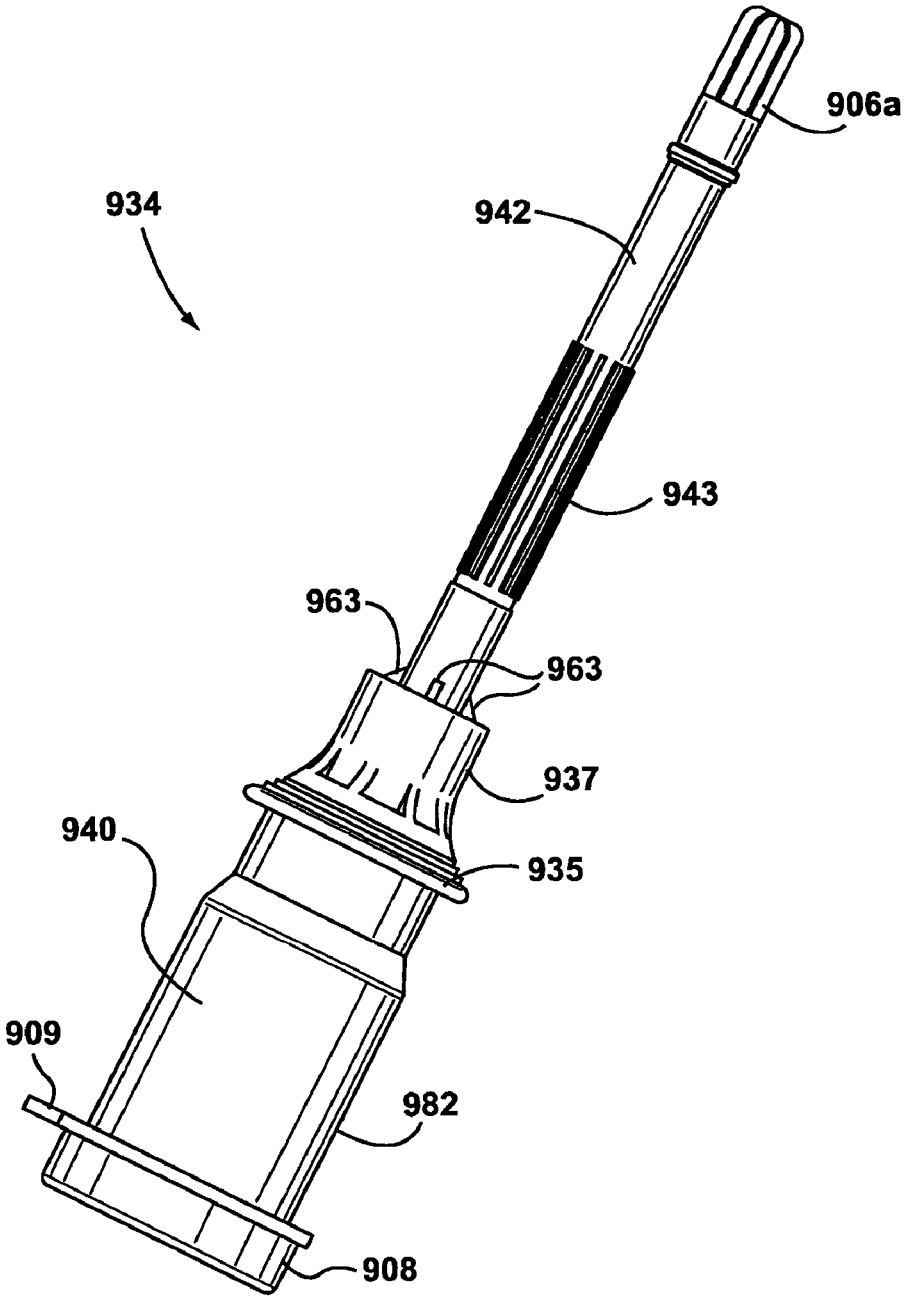
FIG. 58 is a perspective view of a pharmaceutical transfer assembly similar to that shown in FIG. 54, but showing end caps attached.

FIG. 58 shows a version of transfer assembly 934 without the vial 910 or vessel 922. In the version shown in FIG. 58, transfer assembly 934 has an end cap 906*a* enclosing the second portion of housing 942 (and male threads 966).

Transfer assembly 934 also has an end cap 908 disposed on or around open end 992 of vial socket assembly 940. End cap 908 has a radially projecting tab 909, which can be readily pressed upon by a thumb or finger to force end cap 908 off of vial socket assembly 940.

The version of the transfer assembly 934 shown in FIG. 58 may be part of a kit, which also includes a vial and syringe, for assembly and subsequent transfer of fluids between the vial and syringe.

According to the embodiments shown in FIGS. 54 to 56, the detachable needle transfer plunger rod 938 of pharmaceutical transfer assembly 936 shown in FIGS. 54 to 56 does not have a resilient biasing member. This is because the biasing member is not strictly necessary. In this embodiment, the frictional engagement of post 976 with the female luer slip 500 is sufficient to enable retraction of needle 970 from piston 930 when the transfer assembly 936 is returned from the activated position to the unactivated position.

Any one of the pharmaceutical delivery system embodiments previously described herein can employ the vial socket assembly 940 to transfer a fluid to and/or from a maximum recovery vial, providing the needle 978 is of an appropriate length. In particular, the vial socket assembly of pharmaceutical delivery system 34 shown in FIGS. 1-19, pharmaceutical delivery system 134 shown in FIGS. 20-26, pharmaceutical delivery system 434 shown in FIGS. 43-51, pharmaceutical delivery system 734 shown in FIG. 52, and pharmaceutical delivery system 834 shown in FIG. 53 can alternatively employ vial socket assembly 940 to transfer fluid between vial 910 (or another form of maximum recovery vial) and another enclosed volume. Also, according to further embodiments, the pharmaceutical transfer assembly 936 described above can be used with a suitable resilient biasing member, such as is employed by delivery system 134, 434, 734 and 834.

Another difference shown in FIGS. 54-56 is the incorporation of a locking ring 907 (instead of a sheath 207) that is attached to the piston backstop transfer assembly 901. The locking ring 907 has an annular detent 995 that snap fits into the snaps 991*a*, 991*b* on the top plate extensions of a piston backstop 901. This arrangement fixedly attaches the locking ring to the piston backstop 901.

Figure 59B:
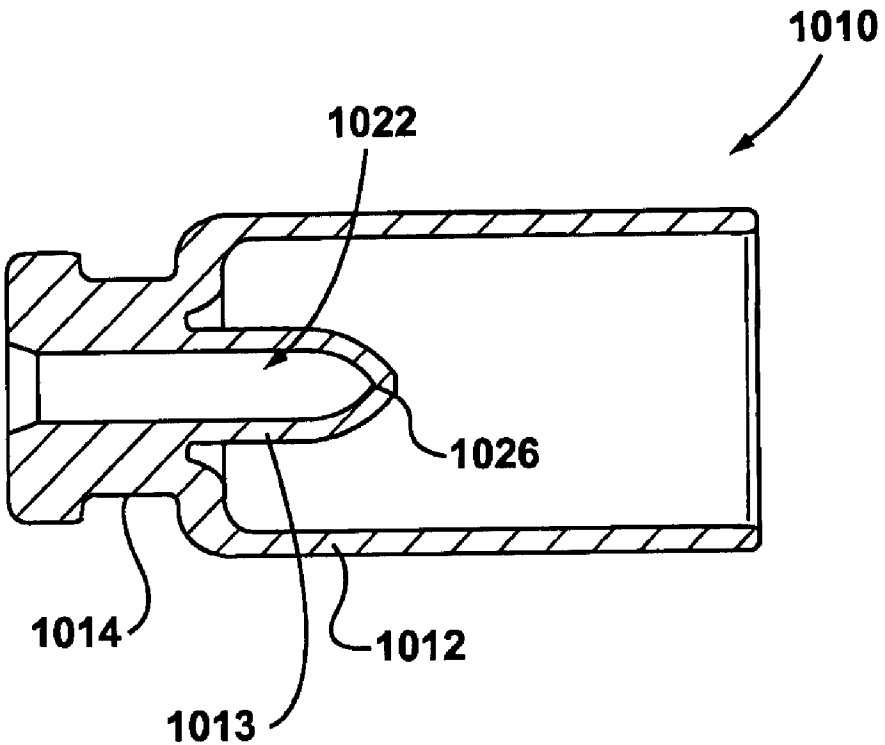
FIG. 59B is a cross-sectional view of the vial of FIG. 59A, taken along line A-A.
Figure 59A:
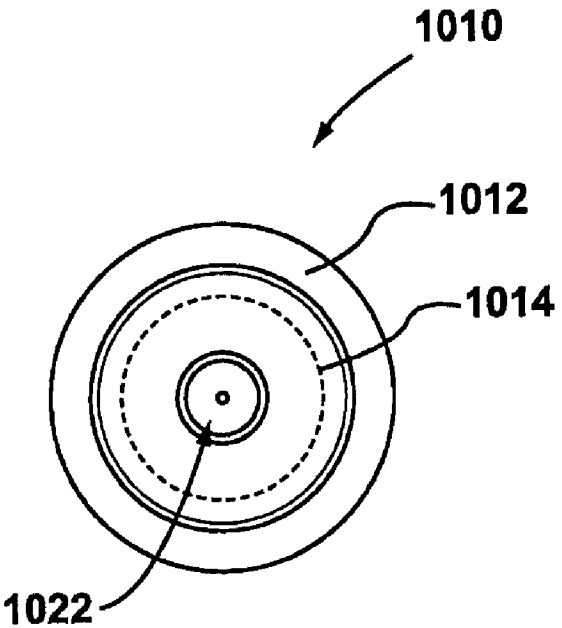
FIG. 59A is a plan view of a vial according to one embodiment.

Referring now to FIGS. 59*a* and 59*b*, a further vial embodiment is shown and designated by reference numeral 1010. Vial 1010 is similar to vial 910 in that it is also a form of maximum recovery vial and has a similar structure, except that vial 1010 has an inner chamber 1022 formed to have a different shape and volume.

Vial 1010 has a somewhat bullet shaped inner chamber 1022. Inner chamber 1022 has a closed end 1026 tapering inwardly toward an apex in the direction of the bottom of the vial 1010. Inner chamber 1022 has an open end opposite the closed end 1026. The open end is adjacent a penetrable seal (not shown) so that a hollow piercing member, such as a needle, can be inserted into inner chamber 1022 through the penetrable seal.

For the vial embodiment shown in FIGS. 59A and 59B, a vial socket assembly suitable for use with vial 1010 has a needle of appropriate length so that, when vial 1010 is fully engaged and received within the vial socket, the tip of the needle (or other hollow piercing member) is positioned closely adjacent the apex at the closed end 1026 of the inner chamber 1022. Thus, if vial 1010 has an inner chamber of different length to the length of the inner chamber of vial 910, the length of the hollow piercing member must be correspondingly different.

Vial 1010 has an outer wall 1012 of similar dimensions to those of a standard vial. Vial 1010 also has an inner wall 1013 at least partially defining the inner chamber 1022 and enclosed by outer wall 1012. Outer wall 1012 and inner wall 1013 are integrally formed and connected to each other toward a neck portion 1014 of vial 1010. Outer wall 1012 generally defines an outer chamber around the inner chamber 1022 and having an open end toward the bottom of vial 1010.

Vial 1010 may be substituted for vial 910 in an alternative embodiment of transfer assembly 934 that has a vial socket and hollow piercing member of suitable length for the length of inner chamber 1022.

Vial 1010 may have neck, head and base diameters similar to those of a standard 13 mm (outside diameter) neck vial. In such a case, the diameter of the inner chamber away from closed end 1026 may be about 3.5 mm. The length of inner chamber 1022 from the open end to the closed end may be between about 17.8 and 18.8 mm. The outer diameter of neck portion 1014 should not exceed about 10.5. The overall length of the vial, not including the cap or penetrable closure, may be about 37.5 mm. The outer diameter of outer wall 1012 may be about 16.8 mm. These dimensions are exemplary only and some modification may be made without altering the working of the invention.

Figure 60:
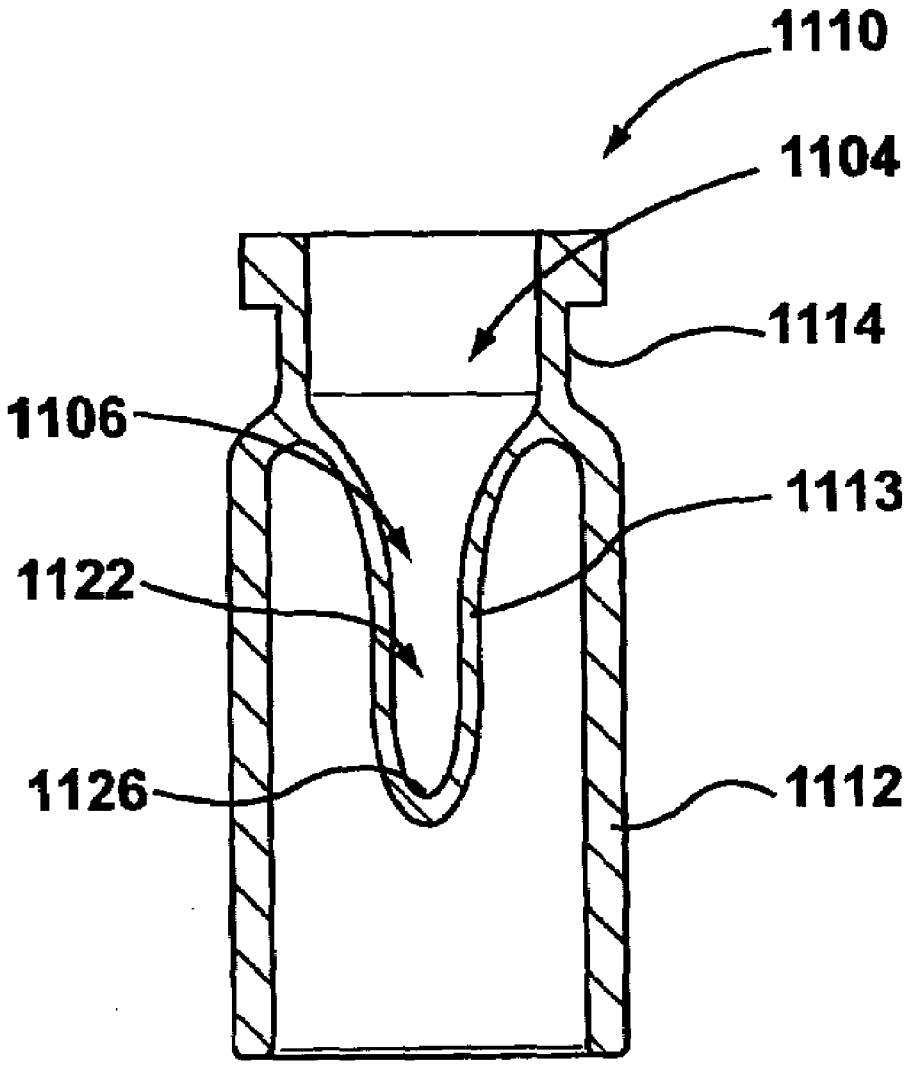
FIG. 60 is a side cross-sectional view of a vial according to another embodiment.

Referring now to FIG. 60, a further vial embodiment is shown and designated by reference numeral 1110. Vial 1110 is similar to vials 910 and 1010 in that it is also a form of maximum recovery vial and has a similar structure. However, vial 1110 has an inner chamber 1122 formed to have a different shape and volume to the inner chambers of vials 910 and 1010.

Vial 1110 has a somewhat elongate nipple shaped inner chamber 1122. Inner chamber 1122 has a closed end 1126 tapering inwardly toward an apex in the direction of the bottom of the vial 1110. Inner chamber 1122 has an open end opposite the closed end. The open end is adjacent a penetrable seal (not shown) so that a hollow piercing member, such as a needle, can be inserted into inner chamber 1122 through the penetrable seal.

For the vial embodiment shown in FIG. 60, the vial socket assembly suitable for use with vial 1110 has a needle of appropriate length so that, when vial 1110 is fully engaged and received within the vial socket, the tip of the needle (or other hollow piercing member) is positioned closely adjacent the apex at the closed end 1126 of the inner chamber 1122. Thus, if vial 1110 has an inner chamber of different length to the length of the inner chamber of vial 910 or vial 1010, the length of the hollow piercing member must be correspondingly different.

Vial 1110 has an outer wall 1112 of similar dimensions to those of a standard 20 mm vial. Vial 1110 also has an inner wall 1113 at least partially defining the inner chamber 1122 and enclosed by outer wall 1112. Outer wall 1112 and inner wall 1113 are connected to each other (and integrally formed) toward a neck portion 1114 of vial 1110. Outer wall 1112 generally defines an outer chamber around the inner chamber 1122 and having an open end toward the bottom of vial 1110.

Inner wall 1113 defines a transitional tapering portion between a portion 1104 of wider diameter towards the open end of inner chamber 1122 and a narrower diameter portion 1106 toward the closed end 1126 of inner chamber 1122. Portions 1104, 1106 generally correspond, in a functional sense, to the first and second compartments, respectively, described in relation to vial 910. The inner wall transitional portion is generally curved, for example in the shape of part of a parabola or part of an exponential curve. Closed end 1126 may be tapered toward a point so as to form a clearly defined downward apex, although the tapering may be relatively gradual at the apex and the closed end 1126 may be formed so as to have a somewhat curved or catenoid shape. As, in practice, it is not readily feasible to taper the inner wall to a point, the phrase "tapering toward a point" should not be construed literally. Rather, it is sufficient that, for the maximum recovery vial embodiments described herein, the inner chamber should taper approximately toward a point or a region that, to the human eye, resembles a point.

The vial 1110 illustrated in FIG. 1160 may have, for example, a 20 mm neck finish. For the illustrated embodiment of vial 1110, the inner chamber may extend about 31 mm from the open end to the apex of the closed end, with the total length of the vial 1110 being about 46 mm. the internal diameter of the neck portion 1114 may be about 13 mm. the transitional portion of inner wall 1113 may form about a third of the length of the inner chamber 1112, with the two constant diameter portions above and below the transitional portion each being about a third of the length of inner chamber 1122. The diameter of the constant diameter portion of inner chamber 1122 towards closed end 1126 may be about 3 mm. These dimensions are exemplary only and some variation may be made without altering the working of the invention.

Vial 1110 may be substituted for vial 910 or vial 1010 in an alternative embodiment of transfer assembly 934 that has a vial socket and hollow piercing member of suitable length for the length of inner chamber 1122. Each of vials 910, 1010 and 1110 are preferably formed by existing tube-forming processes. Alternatively, in order to achieve a suitable shape of the inner chamber, the vial may be formed by a moulding process.

While the above description details features functions and elements of various embodiments, it will be appreciated that the embodiments are susceptible to some modification and change without departing from the spirit and scope of the invention.

We claim:

1. A transfer assembly for transferring a fluid between a vessel and a vial, the vessel having a body with an open end and a slidable piston positioned within the body through the open end, the vial having an inner chamber with an open end and a closed end and a penetrable seal covering the open end of the inner chamber, the closed end tapering toward an apex, the transfer assembly comprising:

a housing having first and second open ends and a bore extending between the first and second open ends, the housing being connectable to the piston through said open end of said vessels;

a conduit having first and second open ends and a passageway extending between first and second ends, the conduit being longitudinally slidable within the bore between a retracted position in which the first open end of said conduit is positioned within at least one of the housing and the piston when the housing is connected to the piston, and an activated position in which the first end of the conduit protrudes through the piston so that the first open end of said conduit is in fluid communication with a chamber of the vessel when the housing is connected to the piston, a hub connected to said second open end of said conduit;

the bore of the housing having a first portion, a second portion adjacent to the first portion, and a shoulder formed between the first and second portions, and wherein the transfer assembly further comprises a resilient biasing member positioned between the shoulder and the hub to bias the conduit into the retracted position; and a vial socket assembly having a vial socket and a hollow piercing member, the vial socket being sized and shaped for receiving and engaging at least a portion of the vial including the penetrable seal, the hollow piercing member having a first open end in fluid communication with the conduit and a second open end for piercing the penetrable seal, the hollow piercing member being sized to extend substantially the full length of the inner chamber of the vial so that the second open end of the hollow piercing member is positioned adjacent the apex of the closed end of the inner chamber when the vial is fully engaged in the vial socket, the vial socket assembly being moveable longitudinally relative to the housing in concert with the conduit so that moving the vial socket assembly longitudinally towards the housing advances the conduit from the retracted position to the activated position to fluidly connect the chamber of the vessel and the inner chamber of the vial.

2. A transfer assembly according to claim 1, wherein the vial socket includes a radially extending flange to assist insertion of the vial into the vial socket.

3. A transfer assembly according to claim 1, wherein the vial socket includes retaining means for retaining the vial in the vial socket when the vial is fully engaged within the vial socket.

4. A transfer assembly according to claim 1, wherein the first end of the conduit forms a piercing tip.

5. A transfer assembly according to claim 1, wherein said vial socket assembly has a post, said hub member being connected to said post which is releasably receivable within the hub.

6. A transfer assembly according to claim 1, wherein the resilient biasing member is a spring.

7. A transfer assembly according to claim 1, wherein the first end of the conduit has a blunt end and the first aperture is an opening on a sidewall of the conduit.

8. A system for transferring a fluid between a vessel and a vial, the system comprising:

a vessel having a body defining a chamber with an open end, the vessel having a slidable piston positioned within the body through the open end;

a vial having an inner chamber with an open end and a closed end and a penetrable seal covering the open end of the inner chamber, the closed end tapering inwardly toward an apex;

a transfer assembly including:

a housing having first and second open ends and a bore extending between the first and second open ends, the housing being connectable to the piston;

a conduit having first and second open ends and a passageway extending between the first and second ends, the conduit being longitudinally slidable within the bore between a retracted position in which the first open end of said conduit is positioned within at least one of the housing and the piston when the housing is connected to the piston, and an activated position in which the first open end of the conduit protrudes through the piston so that the first aperture is in fluid communication with the chamber of the vessel when the housing is connected to the piston, a hub connected to said second open end of said conduit;

the bore of the housing having a first portion, a second portion adjacent to the first portion, and a shoulder formed between the first and second portions, and wherein the transfer assembly further comprises a resilient biasing member positioned between the shoulder and the hub to bias the conduit into the retracted position; and a vial socket assembly having a vial socket and a hollow piercing member, the vial socket being sized and shaped for receiving and engaging at least a portion of the vial including the penetrable seal, the hollow piercing member having a first open end in fluid communication with the conduit and a second open end for piercing the penetrable seal, the hollow piercing member being sized to extend substantially the full length of the inner chamber so that the second open end of the hollow piercing member is positioned adjacent the apex of the closed end of the inner chamber when the vial is fully engaged in the vial socket, the vial socket assembly being moveable longitudinally relative to the housing in concert with the conduit so that moving the vial socket assembly longitudinally towards the housing advances the conduit from the retracted position to the activated position to fluidly connect the chamber of the vessel and the inner chamber of the vial.

9. A system according to claim 8, wherein the vial socket has latches to inhibit removal of the vial from the vial socket once the vial is fully engaged within the vial socket.

10. A system according to claim 8, wherein the vial socket includes a radially extending flange to assist insertion of the maximum recovery vial into the vial socket.

11. A system according to claim 8, wherein the vial socket includes retaining means for retaining the vial in the vial socket when the vial is fully engaged within the vial socket.

12. A system according to claim 8, wherein the inner chamber of the vial is sized to contain a volume of fluid up to about 500 μL.

13. A system according to claim 8, wherein the first end of the conduit forms a piercing tip.

14. A system according to claim 13, wherein said vial socket assembly has a post, said hub being connected to said post which is releasably receivable within the hub.

15. A system according to claim 8, wherein the resilient biasing member is a spring.

16. A system according to claim 8, wherein the first end of the conduit has blunt end and the first aperture is an opening on a sidewall of the conduit.

17. A system according to claim 8, wherein the vessel is a syringe having a neck with a needle mount for removably mounting a needle thereon and a flange adjacent the open end, the system further comprising a piston backstop positioned adjacent the flange, the piston backstop having retaining means for retaining the housing in spaced relation from the piston.

18. A system according to claim 17, further comprising a sheath assembly positioned over the neck of the syringe, the sheath assembly being connectable to the piston backstop.

19. A system according to claim 17, wherein the syringe is plastic and the piston backstop is integrally molded with the syringe.

20. A system according to claim 8, wherein the vessel is a cartridge having a neck with a penetrable closure and a cap to retain the penetrable closure thereon.

21. A system according to claim 20, further comprising a sheath assembly positioned over the neck of the cartridge and a piston backstop connectable to the sheath assembly, the piston backstop having a retaining member for retaining the housing in spaced relation from the piston.

22. A system according to claim 20, wherein the cartridge is plastic and a piston backstop is integrally molded with the cartridge, the piston backstop having a retaining member for retaining the housing in spaced relation from the piston.

23. A method for transferring a fluid between a vessel and a vial, the method comprising the steps of:

a) providing a vessel having a body defining chamber with an open end, the vessel having a slidable piston positioned within the body through the open end;

b) providing a vial having an inner chamber with an open end and a closed end and a penetrable seal covering the open end of the inner chamber, the closed end tapering inwardly toward an apex;

c) providing a transfer assembly including:

I) a housing having first and second open ends and a bore extending between the first and second open ends;

ii) a conduit having first and second ends and first and second apertures adjacent to the first and second ends, respectively, the conduit longitudinally slidable within the bore between a retracted position in which the first end of the conduit is positioned within at least one of the housing and the piston and an activated position in which the first end of the conduit protrudes through the piston into the chamber of the vessel; and iii) a vial socket assembly having a vial socket and a hollow piercing member, the vial socket being sized and shaped for receiving and engaging at least a portion of the vial including the penetrable seal, the hollow piercing member having a first open end in fluid communication with the conduit and a second open end for piercing the penetrable seal, the vial socket assembly being moveable longitudinally relative to the housing in concert with the conduit;

d) in any order, connecting the first open end of the housing to the piston and fully inserting the vial into the vial socket so that the hollow piercing member pierces the penetrable seal and extends substantially the full length of the inner chamber and the second open end of the hollow piercing member is positioned adjacent the apex of the closed end of the inner chamber;

e) advancing the vial socket assembly towards the housing, causing the conduit to advance from the retracted position to the activated position to fluidly connect the chamber of the vessel and the inner chamber of the vial; and f) transferring at lest one fluid between the vessel and the maximum recovery vial through the conduit.

24. A method according to claim 23, wherein the vial is pre-filled with the at least one fluid and step (f) is performed by aspirating the at least one fluid from the vial into the vessel.

25. A method according to claim 23, wherein the vessel is pre-filled with the at least one fluid, the vial contains a pharmaceutical component, and step (f) is performed by injecting the at least one fluid from the vessel into the vial and aspirating the contents of the vial into the vessel.

26. A method according to claim 25, further comprising the step of mixing the contents of the vial after the step of injecting and before the step of aspirating.

27. A method according to claim 26, further comprising, subsequent to step (f), the step of detaching the vial socket assembly from the housing and using the housing as a plunger rod to dispense the contents of the vessel.

* * * * *